US008609311B2

(12) United States Patent
Yamada et al.

(10) Patent No.: US 8,609,311 B2
(45) **Date of Patent: *Dec. 17, 2013**

(54) ELECTROPHOTOGRAPHIC PHOTORECEPTOR, PROCESS CARTRIDGE, AND IMAGE FORMING APPARATUS

(75) Inventors: Wataru Yamada, Kanagawa (JP); Takatsugu Doi, Kanagawa (JP); Katsumi Nukada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 130 days.

This patent is subject to a terminal disclaimer.

(21) Appl. No.: 13/197,416

(22) Filed: Aug. 3, 2011

(65) Prior Publication Data

US 2012/0202146 A1 Aug. 9, 2012

(30) Foreign Application Priority Data

Feb. 4, 2011 (JP) ..... 2011-022933

(51) Int. Cl.
*G03G 5/00* (2006.01)

(52) U.S. Cl.
USPC ..... 430/66; 430/58.05; 430/73; 399/159

(58) Field of Classification Search
USPC ..... 430/66, 58.05, 73; 399/159
See application file for complete search history.

(56) References Cited

U.S. PATENT DOCUMENTS 4,599,286 A 7/1986 Limburg et al.
5,427,880 A 6/1995 Tamura et al.

(Continued)

FOREIGN PATENT DOCUMENTS

JP A-7-072640 3/1995
JP A-9-302011 11/1997

(Continued)

OTHER PUBLICATIONS

Jul. 15, 2013 Office Action issued in U.S. Appl. No. 13/197,399.

(Continued)

*Primary Examiner* — Mark A Chapman
(74) *Attorney, Agent, or Firm* — Oliff & Berridge, PLC

(57) ABSTRACT

Provided is an electrophotographic photoreceptor including: a functional layer containing: a polymer of a first compound having a chain polymerizable functional group and a charge transporting skeleton in one molecule, and at least one second compound selected from a compound including at least one kind of the repeating unit represented by formula (AA) and having a weight average molecular weight of 10000 or less, a compound including at least one kind of the repeating unit represented by formula (BB) and having a weight average molecular weight of 10000 or less, a phthalic ester, a trimellitic ester, a fatty acid ester, a polyhydric alcohol ester, and a polyhydric alcohol ether.

(AA)

(BB)

15 Claims, 6 Drawing Sheets

(56) References Cited

U.S. PATENT DOCUMENTS

| | | | | |
|---|---|---|---|---|
| 5,695,898 | A | 12/1997 | Go et al. | |
| 6,043,334 | A | 3/2000 | Kanamaru et al. | |
| 6,180,303 | B1 | 1/2001 | Uematsu et al. | |
| 6,262,206 | B1 | 7/2001 | Nesvadba et al. | |
| 7,169,521 | B2 | 1/2007 | Tokarski et al. | |
| 7,629,103 | B2 | 12/2009 | Ikuno et al. | |
| 7,842,444 | B2 | 11/2010 | Nukada et al. | |
| 8,373,160 | B2 * | 2/2013 | Yamada et al. | 257/40 |
| 2005/0244732 | A1 | 11/2005 | Tokarski et al. | |
| 2005/0282075 | A1 | 12/2005 | Ikuno et al. | |
| 2007/0178400 | A1 | 8/2007 | Kikuchi et al. | |
| 2007/0231721 | A1 | 10/2007 | Nukada et al. | |
| 2008/0102391 | A1 | 5/2008 | Yanagawa et al. | |
| 2008/0199217 | A1 | 8/2008 | Iwamoto et al. | |
| 2010/0119260 | A1 | 5/2010 | Egawa et al. | |
| 2011/0076603 | A1 * | 3/2011 | Shibata et al. | 430/56 |
| 2012/0100472 | A1 | 4/2012 | Sonobe et al. | |

FOREIGN PATENT DOCUMENTS

| | | |
|---|---|---|
| JP | A-2000-19749 | 1/2000 |
| JP | A-2000-66424 | 3/2000 |
| JP | A-2000-169531 | 6/2000 |
| JP | A-2002-040686 | 2/2002 |
| JP | B2-3287678 | 3/2002 |
| JP | A-2004-012986 | 1/2004 |
| JP | A-2004-240079 | 8/2004 |
| JP | A-2005-234546 | 9/2005 |
| JP | A-2005-321792 | 11/2005 |
| JP | A-2005-345782 | 12/2005 |
| JP | A-2006-010757 | 1/2006 |
| JP | A-2006-234943 | 9/2006 |
| JP | A-2007-264214 | 10/2007 |
| JP | A-2007-322483 | 12/2007 |
| JP | A-2008-058779 | 3/2008 |
| JP | A-2008-216297 | 9/2008 |
| JP | A-2008-225043 | 9/2008 |
| JP | A-2008-225411 | 9/2008 |
| JP | A-2008-233893 | 10/2008 |

OTHER PUBLICATIONS

Feb. 26, 2013 Office Action issued in U.S. Appl. No. 13/197,399.
U.S. Appl. No. 13/197,399 of Sonobe et al. filed Aug. 3, 2011.
U.S. Appl. No. 12/861,280 of Yamada et al. filed Aug. 23, 2010.
May 7, 2012 Office Action issued in U.S. Appl. No. 12/861,280.

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2011-022933 filed Feb. 4, 2011.

BACKGROUND

1. Technical Field

The present invention relates to an electrophotographic photoreceptor, a process cartridge, and an image forming apparatus.

2. Related Art

Generally, an electrophotographic image forming apparatus has the following structure and processes.

Specifically, the surface of an electrophotographic photoreceptor is charged by a charging unit to a desired polarity and potential, and charge is selectively removed from the surface of the electrophotographic photoreceptor after charging by subjecting it to exposure to form an electrostatic latent image. The latent image is then developed into a toner image by attaching a toner to the electrostatic latent image by a developing unit, and the toner image is transferred to a transfer medium by a transfer unit to be discharged as a material on which an image is formed.

SUMMARY

According to an aspect of the invention, there is provided an electrophotographic photoreceptor including:

a functional layer containing:

a polymer of a first compound having a chain polymerizable functional group and a charge transport skeleton in one molecule, and at least one second compound selected from a compound including at least one kind of the repeating unit represented by the following formula (AA) and having a weight average molecular weight of 10000 or less, a compound including at least one kind of the repeating unit represented by the following formula (BB) and having a weight average molecular weight of 10000 or less, a phthalic ester, a trimellitic ester, a fatty acid ester, a polyhydric alcohol ester, and a polyhydric alcohol ether.

(AA)

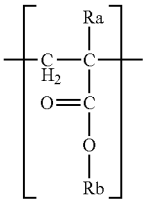

(BB)

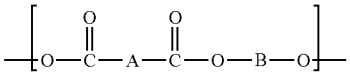

wherein in formulae (AA) and (BB), Ra represents a hydrogen atom or an alkyl group; Rb represents a hydrogen atom, an alkyl group, or an aryl group; and A and B each independently represent an alkylene group having 1 to 20 carbon atoms.

BRIEF DESCRIPTION OF THE DRAWINGS

Exemplary embodiments of the present invention will be described in detail based on the following figures, wherein.

DETAILED DESCRIPTION

[Electrophotographic Photoreceptor]

Figure 1:
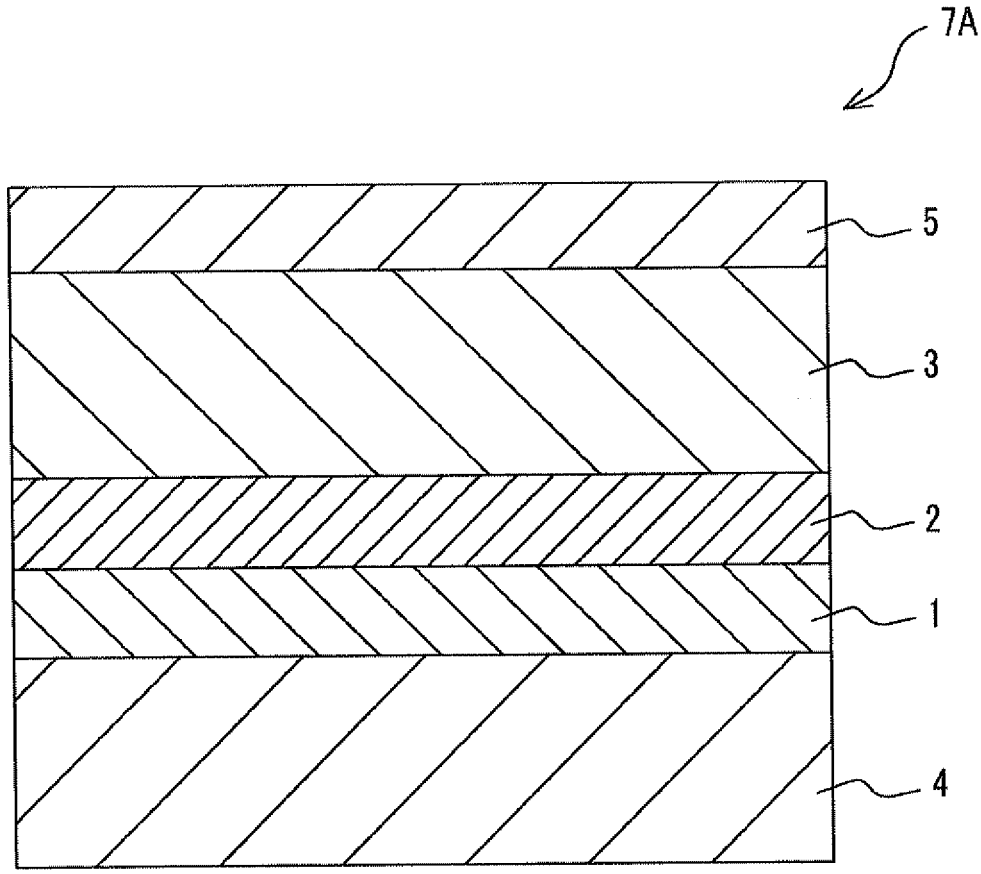
FIG. 1 is a schematic partial cross-sectional view showing an electrophotographic photoreceptor according to an exemplary embodiment.

The electrophotographic photoreceptor according to the present exemplary embodiment is an electrophotographic photoreceptor having a functional layer containing a polymer of a compound having a chain polymerizable functional group and a charge transport skeleton in one molecule (first compound: hereinafter sometimes referred to as a specific charge transporting material), and at least one second compound selected from a compound including at least one kind of the repeating unit represented by the following formula (AA) and having a weight average molecular weight of 10000 or less, a compound including at least one kind of the repeating unit represented by the following formula (BB) and having a weight average molecular weight of 10000 or less, a phthalic ester, a trimellitic ester, a fatty acid ester, a polyhydric alcohol ester, and a polyhydric alcohol ether (second compound: hereinafter sometimes referred to as a specific ester/ether compound).

Here, a layer in which a polymer of a specific charge transporting material is used has high mechanical strength, but when applied in an electrophotographic photoreceptor, deterioration of electrical characteristics, in particular, generation of residual image phenomenon (ghost) caused by a persisting history of previous images occurs in some cases.

Therefore, in the electrophotographic photoreceptor according to the present exemplary embodiment, incorporation of the functional layer makes it possible to inhibit generation of residual image phenomenon (ghost) caused by a persisting history of previous images. The reason therefor is not clear, but is presumed to be as follows.

It is known that in the process of polymerization of a specific charge transporting material, cations, anions, or radicals generated from an initiator, or stimulation (by for example, heat, an electron beam, light, and the like) attacks a chain polymerizable functional group to initiate chain polymerization. It is thought that at this time, frequently, cations, anions, or radicals generated from an initiator, or stimulation (by for example, heat, an electron beam, light, and the like) also attacks a charge transporting site (charge transport skeleton) in the charge transporting material, which leads to deterioration of the electrical characteristics or limitation in molecular motion during a chain polymerization reaction whereby poor polymerization occurs.

In order to suppress this, the above-described stimulation may be solved by using mild conditions, but the mild conditions limit the molecular motion during the chain polymerization reaction. Accordingly, the polymerization reaction barely proceeds and the film strength is not obtained in some cases.

On the contrary, as in the present exemplary embodiment, it is thought that if a specific charge transporting material is used in combination with the specific ester•ether compound, the second compound acts as a plasticizer, and thus, limitation in the molecular motion occurring during the chain polymerization reaction of the specific charge transporting material is inhibited. Further, although the reason is not clear, during the chain polymerization reaction, cations, anions, or radicals generated from an initiator or stimulation (by for example, heat, an electron beam, light, and the like) selectively attack the chain polymerizable functional groups and by the initiation of the chain polymerization, the attack on the charge transporting site (charge transport skeleton) in the charge transporting material is inhibited, and a cured film having excellent strength is formed without interfering with the charge transporting.

As a result, it is thought that in the electrophotographic photoreceptor according to the present exemplary embodiment, generation of residual image phenomenon (ghost) caused by a persisting history of previous images is inhibited.

Furthermore, consequently, it is thought that the functional layer has high mechanical strength and if the functional layer is included as an outermost layer, the mechanical strength is high, and deterioration of the electrical characteristics and image characteristics due to repeated use over a long period of time is inhibited, that is, generation of residual image phenomenon (ghost) caused by a persisting history of previous images due to repeated use is inhibited.

Moreover, in the process cartridge and the image forming apparatus, each of which includes the electrophotographic photoreceptor according to the present exemplary embodiment, an image in which generation of residual image phenomenon (ghost) caused by a persisting history of previous images is inhibited is obtained. In addition, a stable image is obtained.

The electrophotographic photoreceptor according to the present exemplary embodiment has, as described above, the functional layer above, in which the functional layer may be any one of an outermost layer, or any layer other than the outermost layer. However, the outermost layer is preferable from the viewpoints that the mechanical strength is high and generation of residual image phenomenon (ghost) caused by a persisting history of previous images due to repeated use is inhibited.

Here, the outermost layer forms the uppermost surface of the electrophotographic photoreceptor itself, and particularly, it is preferably provided as a layer that functions as a protective layer, or a layer that functions as a charge transporting layer.

In the case where the outermost layer is provided as a layer that functions as a protective layer, a configuration that includes a conductive substrate with a photosensitive layer and a protective layer as an outermost layer thereon, in which the protective layer includes the functional layer, can be exemplified.

On the other hand, in the case where the outermost layer is a layer that functions as a charge transporting layer, a configuration that includes a conductive substrate thereon a charge generating layer and a charge transporting layer as the outermost layer, in which the charge transporting layer includes the functional layer.

Further, in the case where the functional layer includes other layers than the outermost layer, a configuration that includes a photosensitive layer including a charge generating layer and an outermost layer, and a protective layer as an outermost layer on the photosensitive layer, in which the charge transporting layer includes the functional layer, can be exemplified.

Hereinbelow, the electrophotographic photoreceptor according to the present exemplary embodiment in the case where the functional layer is a layer that functions as a protective layer that is an outermost layer will be described in detail with reference to the figures. Further, in the figures, the same or corresponding parts are attached with the same symbols and duplicated explanations are omitted.

FIG. 1 is a schematic cross-sectional view showing a preferable exemplary embodiment of the electrophotographic photoreceptor according to the exemplary embodiment.

Figure 2:
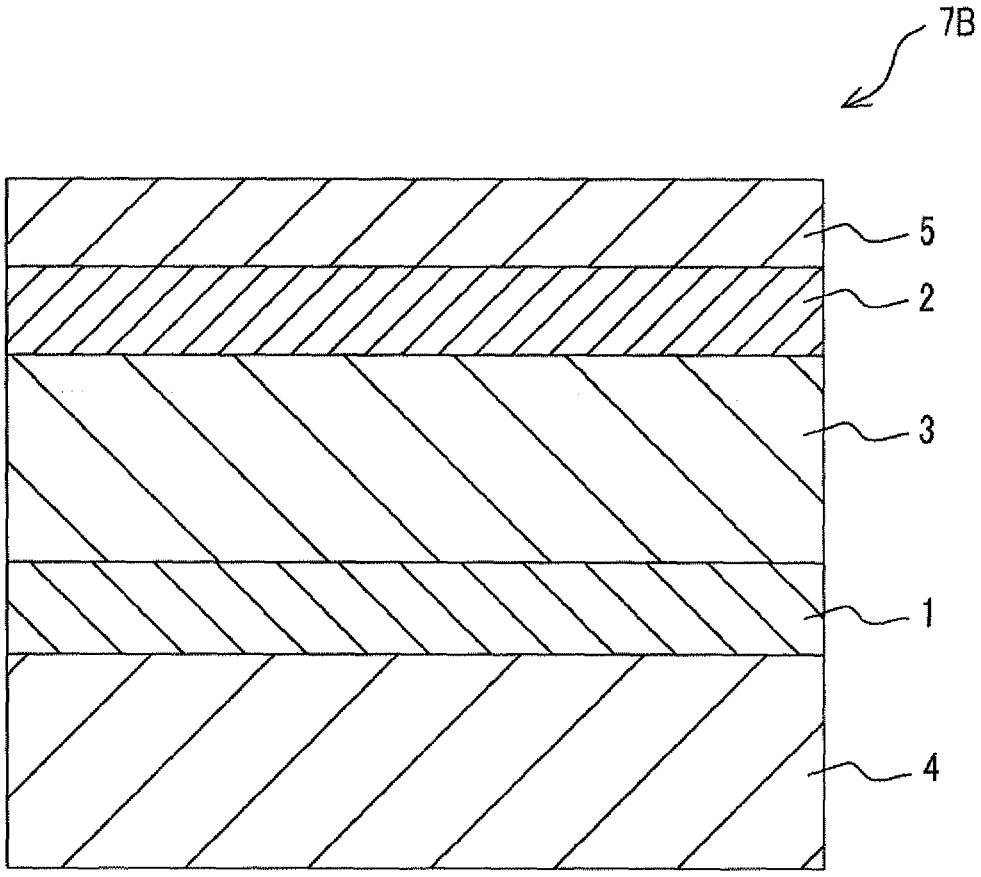
FIG. 2 is a schematic partial cross-sectional view showing an electrophotographic photoreceptor according to another exemplary embodiment.
Figure 3:
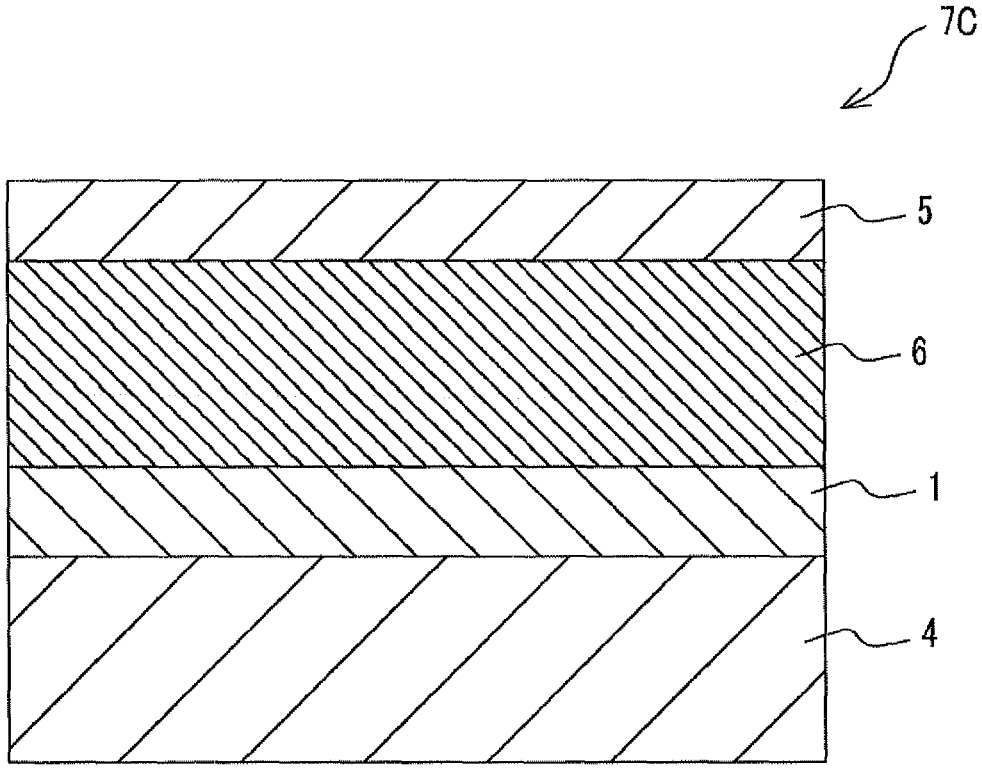
FIG. 3 is a schematic partial cross-sectional view showing an electrophotographic photoreceptor according to a further exemplary embodiment.

FIGS. 2 and 3 are each a schematic cross-sectional view showing the electrophotographic photoreceptor according to different exemplary embodiments.

An electrophotographic photoreceptor 7A shown in FIG. 1 is a so-called function-separate type photoreceptor (or a lamination type photoreceptor) having a structure that includes a conductive substrate 4 having thereon an undercoat layer 1, and having formed thereon a charge generating layer 2, a charge transporting layer 3, and a protective layer 5 in order. In the electrophotographic photoreceptor 7A, a photosensitive layer consists of the charge generating layer 2 and the charge transporting layer 3.

The electrophotographic photoreceptor 7B shown in FIG. 2 is a function-separate type photoreceptor, in which the functions of the charge generating layer 2 and the charge transporting layer 3 are separated as in the electrophotographic photoreceptor 7A shown in FIG. 1. Further, the electrophotographic photoreceptor 7C shown in FIG. 3 contains a charge generating material and a charge transporting material in the same layer (single layer type photosensitive layer 6 (charge generating/charge transporting layer)).

The electrophotographic photoreceptor 7B shown in FIG. 2 has a constitution in which an undercoat layer 1 is provided on a conductive substrate 4, and a charge transporting layer 3, a charge generating layer 2, and a protective layer 5 are formed in order thereon. In the electrophotographic photoreceptor 7B, the photosensitive layer includes the charge transporting layer 3 and charge generating layer 2.

Furthermore, the electrophotographic photoreceptor 7C shown in FIG. 3 has a constitution in which the undercoat layer 1 is provided on the conductive substrate 4, and the single layer type photosensitive layer 6 and the protective layer 5 are formed in order thereon.

Moreover, the electrophotographic photoreceptors 7A to 7C shown in FIGS. 1 to 3 have a constitution in which the protective layer 5 is formed as an outermost layer disposed on a side farthest from the conductive substrate 2, in which the outermost layer includes the functional layer.

Further, in the electrophotographic photoreceptors shown in FIGS. 1 to 3, the undercoat layer 1 may or may not be provided.

Hereinafter, each of the components will be described on the basis of the electrophotographic photoreceptor 7A shown in FIG. 1 as a representative example.

(Conductive Substrate)

As the conductive substrate, any material that has been conventionally used may be used. Examples thereof include plastic films or the like provided with thin films (for example, metals such as aluminum, titanium, nickel, chromium, stainless steel, and the like, and films of aluminum, titanium, nickel, chromium, stainless steel, gold, vanadium, tin oxide, indium oxide, indium tin oxide (ITO), or the like), paper that is coated with or impregnated with a conductivity imparting agent, plastic films that are coated with or impregnated with a conductivity imparting agent, and the like. The shape of the substrate is not limited to a cylindrical shape and it may be a sheet shape or a plate shape.

In addition, the conductive substrate preferably has conductivity with a volume resistivity, for example, of less than $10^7$ Ω·cm.

When a metal pipe is used as the conductive substrate, the surface thereof may be the surface of a bare metal pipe itself or may be subjected beforehand to a treatment such as mirror grinding, etching, anodic oxidation, coarse grinding, centerless grinding, sandblasting, wet honing, and the like.

(Undercoat Layer)

The undercoat layer may be provided, as required, for the purpose of prevention of light reflection at the surface of the conductive substrate, prevention of inflow of unnecessary carrier from the conductive substrate into the photosensitive layer, or the like.

The undercoat layer is configured to include, for example, a binder resin and other additives, as required.

Examples of the binder resin contained in the undercoat layer include known polymer resin compounds, for example, acetal resins such as polyvinyl butyral and the like, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins, urethane resins, and the like; charge transporting resins having charge transporting groups; and conductive resins such as polyaniline and the like. Among these, resins which are insoluble in the coating solvent for the upper layer are preferably used, and phenolic resins, phenol-formaldehyde resins, melamine resins, urethane resins, epoxy resins, or the like are particularly preferably used.

The undercoat layer may contain, for example, metal compounds such as a silicon compound, an organic zirconium compound, an organic titanium compound, an organic aluminum compound, and the like.

The ratio of the metal compound to the binder resin is not particularly limited, but is determined within a range in which desired electrophotographic photoreceptor characteristics are obtained.

Resin particles may also be added to the undercoat layer for adjusting the surface roughness. Examples of the resin particles include silicone resin particles, crosslinking type polymethyl methacrylate (PMMA) resin particles, and the like. Further, the undercoat layer may be formed and then subjected to grinding for adjusting the surface roughness thereof. As the grinding method, buffing grinding, a sandblast treatment, wet honing, a grinding treatment, or the like is used.

Here, examples of the constitution of the undercoat layer include a constitution in which the undercoat layer contains at least a binder resin and conductive particles. Further, the conductive particles preferably have conductivity with a volume resistivity, for example, of less than $10^7$ Ω·cm.

Examples of the conductive particle include metal particles (particles of aluminum, copper, nickel, silver, or the like), conductive metal oxide particles (particles of antimony oxide, indium oxide, tin oxide, zinc oxide, or the like), conductive material particles (particles of carbon fiber, carbon black, or graphite powders), and the like. Among these, conductive metal oxide particles are suitable. The conductive particles may be used as a mixture of 2 or more kinds thereof Furthermore, the conductive particles may be used after adjustment of the resistivity by performing a surface treatment with a hydrophobizing treatment agent (for example, a coupling agent) or the like.

The content of the conductive particles is preferably, for example, 10% by mass or more and 80% by mass or less, and more preferably 40% by mass or more and 80% by mass or less, based on the binder resin.

When the undercoat layer is formed, a coating liquid for forming an undercoat layer, to which the components as described above are added, is used.

Furthermore, for a method for dispersing the particles in the coating liquid for forming an undercoat layer, a media disperser such as a ball mill, a vibration ball mill, an attritor, a sand mill, a horizontal-type sand mill, and the like, or a medialess disperser such as a stirrer, an ultrasonic disperser, a roll mill, a high-pressure homogenizer, and the like, is used. Examples of the high-pressure homogenizer include a homogenizer using a collision method including subjecting a dispersion liquid to liquid-liquid collision or liquid-wall collision at high pressure so as to perform dispersing, a homogenizer using a flow-through method including allowing the dispersion liquid to flow through a fine flow path at high pressure so as to perform dispersing, and the like.

Examples of the method of coating the coating liquid for forming an undercoat layer on a conductive substrate include a dip coating method, a push-up coating method, a wire bar coating method, a spray coating method, a blade coating method, a knife coating method, a curtain coating method, and the like.

The film thickness of the undercoat layer is preferably 15 μm or more, and more preferably 20 μm or more and 50 μm or less.

Here, although not shown, an intermediate layer may be further provided between the undercoat layer and the photosensitive layer. Examples of the binder resin used in the intermediate layer include organic metal compounds containing a zirconium atom, a titanium atom, an aluminum atom, a manganese atom, a silicon atom, and the like, in addition to polymer resin compounds, for example, acetal resins such as polyvinyl butyral and the like, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, melamine resins, and the like. These compounds may be used singly or in a mixture of plural kinds of the compounds or a polycondensate thereof. Among these, the organic metal compound containing zirconium or silicon is suitable from the viewpoint of a low residual potential, small change in potential due to the environment, small change in potential due to repeated use, or the like.

When the intermediate layer is formed, a coating liquid for forming an intermediate layer, which is formed by adding the components to a solvent, is used.

As a coating method for forming the intermediate layer, an ordinary method, such as a dip coating method, a push-up coating method, a wire bar coating method, a spray coating method, a blade coating method, a knife coating method, a curtain coating method, and the like is used.

Moreover, the intermediate layer also functions as an electrical blocking layer in addition to improving the coatability of the upper layer. However, when the thickness of the intermediate layer is excessively large, the electric barrier sometimes becomes excessively strong, thereby causing desensitization or an increase in potential over repetition. Therefore, when the intermediate layer is formed, the thickness thereof is adjusted to be in the range of 0.1 μm or more and 3 μm or less. Further, the intermediate layer in this case may be used as the undercoat layer.

(Charge Generating Layer)

The charge generating layer is formed, for example, of a charge generating material in a binder resin. Examples of the charge generating material include phthalocyanine pigments, such as metal-free phthalocyanine, chlorogallium phthalocyanine, hydroxygallium phthalocyanine, dichlorotin phthalocyanine, titanyl phthalocyanine, and the like. In particular, the examples include a chlorogallium phthalocyanine crystal having strong diffraction peaks at Bragg angles)(2θ±0.2°) to CuKα characteristic X-rays of at least 7.4°, 16.6°, 25.5°, and 28.3°, a metal-free phthalocyanine crystal having strong diffraction peaks at Bragg angles)(2θ±0.2°) to CuKα characteristic X-rays of at least 77°, 9.3°, 16.9°, 17.5°, 22.4°, and 28.8°, a hydroxygallium phthalocyanine crystal having strong diffraction peaks at Bragg angles)(2θ±0.2°) to CuKα characteristic X-rays of at least 7.5°, 9.9°, 12.5', 16.3 °, 18.6°, 25.1°, and 283°, or a titanyl phthalocyanine crystal having strong diffraction peaks at Bragg angles)(2θ±0.2°) to CuKα characteristic X-rays of at least 9.6°, 24.1°, and 27.2°. Examples of the charge generating material further include quinone pigments, perylene pigments, indigo pigments, bisbenzimidazole pigments, anthrone pigments, quinacridone pigments, and the like. Further, the charge generating material may be used singly or in a mixture of 2 or more kinds thereof.

Examples of the binder resin constituting the charge generating layer include polycarbonate resins of a bisphenol A type, a bisphenol Z type, or the like, an acrylic resin, a methacrylic resin, a polyarylate resin, a polyester resin, a polyvinyl chloride resin, a polystyrene resin, an acrylonitrile styrene copolymer resin, an acrylonitrile-butadiene copolymer, a polyvinyl acetate resin, a polyvinyl formal resin, a polysulfone resin, a styrene-butadiene copolymer resin, a vinylidene chloride acrylonitrile copolymer resin, a vinyl chloride-vinyl acetate maleic anhydride resin, a silicone resin, a phenol-formaldehyde resin, a polyacryl amide resin, a polyamide resin, a poly-N-vinyl carbazole resin, and the like. These binder resins may be used singly or in a mixture of 2 or more kinds thereof.

Further, the blending ratio of the charge generating material and the binder resin is, for example, in the range of 10:1 to 1:10, When the charge generating layer is formed, a coating liquid for forming charge generating layer formed by adding the components to a solvent is used.

As a method for dispersing the particles (for example, charge generating materials) in the coating liquid for forming a charge generating layer, a media disperser such as a ball mill, a vibration ball mill, an attritor, a sand mill, a horizontal-type sand mill, and the like, or a medialess disperser such as a stirrer, an ultrasonic disperser, a roll mill, a high-pressure homogenizer, and the like, is used. Examples of the high-pressure homogenizer include a homogenizer using a collision method including subjecting a dispersion liquid to liquid-liquid collision or liquid-wall collision at high pressure so as to perform dispersing, a homogenizer using a flow-through method including allowing the dispersion liquid to flow through a fine flow path at high pressure so as to perform dispersing, and the like.

Examples of the method for coating the coating liquid for forming a charge generating layer on the undercoat layer include a dip coating method, a push-up coating method, a wire bar coating method, a spray coating method, a blade coating method, a knife coating method, a curtain coating method, and the like.

The film thickness of the charge generating layer is set to be preferably in the range of 0.01 μm or more and 5 μm or less, and more preferably in the range of 0.05 μm or more and 2.0 μm or less.

(Charge Transporting Layer)

The charge transporting layer is configured to include the charge transporting material, and if necessary, a binder resin.

Examples of the charge transporting materials include hole transporting materials, for example, oxadiazole derivatives such as 2,5-bis-(p-diethylaminophenyl)-1,3,4-oxadiazole and the like, pyrazoline derivatives such as 1,3,5-triphenylpyrazoline, 1-[pyridyl-(2)]-3-(p-diethylaminostyryl)-5-(p-diethylaminostyryl)pyrazoline, and the like, aromatic tertiary amino compounds such as triphenylamine, N,N'-bis(3,4-dimethylphenyl)biphenyl-4-amine, trip-methylphenyl)aminyl-4-amine, dibenzylaniline, and the like, aromatic tertiary diamino compounds such as N,N'-bis(3-methylphenyl)-N,N'-diphenylbenzidine and the like, 1,2,4-triazine derivatives such as 3-(4'-dimethylaminophenyl)-5,6-di-(4'-methoxyphenyl)-1,2,4-triazine and the like, hydrazone derivatives such as 4-diethylaminobenzaldehyde-1,1-diphenylhydrazone and the like, quinazoline derivatives such as 2-phenyl-4-styrylquinazoline and the like, benzofuran derivatives such as 6-hydroxy-2,3-di-(p-methoxyphenyl)-benzofuran and the like, a-stilbene derivatives such as p-(2,2-diphenylvinyl)-N,N-diphenylaniline and the like, enamine derivatives, and the like, carbazole derivatives such as N-ethylcarbazole and the like, poly-N-vinylcarbazole, a derivative thereof, and the like; electron transporting materials, for example, quinone compounds such as chloranil, bromoanthraquinone, and the like, tetracyanoquinodimethane compounds, and the like, fluorenone compounds such as 2,4,7-trinitrofluorenone, 2,4,5,7-tetranitro-9-fluorenone, and the like, xanthone-based compounds, thiophene compounds, and the like, polymers whose main chains or side chains have groups consisting of the compounds described above, and the like. The charge transporting materials may be used singly or in combination of 2 or more kinds thereof.

Examples of the binder resin constituting the charge generating layer include insulating resins, for example, polycarbonate resins of a bisphenol A type, a bisphenol Z type, or the like, an acrylic resin, a methacrylic resin, a polyarylate resin, a polyester resin, polyvinyl chloride resins, polystyrene resins, acrylonitrile styrene copolymer resins, acrylonitrile-butadiene copolymer resins, polyvinyl acetate resins, polyvinyl formal resins, polysulfone resins, styrene butadiene copolymer resins, vinylidene chloride acrylnitrile copolymer resins, vinyl chloride-vinyl acetate-maleic anhydride resins, silicone resins, phenol-formaldehyde resins, polyacryl amide resins, polyamide resins, chlorine rubber, and the like, and organic light conductive polymers such as polyvinyl carbazole, polyvinyl anthracene, polyvinyl pyrene, and the like. These binder resins may be used singly or in a mixture of 2 or more kinds thereof.

Further, the blending ratio of the charge transporting material and the binder resin is, for example, 10:1 to 1:5.

The charge transporting layer is formed by adding the components in a solvent and using the coating liquid for forming a charge transporting layer.

As a method for dispersing the particles (for example, fluorine resin particles) in the coating liquid for forming a charge transporting layer, a media disperser such as a ball mill, a vibration ball mill, an attritor, a sand mill, a horizontal-type sand mill, and the like, or a medialess disperser such as a stirrer, an ultrasonic disperser, a roll mill, a high-pressure homogenizer, and the like, is used. Examples of the high-pressure homogenizer include a homogenizer using a collision method including subjecting a dispersion liquid to liquid-liquid collision or liquid-wall collision at high pressure so as to perform dispersing, a homogenizer using a flow-through method including allowing the dispersion liquid to flow through a fine flow path at high pressure so as to perform dispersing, and the like.

Examples of the method of coating the coating liquid for forming a charge transporting layer on the charge generating layer include ordinary methods such as a dip coating method, a push-up coating method, a wire bar coating method, a spray coating method, a blade coating method, a knife coating method, a curtain coating method, and the like.

The film thickness of the charge transporting layer is set to be preferably in the range of 5 μm or more and 50 μm or less, and more preferably 10 μm or more and 40 μm or less.

(Protective Layer)

The protective layer is a functional layer which is configured to include a polymer of a specific charge transporting material and a polymer of a specific ester•ether compound.

Specifically, the protective layer (functional layer) is, for example, a functional layer including a cured film obtained by coating a charge transporting composition including at least a specific charge transporting material and a specific ester•ether compound and then polymerizing a specific charge transporting material, thereby performing curing.

Here, this polymer may be a copolymer with other monomers, or may be a non-crosslinked polymer or a crosslinked polymer having a so-called 3-dimensional web structure. This crosslinking non-crosslinking is regulated, for example, by the number of the chain polymerizable functional groups of the specific charge transporting material. Specifically, for example, in the case where the number of the chain polymerizable functional groups is 2 or more, the polymer easily becomes linear or non-crosslinked (however, it does not necessarily become non-crosslinked), and in the case where the number of the chain polymerizable functional groups is 3 or more, the polymer easily becomes crosslinked.

In the first place, the specific ester•ether compound will be described.

As the specific ester•ether compound, at least one kind of the repeating unit represented by the following formula (AA) and having a weight average molecular weight of 10000 or less (hereinafter sometimes referred to as the compound of formula (AA)), a compound including at least one kind of the repeating unit represented by the following formula (BB) and having a weight average molecular weight of 10000 or less (hereinafter sometimes referred to as the compound of formula (BB)), a phthalic ester, a trimellitic ester, a fatty acid ester, a polyhydric alcohol ester, and a polyhydric alcohol ether, is applied.

(AA)

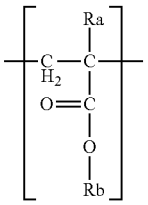

(BB)

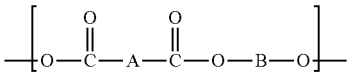

In formula (AA), Ra represents a hydrogen atom or an alkyl group, and Rb represents a hydrogen atom, an alkyl group, or an aryl group.

In formula (BB), A and B each independently represent an alkylene group having 1 to 20 carbon atoms.

Here, in formula (AA), the alkyl group represented by Ra favorably has, for example, 1 to 50 carbon atoms, preferably 1 to 5 carbon atoms, and more preferably 1 to 2 carbon atoms.

In formula (AA), the alkyl group or the aryl group represented by Rb preferably has 1 to 50 carbon atoms, and more preferably 2 to 20 carbon atoms.

The alkyl group may be any one of linear, branched, and cyclic alkyl groups, and for instance, specific examples of the linear alkyl group include a methyl group, an ethyl group, a propyl group, a butyl group, a pentyl group, a hexyl group, a heptyl group, an octyl group, a decyl group, a dodecyl group, an octadecyl group, and an icosyl group, specific examples of the branched alkyl group include an isopropyl group, an isobutyl group, a triisobutyl group, a sec-butyl group, a tert-butyl group, an isopentyl group, a tert-pentyl group, an isohexyl group, a tert-hexyl group, an isoheptyl group, a tert-heptyl group, an isooctyl group, a tert-octyl group, an isotridecyl group, an isocetyl group, and an isostearyl group, and specific examples of the cyclic alkyl group include a cyclohexyl group and the like.

Specific examples of the aryl group include a phenyl group, a naphthyl group, and the like, which are substituted or unsubstituted.

In formula (BB), the alkylene group represented by A and B has 1 to 20 carbon atoms, preferably 1 to 18 carbon atoms, and more preferably 2 to 10 carbon atoms, may be either linear or branched, and specific examples thereof include a methylene group, an ethylene group, a propylene group, a butylene group, a pentylene group, a hexylene group, a heptylene group, an octylene group, and the like.

The compound of formula (AA) will be described.

The compound of formula (AA) may be a homopolymer having the repeating units represented by formula (AA) or a copolymer having the repeating units with other repeating units.

However, in the case where the compound of formula (AA) is a copolymer having the repeating units represented by formula (AA) with other repeating units, it preferably contains the repeating units represented by formula (AA) in an amount of at least 5% by mass or more (preferably 10% by mass or more).

Of course, the compound of formula (AA) may be a copolymer of different kinds of the repeating units represented by formula (AA).

Particularly, from the viewpoint of inhibition of generation of ghost, the repeating unit represented by formula (AA) is preferably a repeating unit in which Ra represents a hydrogen atom or methyl and Rb represents an alkyl group or aryl group having 1 to 10 carbon atoms, and more preferably a repeating unit in which Ra represents a hydrogen atom or methyl and Rb represents an alkyl group having 1 to 6 carbon atoms.

Examples of other repeating units include repeating units with monomers such as styrene, acrylic acid, methacrylic acid, maleic acid, maleic ester, fumaric acid, fumaric ester, and the like.

The compound of formula (AA) has a weight average molecular weight Mw of 10000 or less, preferably 200 to 10000, and more preferably 3000 to 8000.

Furthermore, the weight average molecular weight Mw is obtained by analyzing a THF (tetrahydrofuran)-soluble material in THF solvent using a GPC-HLC-8120 manufactured by Tosoh Corporation and a TSKgel Super HM-M (15 cm) column manufactured by Tosoh Corporation, and calculating using a molecular weight calibration curve created from a monodisperse polystyrene standard sample.

Specific examples of the compound of formula (AA) include at least one kind of polymer of the monomers shown below.

Examples of the monomer include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene methacrylate, hydroxyethyl o-phenyl phenol acrylate, o-phenyl phenol glycidyl ether acrylate, and the like.

Furthermore, examples of the commercially available product of the compound of formula (AA) include ARUFON UP-1000 (weight average molecular weight Mw 3000), UP-1020 (weight average molecular weight Mw 2000), UP-1021 (weight average molecular weight Mw 1600), UP-1080 (weight average molecular weight Mw 5000), UP-1110 (weight average molecular weight Mw 2500), UP-1170 (weight average molecular weight Mw 8000) (all manufactured by Toagosei Co., Ltd.), and the like.

The compound of formula (BB) will be described.

The compound of formula (BB) may be a homopolymer having the repeating units represented by formula (BB) or a copolymer having the repeating units with other repeating units.

However, in the case where the compound of formula (BB) is a copolymer having the repeating units represented by formula (BB) with other repeating units, it preferably contains the repeating units represented by formula (BB) in an amount of at least 5% by mass or more (preferably 10% by mass or more).

Of course, the compound of formula (BB) may be a copolymer of different kinds of the repeating units represented by formula (BB).

Particularly, from the viewpoint of inhibition of generation of ghost, the repeating unit represented by formula (BB) is preferably a repeating unit in which A represents a branched or linear alkylene group having 1 to 20 carbon atoms and B represents a branched or linear alkylene group having 1 to 20 carbon atoms, more preferably a repeating unit in which A represents a branched or linear alkylene group having 1 to 10 carbon atoms and B represents a branched or linear alkylene group having 1 to 10 carbon atoms, and even more preferably a repeating unit in which A represents a linear alkylene group having 2 to 6 carbon atoms and B represents a linear alkylene group having 2 to 6 carbon atoms.

Examples of the other repeating units include the repeating units in which in formula (BB), A and B each represent a group including —O—, —NH—, —CO—, —COO—, and an arylene group, in addition to a branched or linear alkylene group having 1 to 20 carbon atoms.

The compound of formula (BB) has a weight average molecular weight Mw of 10000 or less, preferably 200 or more and 10000 or less, and more preferably 2000 or more and 8000 or less.

Specific examples of the compound of formula (BB) include at least one kind of the polymers of the monomers shown below.

Examples of the monomer include phthalic acid, malonic acid, succinic acid, glutaric acid, adipic acid, pimelic acid, suberic acid, azelaic acid, sebacic acid, phthalic acid, isophthalic acid, terephthalic acid, and the like.

Examples of the commercially available product of the compound of formula (BB) include D623 (weight average molecular weight Mw approximately 1800), D643 (weight average molecular weight Mw approximately 1800), D663 (weight average molecular weight Mw approximately 1800), D620 (weight average molecular weight Mw approximately 800), D620N (weight average molecular weight Mw approximately 800), D623N (weight average molecular weight Mw approximately 1800), D645 (weight average molecular weight Mw approximately 2200), and D663D (weight average molecular weight Mw approximately 2000) (all manufactured by J-PLUS Co., Ltd.), and the like.

Further, examples of the terminal group of the compound of formula (BB) include an aryl group and the like.

The phthalic ester will be described.

Examples of the phthalic ester include benzyl 2-ethylhexyl phthalate, benzylbutyl phthalate, benzylisononyl phthalate, bis(2-ethylhexyl)phthalate, di-n-octyl phthalate, diamyl phthalate, dibutyl phthalate, dicyclohexyl phthalate, diethyl phthalate, dihexyl phthalate, diisobutyl phthalate, diisodecyl phthalate, diisononyl phthalate, diisopropyl phthalate, dimethyl isophthalate, dimethyl phthalate, dinonyl phthalate, diphenyl phthalate, dipropyl phthalate, ditrideeyl phthalate, and diundecyl phthalate (all manufactured by Tokyo Chemical Industry Co., Ltd.), and the like.

Among these, from the viewpoint of inhibition of generation of ghost, dibutyl phthalate is preferable.

The trimellitic ester will be described.

Examples of the trimellitic ester include tris(2-ethylhexyl) trimellitic acid, tri-normal-octyl trimellitate, and the like.

The fatty acid ester will be described.

Examples of the fatty acid ester include adipic ester, azelaic ester, fumaric ester, maleic ester, sebacic ester, succinic ester, oleic ester, and citric ester.

Specific examples of the fatty acid ester include divalent esters (for example, bis(2-butoxyethyl) adipate, bis(2-ethylhexyl) adipate, bis(2-butoxyhexyl) azelate, bis(2-ethylhexyl) azelate, bis(2-butoxyhexyl) fumarate, bis(2-ethylhexyl) maleate, bis(2-ethylhexyl) sebacate, di-n-alkyl adipate (mixture), di-n-octyl sebacate, dibutyl adipate, dibutyl fumarate, dibutyl maleate, dibutyl sebacate, diethyl adipate, diethyl maleate, diethyl sebacate, diethyl succinate, diisobutyl adipate, diisodecyl adipate, diisononyl adipate, diisopropyl adipate, dimethyl adipate, dimethyl maleate, dimethyl sebacate, dipropyl adipate, ethyl oleate, propyl oleate, heptylnonyl adipate, and methyl oleate (all manufactured by Tokyo Chemical Industry Co., Ltd.), and the like), and polyvalent esters (for example, butyl phthalyl butyl glycolite, ethyl phthalyl ethyl glycolite, triethyl O-acetyl citrate, methyl O-acetyl licinolate, triamyl citrate, tributyl citrate, tributyl O-acetyl citrate, triethyl citrate, tripropyl citrate, and the like).

Among these, from the viewpoint of inhibition of generation of ghost, bis(2-ethylhexyl) adipate is preferable.

The polyhydric alcohol ester and the polyhydric alcohol ether will be described.

Examples of the polyhydric alcohol ester and the polyhydric alcohol ether include diethylene glycol acetate, diethylene glycol benzoate, diethylene glycol dibutyl ether, diethylene glycol diethyl ether, diethylene glycol dimethyl ether, monoolefin, triacetin, tributylin, triethylene glycol diacetate, triethylene glycol dimethyl ether, and the like.

Among these, from the viewpoint of inhibition of generation of ghost, diethylene glycol diacetate and diethylene glycol dibutyl ether are preferable.

The specific ester•ether compound may be a solid compound, but from the viewpoint of the film forming property of the charge transporting composition (coating liquid) or inhibition of generation of ghost, a compound which is liquid at 25° C. and under 1 atmosphere is preferable. The reason therefor is thought to be as follows: in the charge transporting composition (coating liquid), the specific ester•ether compound is easily mixed with the specific charge transporting material.

The content of the specific ester•ether compound is, for example, preferably 1% by mass or more and 30% by mass or less, more preferably 2% by mass or more and 20% by mass or less, and even more preferably 5% by mass or more and 15% by mass or less, based on the charge transporting composition (the total mass of the solid content excluding the solvent).

Next, the specific charge transporting material will be described.

The specific charge transporting material is a compound having a chain polymerizable functional group and a charge transport skeleton in one molecule.

Here, examples of the chain polymerizable functional group in the specific charge transporting material include functional group having a carbon double bond, including, for example, a group selected from an acryloyl group, a methacryloyl group, a vinylphenyl group, an allyl group, a vinyl group, a vinyl ether group, an allyl vinyl ether group, and derivatives thereof. Among these, from the viewpoint of excellent reactivity, examples of the chain polymerizable functional group include at least one group selected from an acryloyl group, a methacryloyl group, a vinylphenyl group, a vinyl group, and derivatives thereof.

On the other hand, examples of the charge transport skeleton in the specific charge transporting material include a skeleton derived from a nitrogen-containing hole transporting compound such as a triarylamine-based compound, a benzidine-based compound, a hydrozone-based compound, and the like, in which the structure conjugated with a nitrogen atom is a charge transport skeleton. Among these, a triarylamine skeleton is preferable.

As the specific charge transporting material, a compound having 2 or more (particularly 4 or more) chain polymerizable functional groups in one molecule is preferable. By this, the electrical characteristics (a charge transporting property, a charging property, a residual potential, and the like) of the cured film are improved, these characteristics are easily maintained even with repeated use, and generation of ghost due to repeated use is easily inhibited. Further, the crosslinking density increases, and thus, a cured film having higher mechanical strength is easily obtained.

The number of these chain polymerizable functional groups may be in the range of 20 or less or of 10 or less, in view of the stability and the electrical characteristics of the charge transporting composition (coating liquid).

Specific examples of the specific charge transporting material include a compound represented by the following formula (I) from the viewpoint of the electrical characteristics and the film strength.

When the compound represented by the following formula (I) is applied, the electrical characteristics (a charge transporting property, a charging property, a residual potential, and the like) of the cured film is improved, these characteristics are easily maintained even with repeated use, and generation of ghost due to repeated use is easily inhibited.

(I)

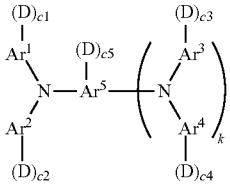

In formula (I), $Ar^1$ to $Ar^4$ each independently represent a substituted or unsubstituted aryl group; $Ar^5$ represents a substituted or unsubstituted aryl group, or a substituted or unsubstituted arylene group; D represents a group containing a functional group having a carbon double bond; c1 to c5 each independently represent 0, 1, or 2; k represents 0 or 1; and the total number of D's is 1 or more.

Here, as the compound represented by formula (I), the compound in which D represents a group having at least one selected from an acryloyl group, a methacryloyl group, a vinylphenyl group, an allyl group, a vinyl group, a vinyl ether group, an allyl vinyl ether group, and derivatives thereof (particularly, a group having any of those groups on the end) is preferable.

Particularly, as the compound represented by formula (I), the compound in which D represents $—(CH_2)_d—(O—CH_2—CH_2)_e—O—CO—C(R')=CH_2$ (wherein R' represents a hydrogen atom or a methyl group, d represents an integer of 1 or more and 5 or less, and e represents 0 or 1), and the total number of D's is 4 or more is preferable.

When the present compound is applied, the electrical characteristics (a charge transporting property, a charging property, a residual potential, and the like) of the cured film are improved, these characteristics are easily maintained even with repeated use, and generation of ghost due to repeated use is easily inhibited. Further, the crosslinking density increases, and thus, a cured film having higher mechanical strength is easily obtained.

Further, an acryloyl group, a methacryloyl group, and a vinylphenyl group, which have a tendency of imparting a high reactivity and high mechanical strength to the resulting cured film, are preferable.

In formula (I), $Ar^1$ to $Ar^4$ each independently represent a substituted or unsubstituted aryl group. $Ar^1$ to $Ar^4$ may be the same as or different from each other.

Here, examples of the substituent in the substituted aryl group include an alkyl group having 1 to 4 carbon atoms, an alkoxy group having 1 to 4 carbon atoms, a substituted or unsubstituted aryl group having 6 to 10 carbon atoms, and the like, in addition to the groups represented by D.

$Ar^1$ to $Ar^4$ are preferably any of the following formulae (1) to (7). Further, in the following formulae (1) to (7), "$-(D)_{C1}$" to "$-(D)_{C4}$" capable of bonding to each of $Ar^1$ to $Ar^4$ are generally shown as "$-(D)_C$".

(1)

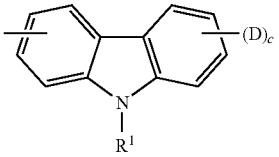

(2)

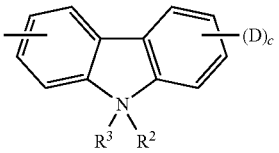

(3)

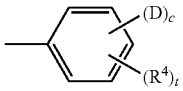

(4)

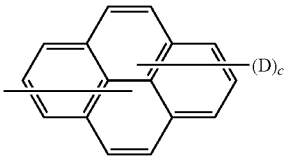

(5)

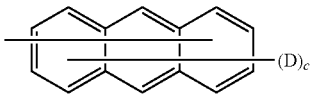

(6)

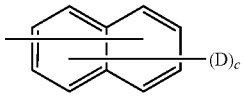

(7)

In formulae (1) to (7), $R^1$ represents one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms; $R^2$ to $R^4$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; Ar represents a substituted or unsubstituted arylene group; D represents the same group as D in formula (I); c represents 1 or 2; s represents 0 or 1; and t represents an integer of 0 or more and 3 or less.

Here, Ar in formula (7) is preferably represented by the following structural formula (8) or (9), (8)

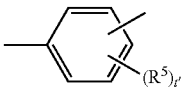

-continued (9)

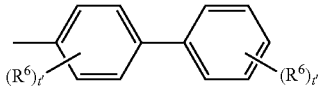

In formulae (8) and (9), $R^5$ and $R^6$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; and t' represents an integer of 0 or more and 3 or less.

In formula (7), Z' represents a divalent organic linking group, and is preferably represented by any of the following formulae (10) to (17); and s represents 0 or 1.

(10)

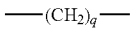

(11)

(12)

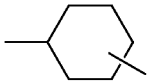

(13)

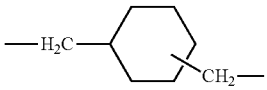

(14)

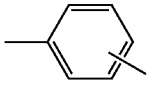

(15)

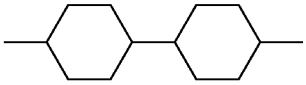

(16)

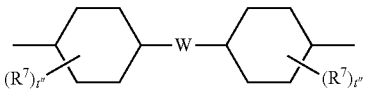

(17)

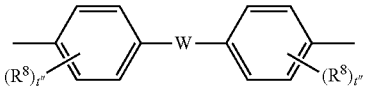

In formulae (10) to (17), $R^7$ and $R^8$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; W represents a divalent group; q and r each independently represent an integer of 1 to 10; and t" represents an integer of 0 or more and 3 or less, W in formulae (16) and (17) is preferably any of divalent groups represented by the following formulae (18) to (26). In formula (25), u represents an integer of 0 or more and 3 or less.

(18) —$CH_2$—

(19) —$C(CH_3)_2$—

(20) —O—

(21) —S—

(22) —$C(CF_3)_2$—

(23) —$Si(CH_3)_2$—

(24)

(25)

(26)

Furthermore, in formula (I), $Ar^5$ represents a substituted or unsubstituted aryl group when k is 0. As the aryl group, the same aryl groups shown in the description of $Ar^1$ to $Ar^4$ are exemplified. Further, $Ar^5$ represents a substituted or unsubstituted arylene group when k is 1, and as the arylene group, arylene groups obtained by subtracting one hydrogen atom at a desired position from the aryl groups shown in the description of $Ar^1$ to $Ar^4$ are exemplified.

Specific examples of the specific charge transporting material are shown below. However, the specific charge transporting material is by no means limited thereto.

In the first place, specific examples of the specific charge transporting material having one chain polymerizable functional group are shown, but are not limited thereto.

i-1

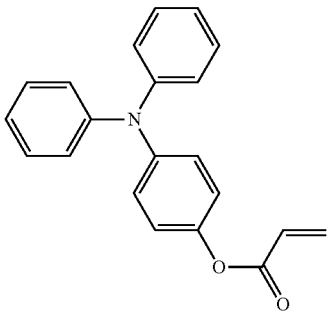

-continued i-2

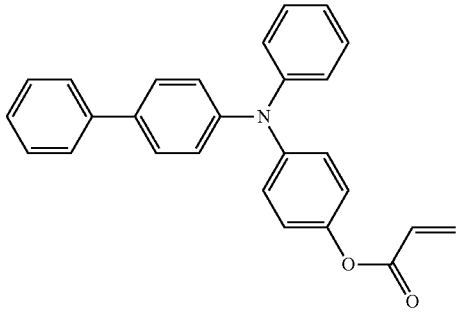

i-3

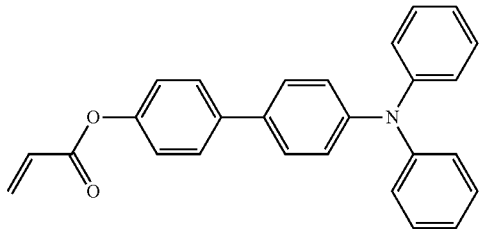

i-4

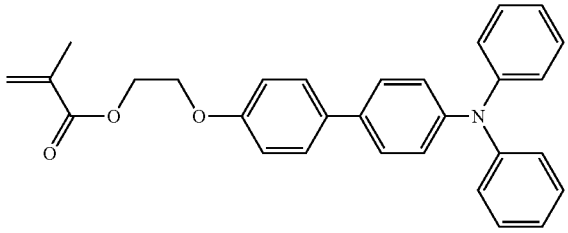

i-5

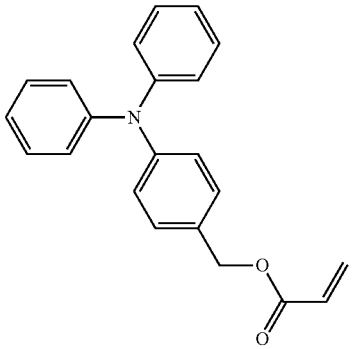

i-6

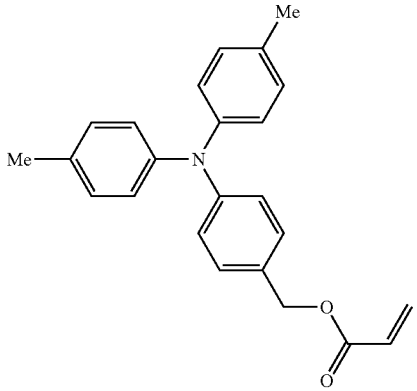

-continued
i-7
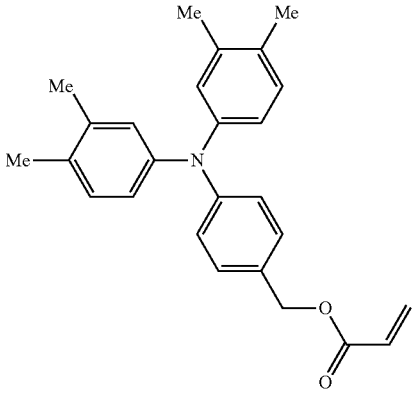
i-8
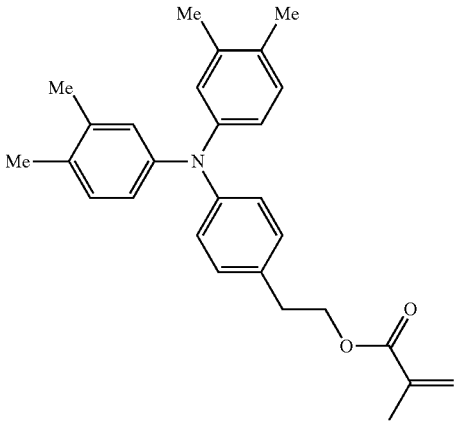
i-9
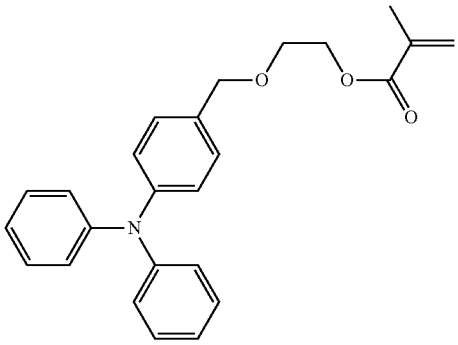
i-10
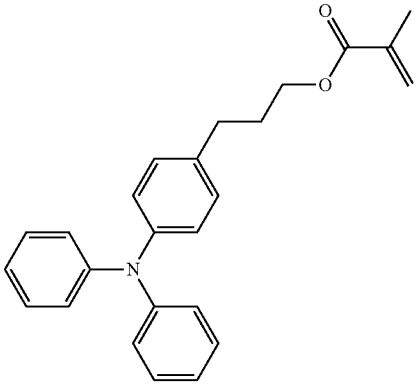
-continued
i-11
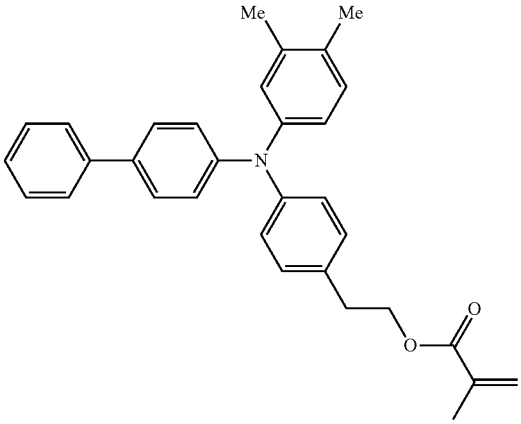
i-12
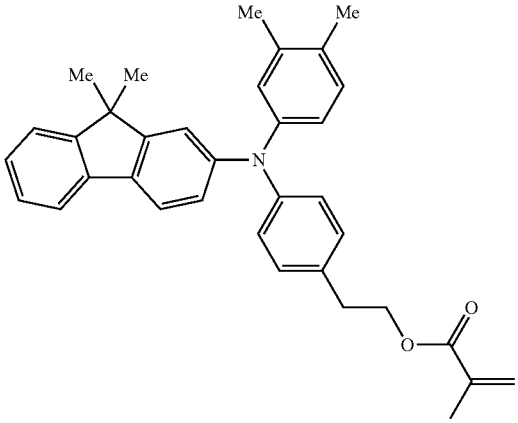
i-13
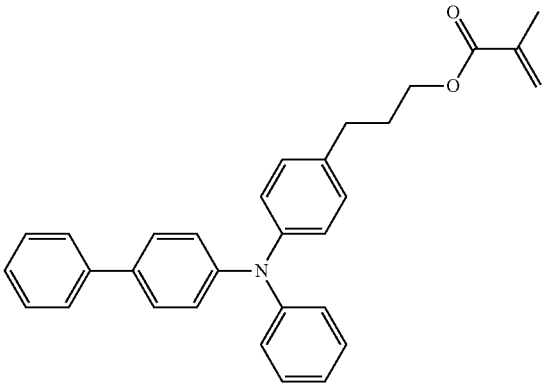

-continued
i-14
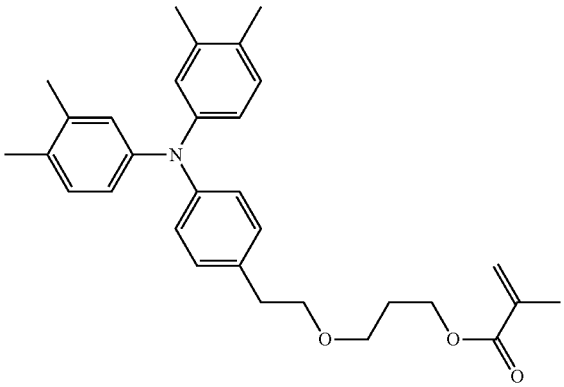
i-15
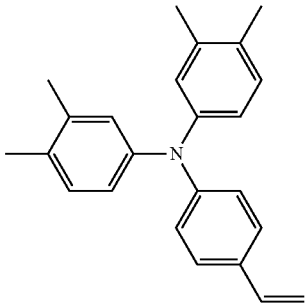
i-16
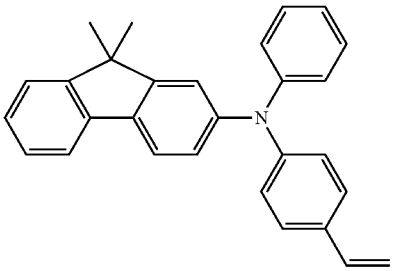
i-17
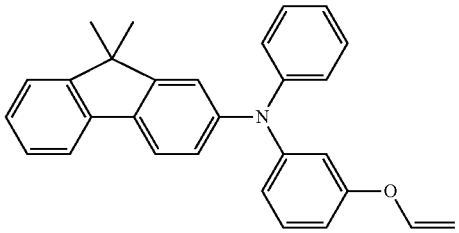
i-18
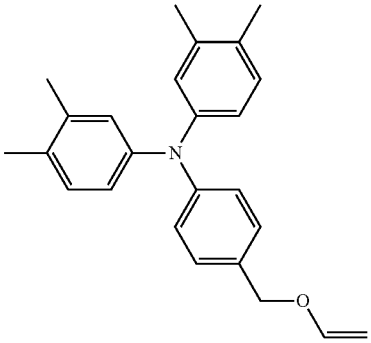
-continued
i-19
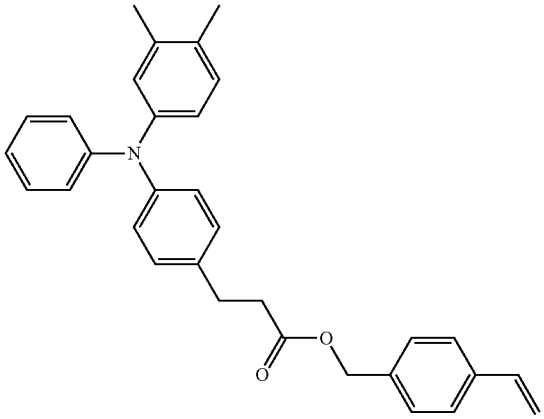
i-20
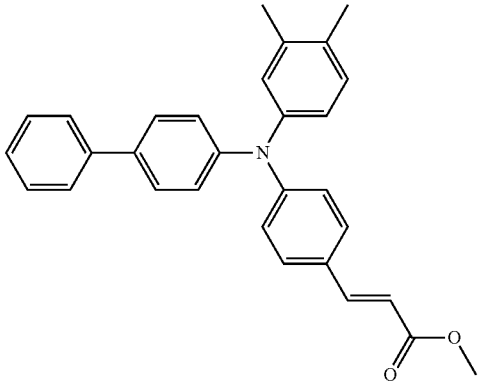
i-21
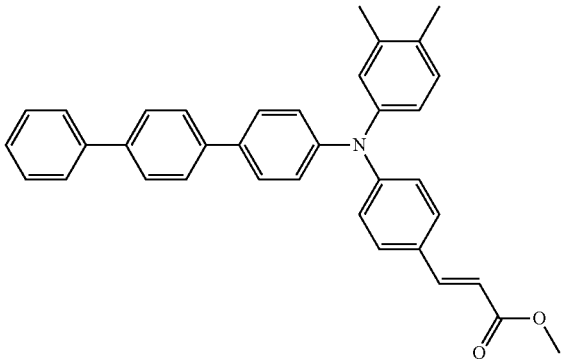
i-22
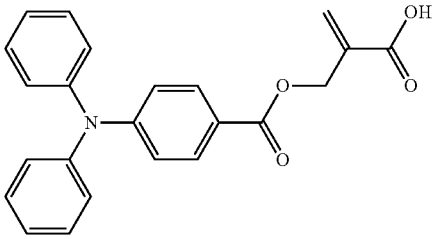

-continued
i-23
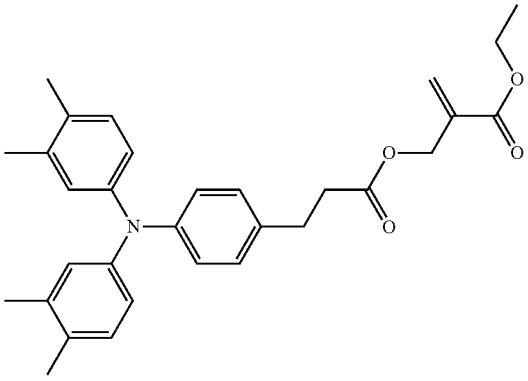
i-24
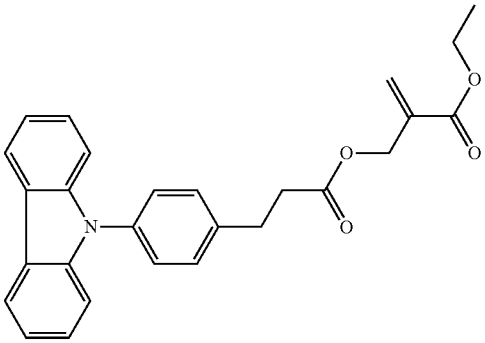
-continued
i-25
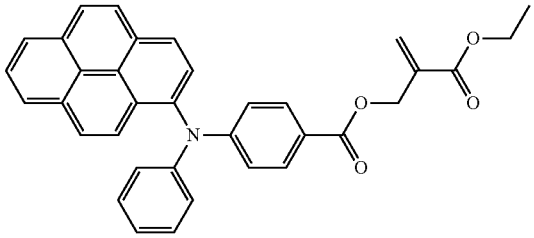
i-26
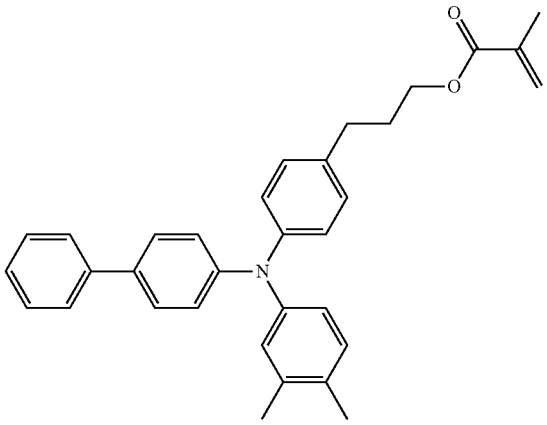
Next specific examples of the specific charge transporting material having two chain polymerizable functional groups are shown, but are not limited thereto.
ii-1
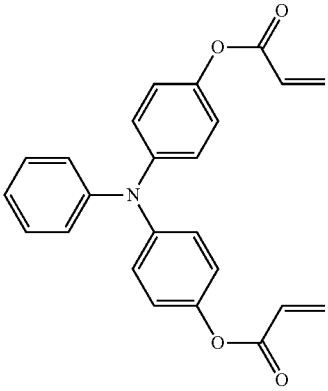
ii-2
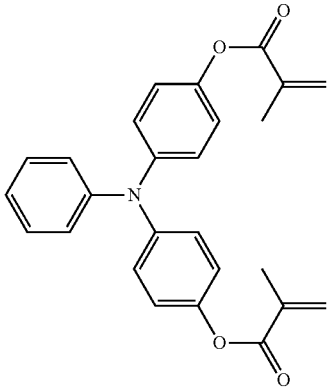

-continued
ii-3
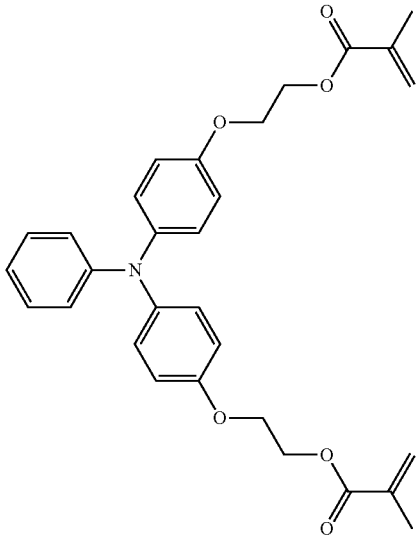
ii-4
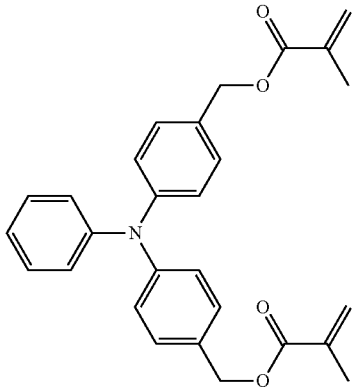
ii-5
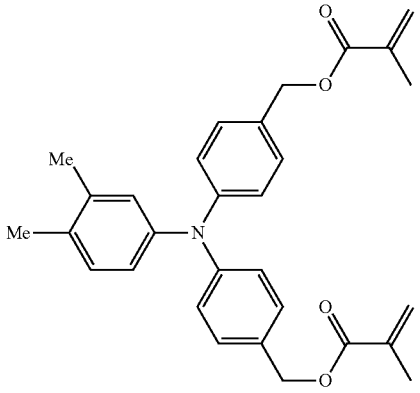
ii-6
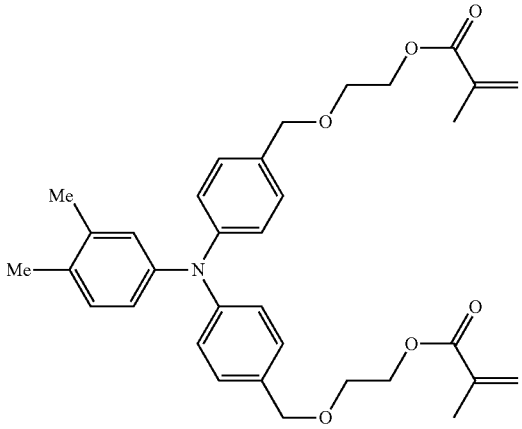
ii-7
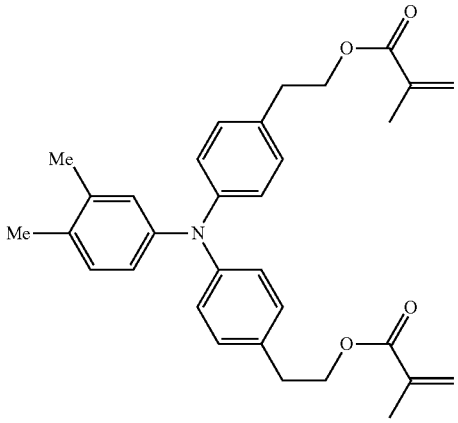
ii-8
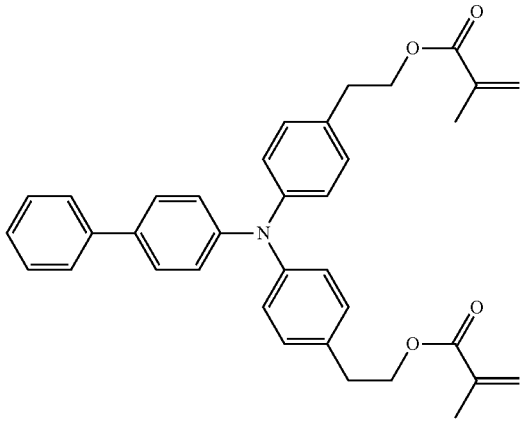

-continued
ii-9
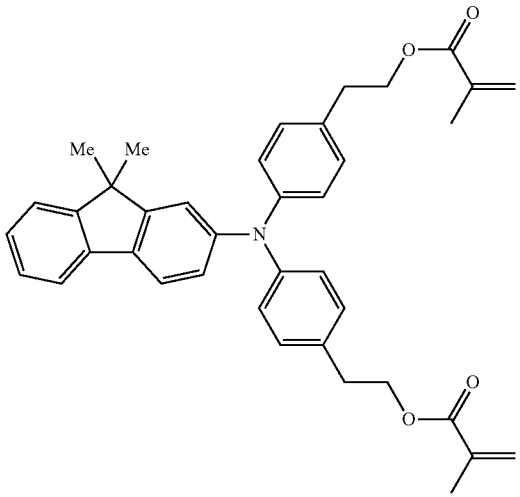
ii-10
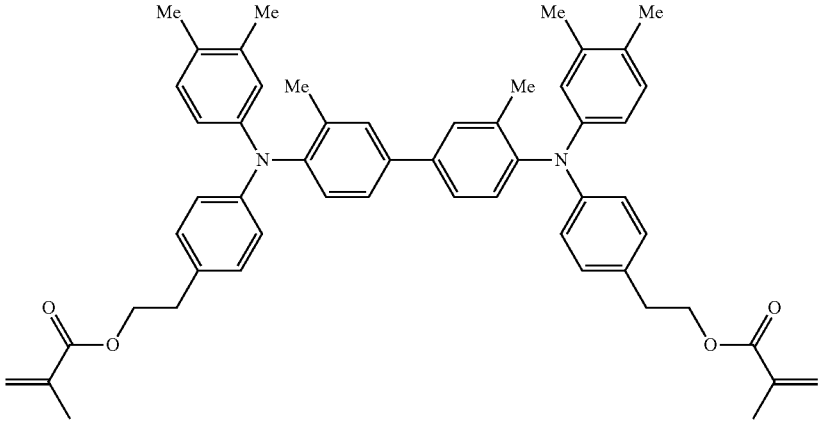
ii-11
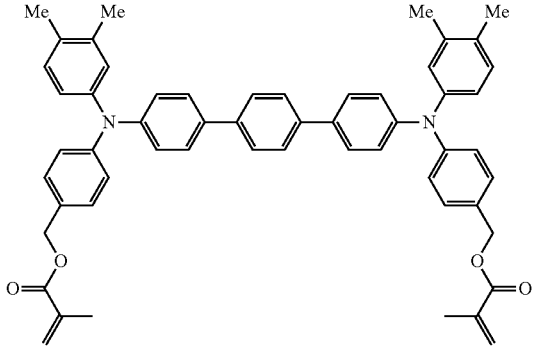
ii-12
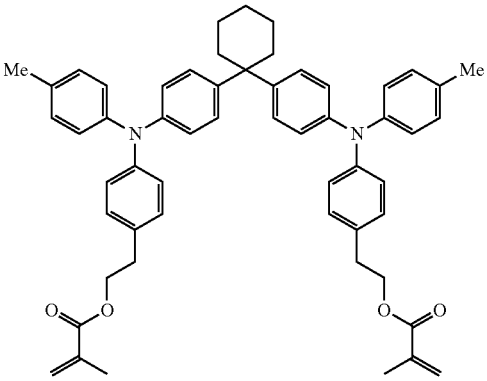

-continued
ii-13
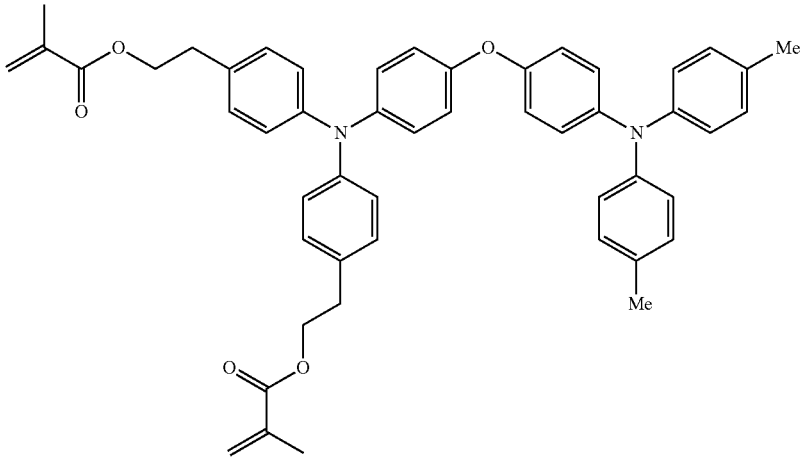
ii-14
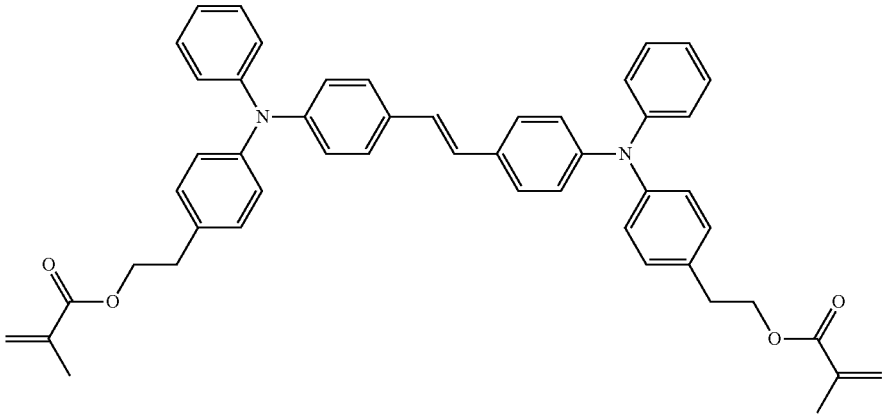
ii-15
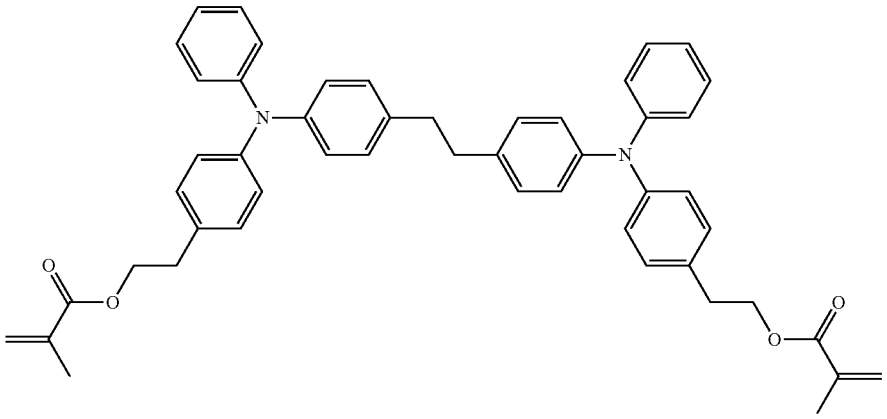

-continued
ii-16
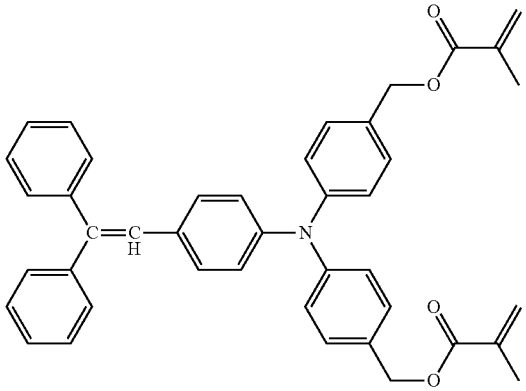
ii-17
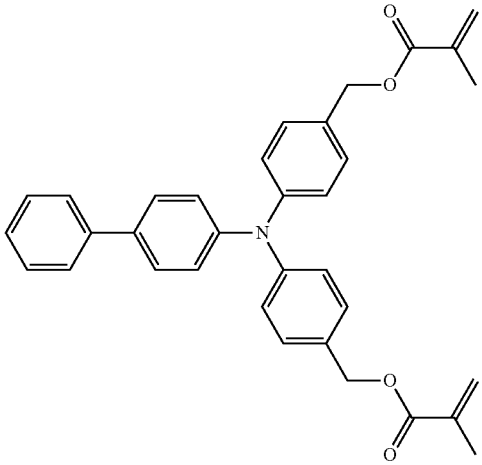
ii-18
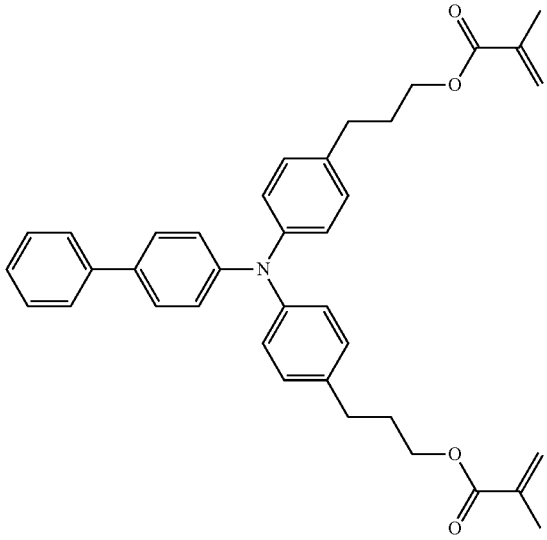
ii-19
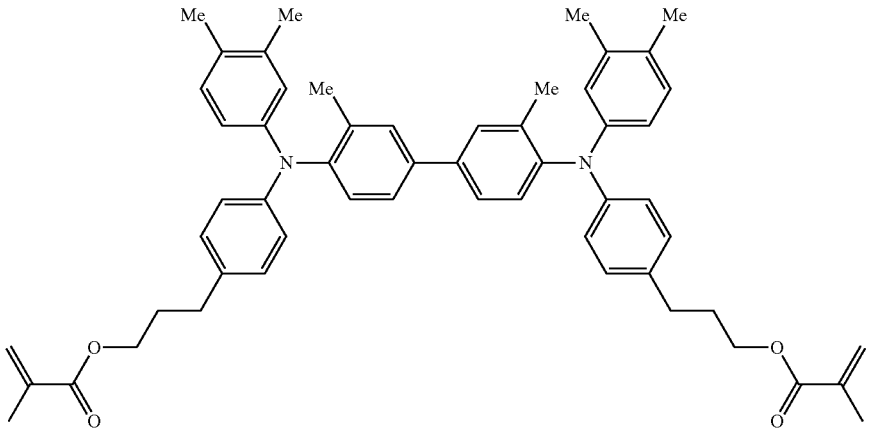

-continued
ii-20
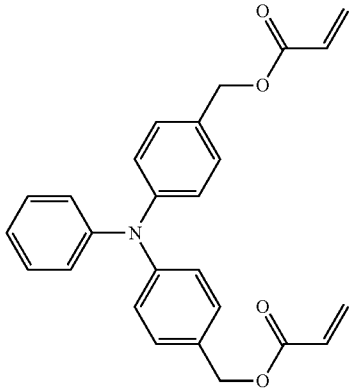
ii-21
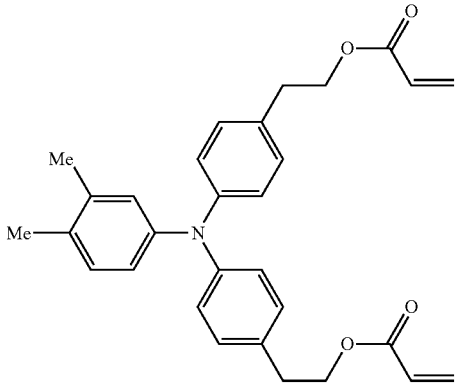
ii-22
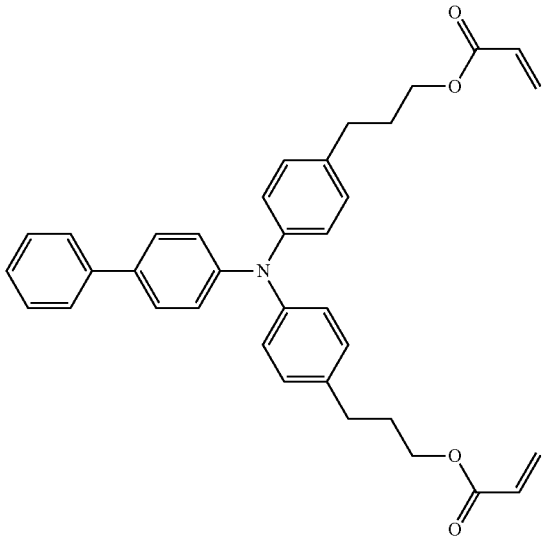
ii-23
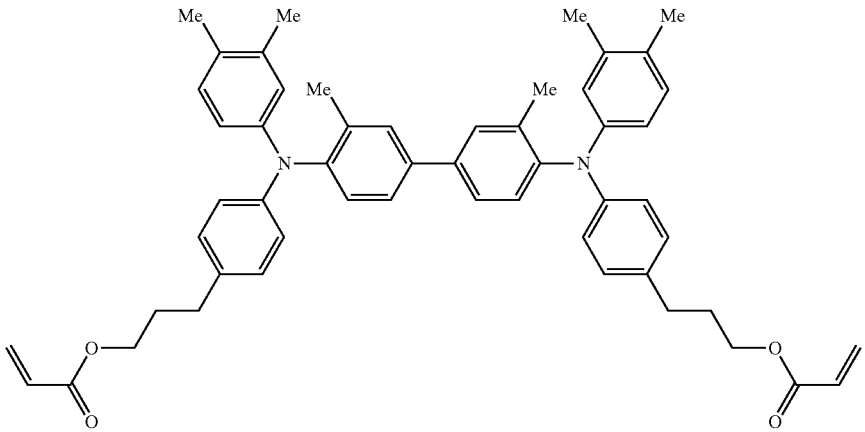

-continued
ii-24
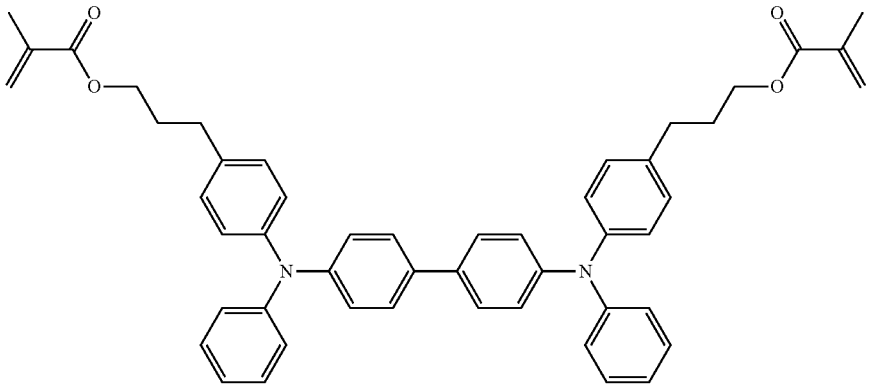
ii-25
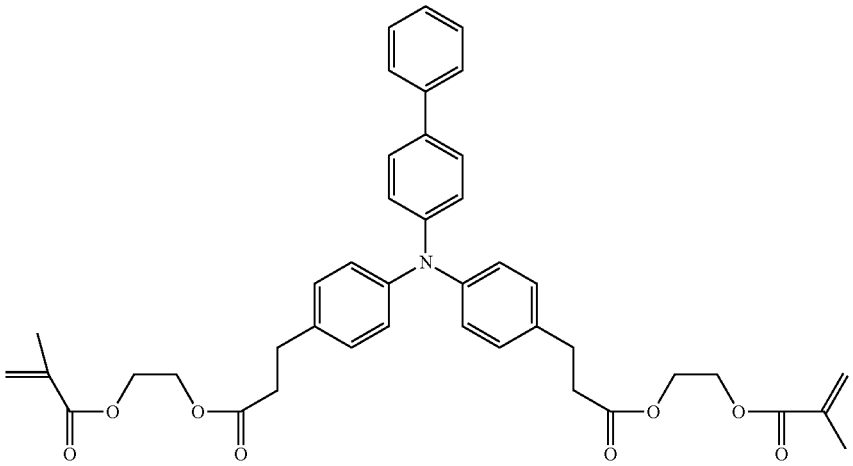
ii-26
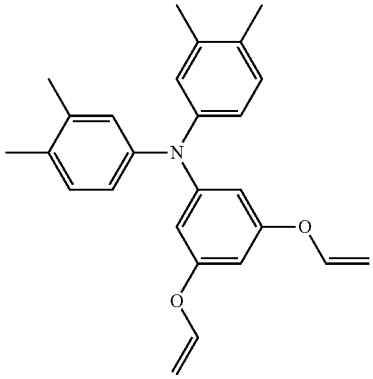
ii-27
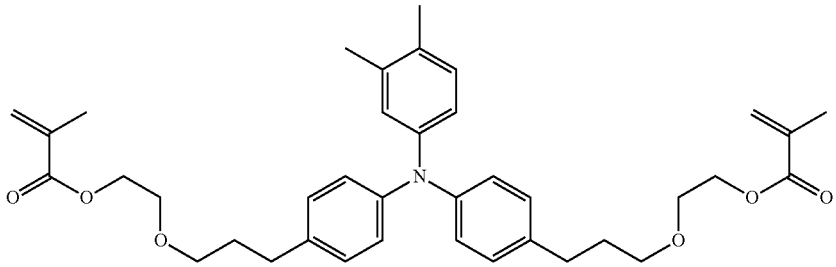

-continued
ii-28
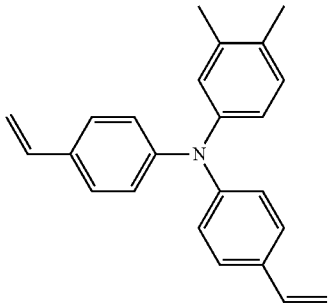
ii-29
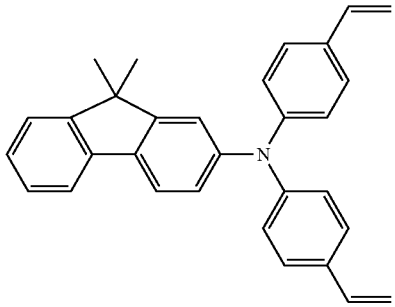
ii-30
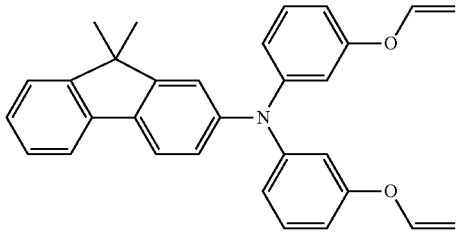
ii-31
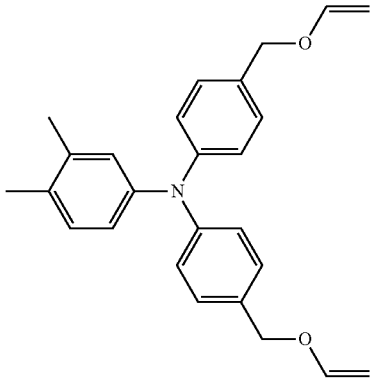
ii-32
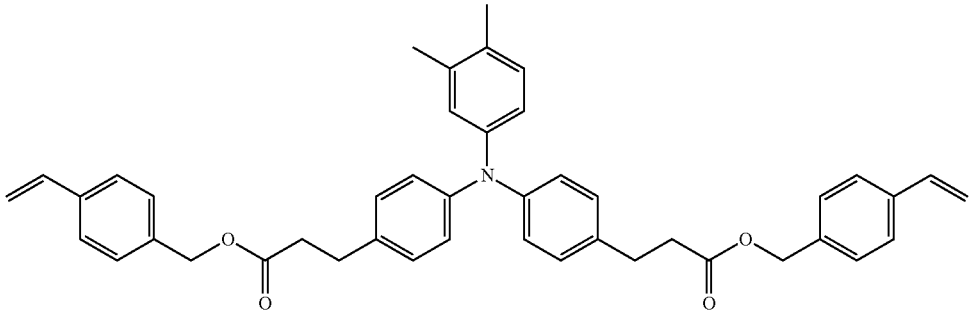
ii-33
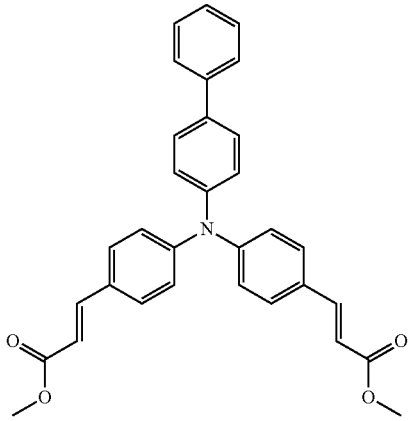
ii-34
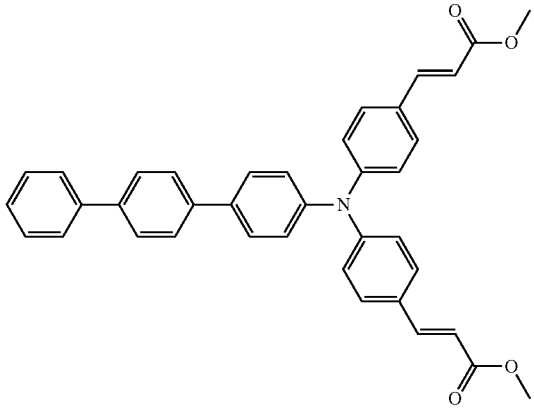

-continued
ii-35
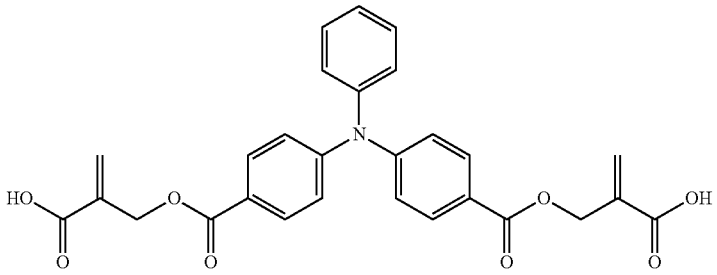
ii-36
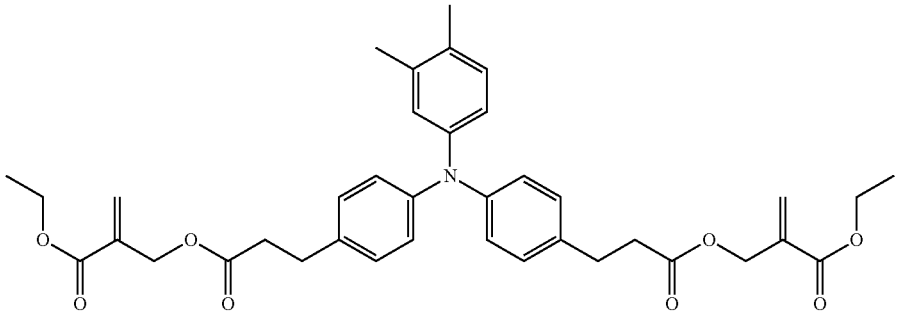
ii-37
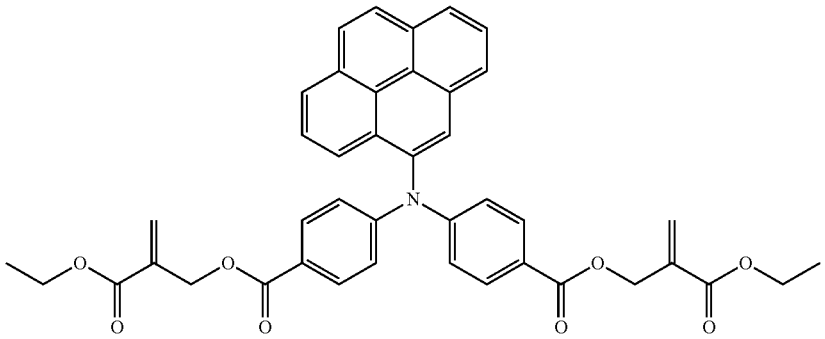
ii-38
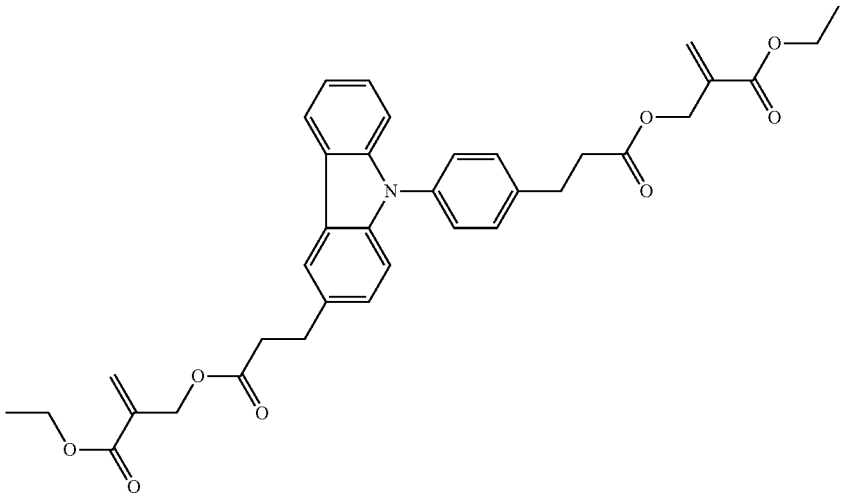

-continued
ii-39
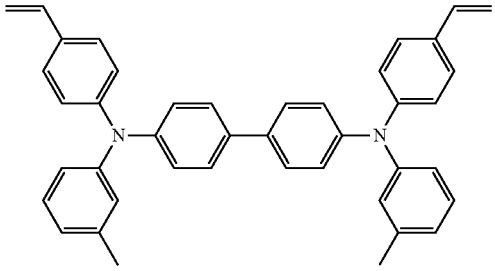
ii-40
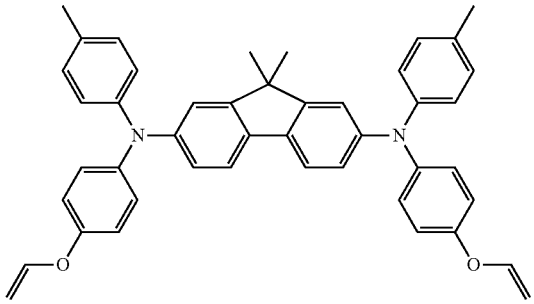
ii-41
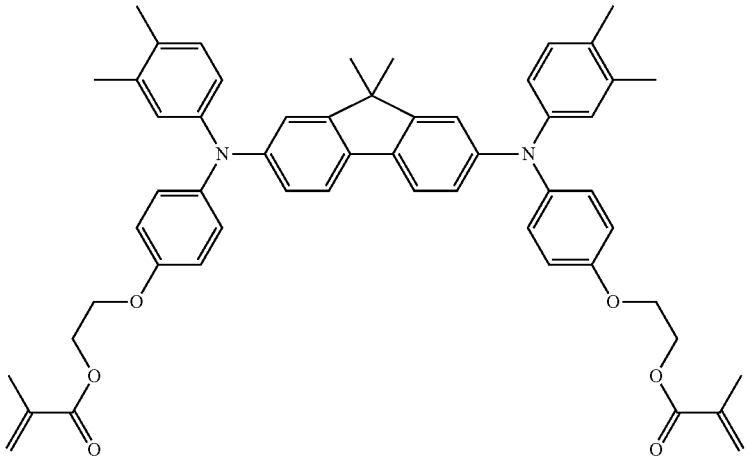
ii-42
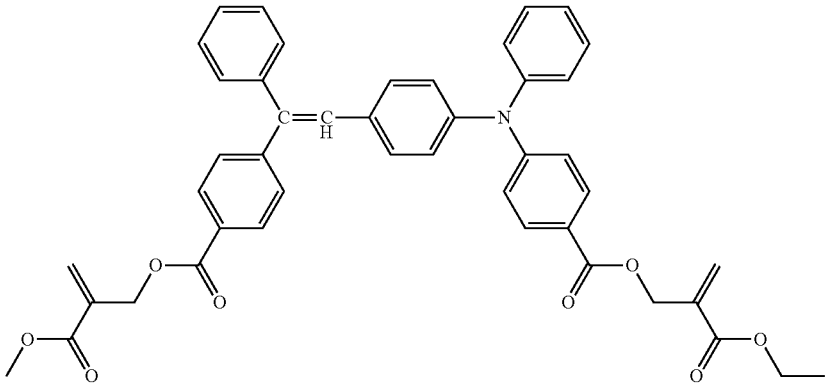
ii-43
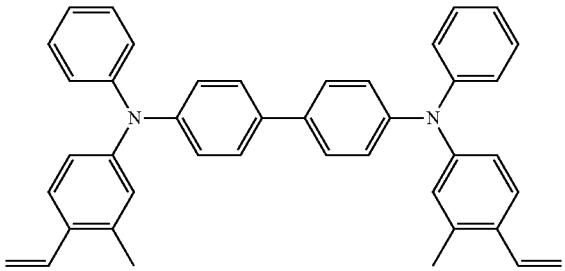

-continued
ii-44
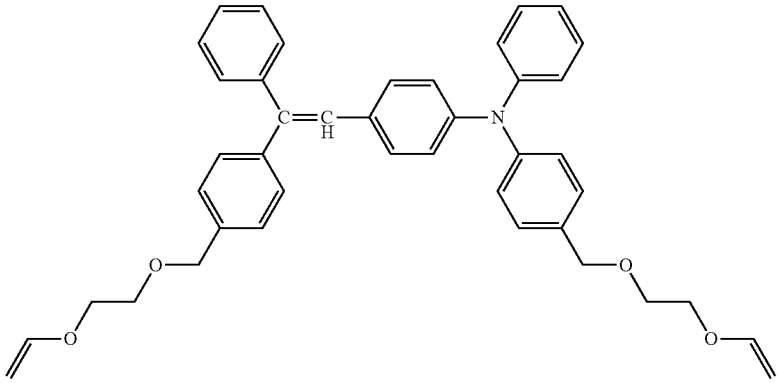
ii-45
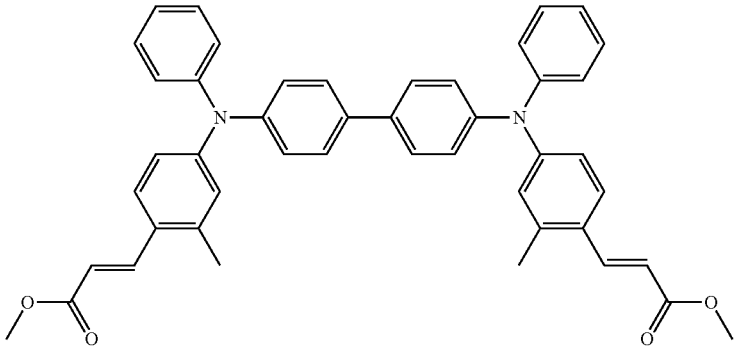
ii-46
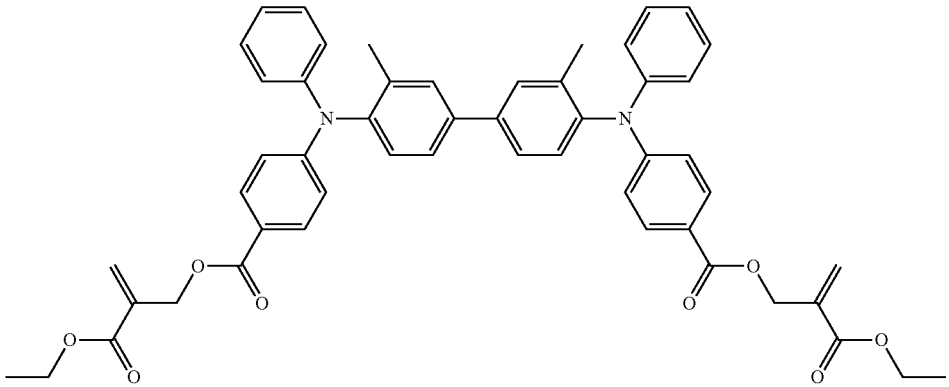
ii-47
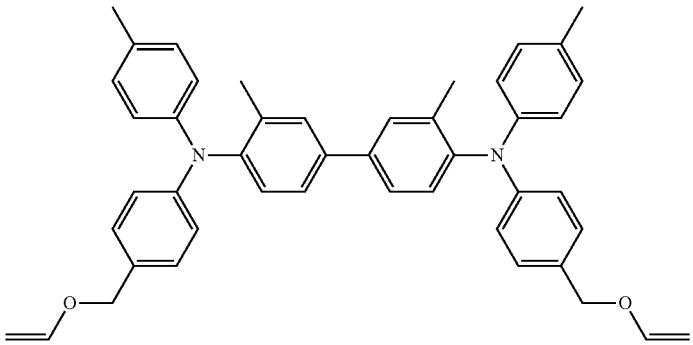

-continued
ii-48
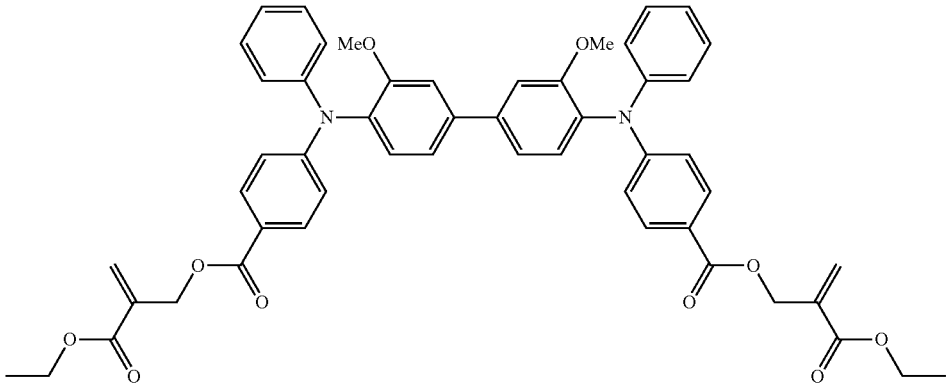
ii-49
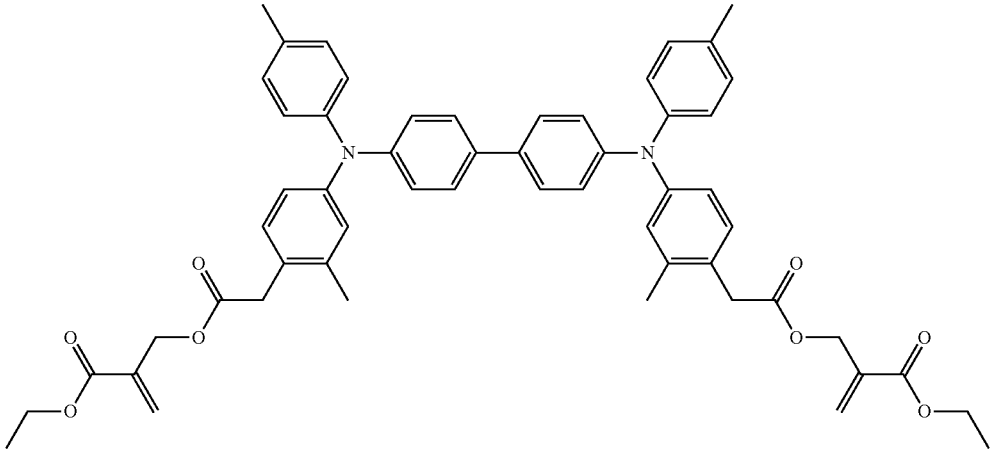
ii-50
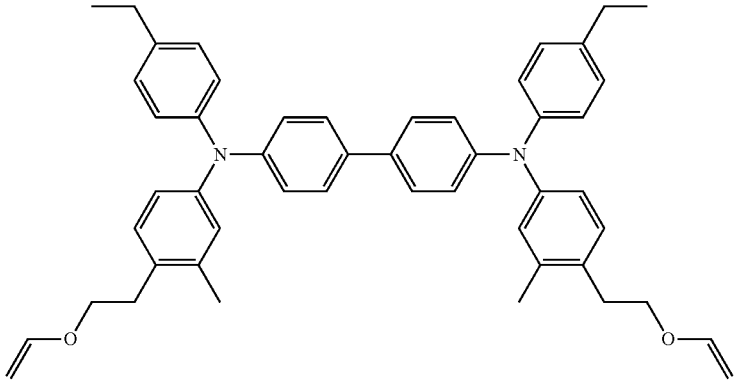

-continued
ii-51
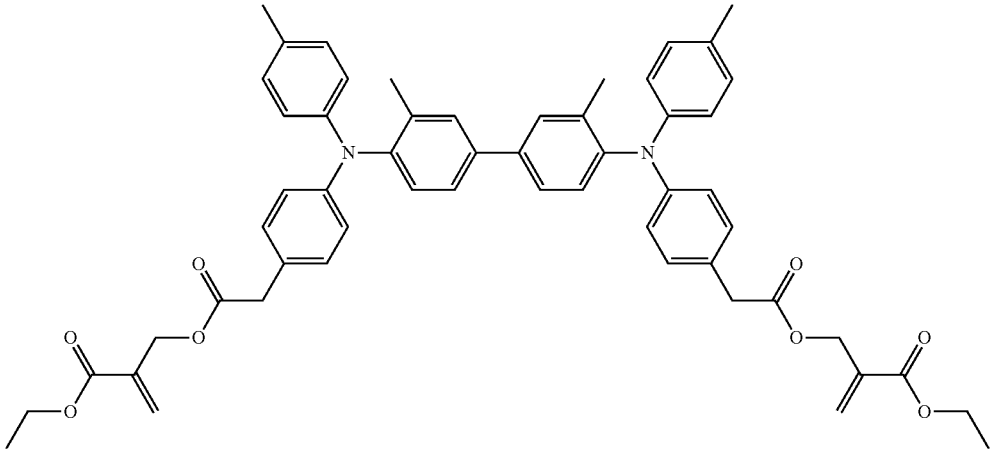
II-52
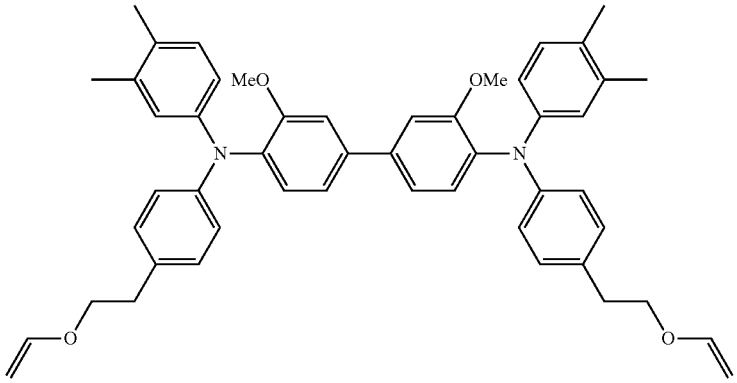
ii-53
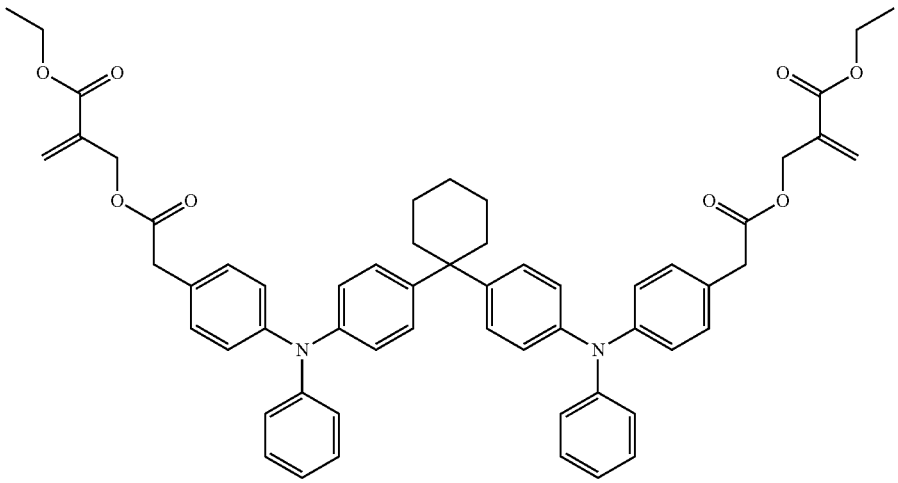

-continued
ii-54
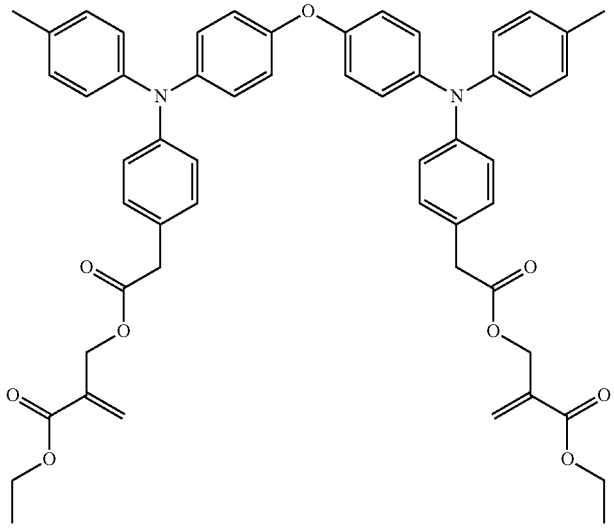
ii-55
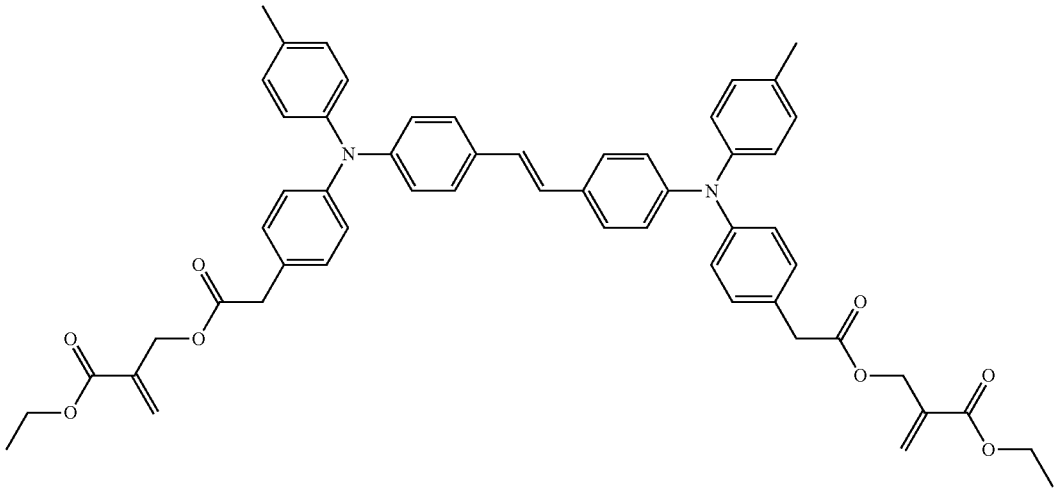
ii-55
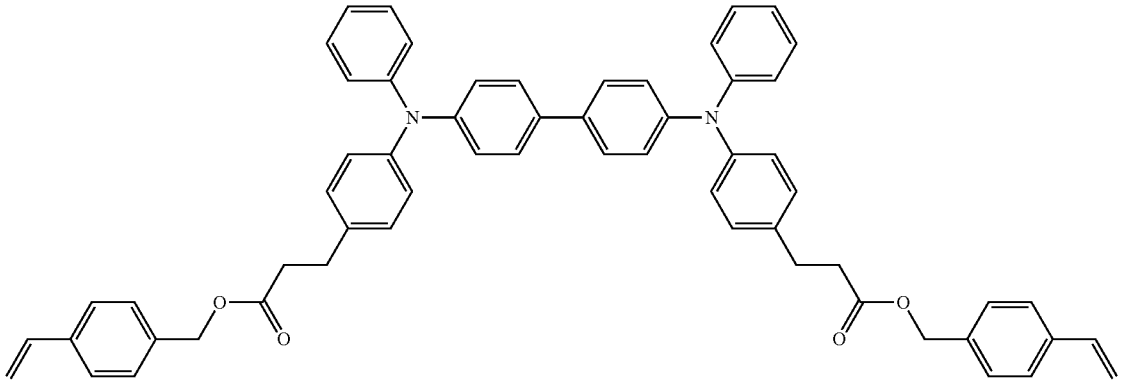

Next, specific examples of the specific charge transporting material having 3 chain polymerizable functional groups are shown, but are not limited thereto.
iii-1
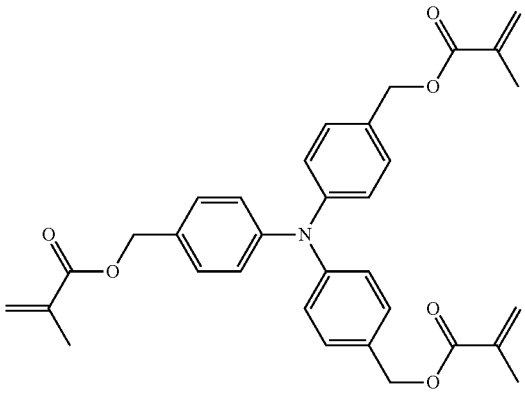
iii-2
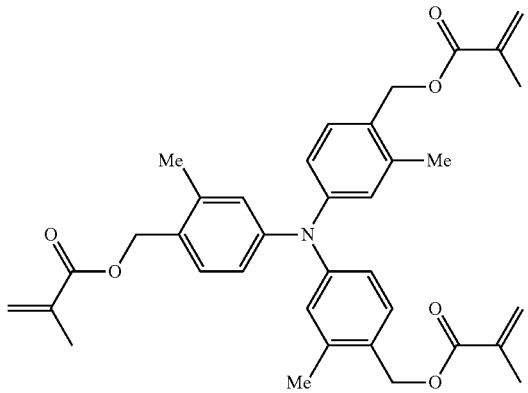
iii-3
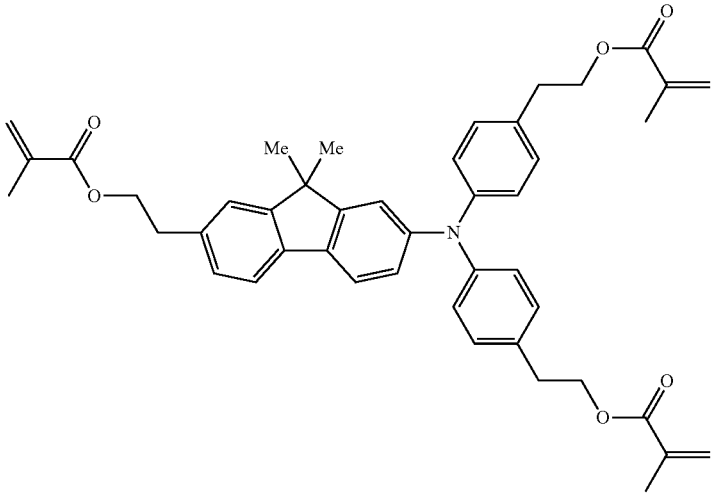
iii-4
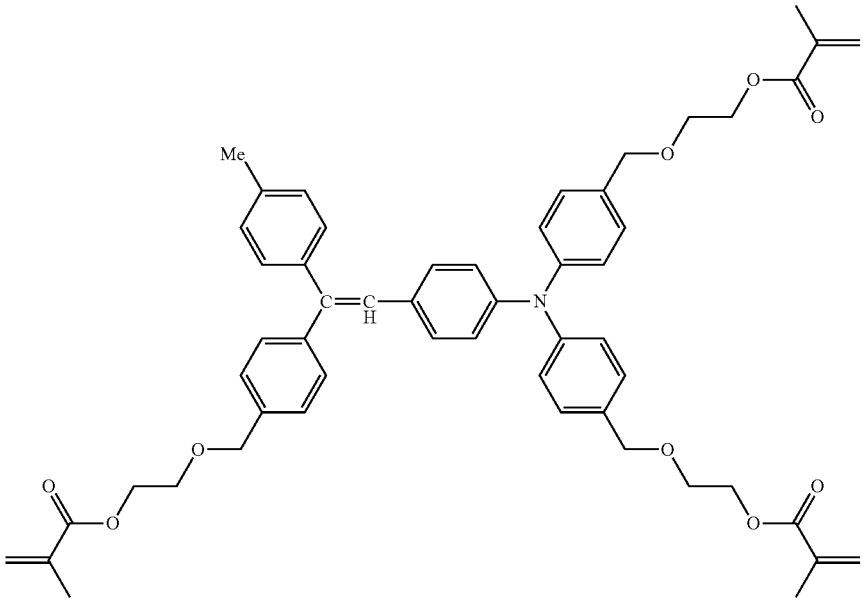

-continued
iii-5
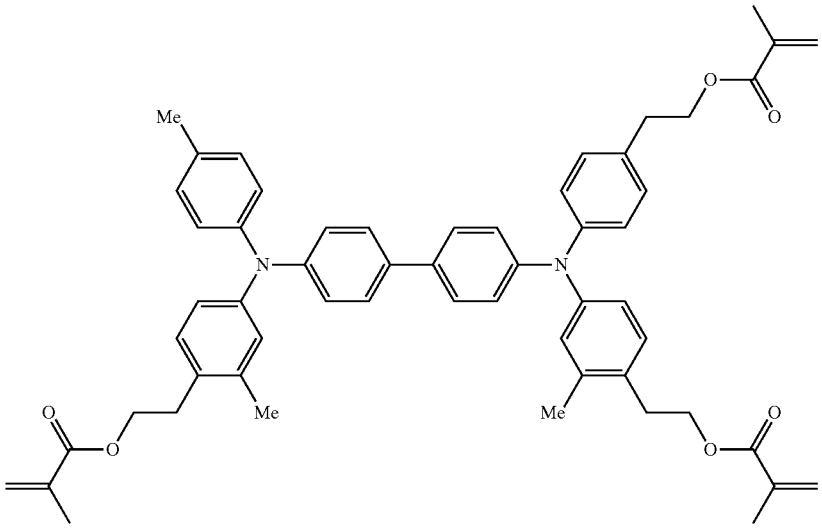
iii-6
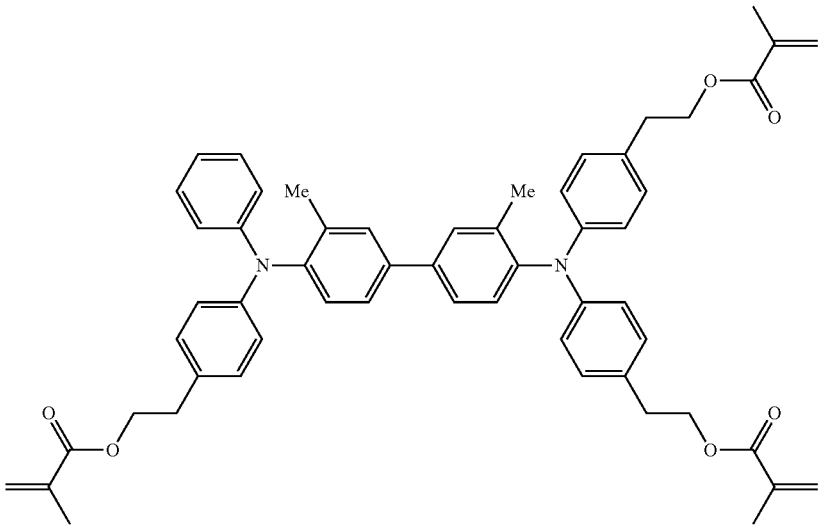
iii-7
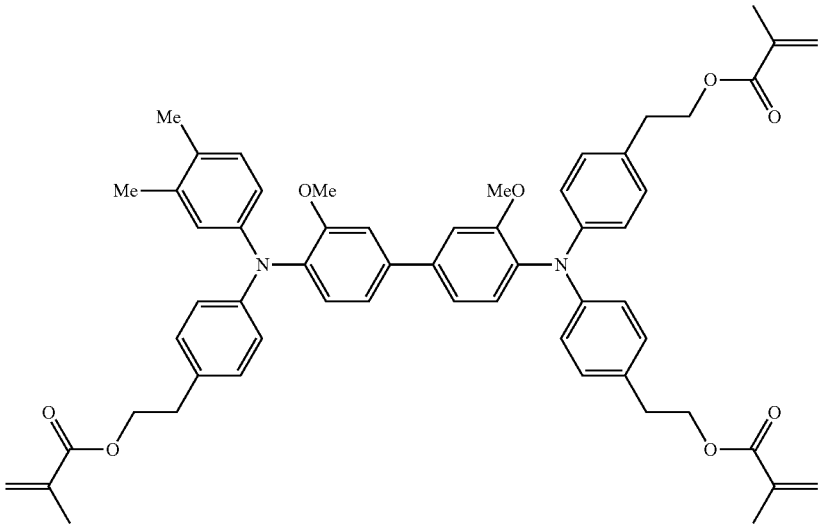

-continued
iii-8
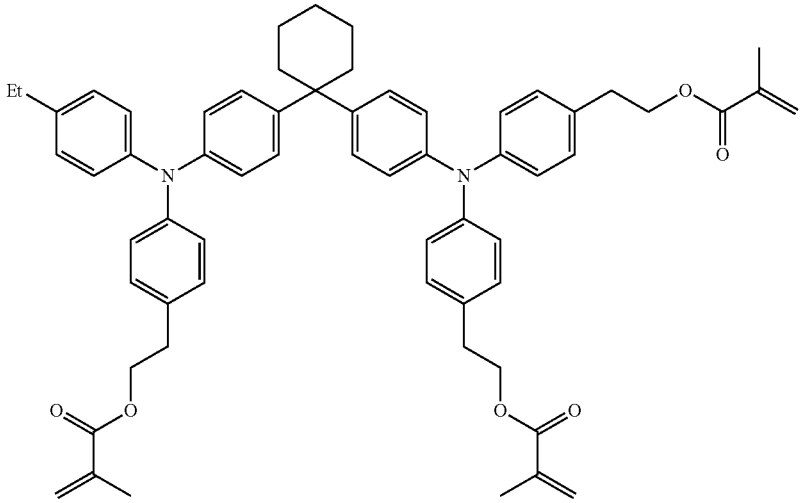
iii-9
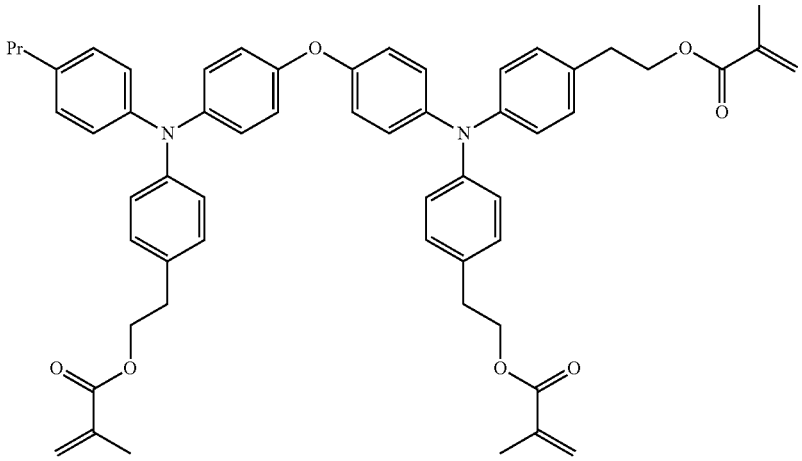
iii-10
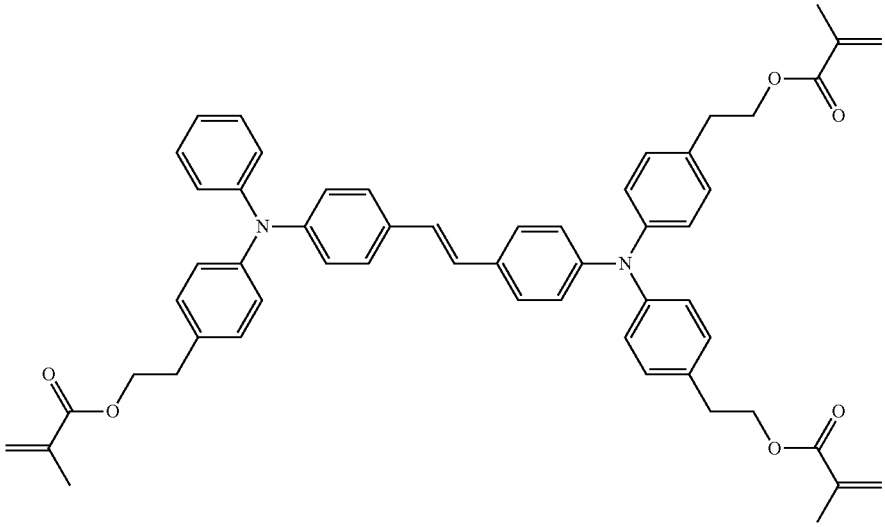

-continued
iii-11
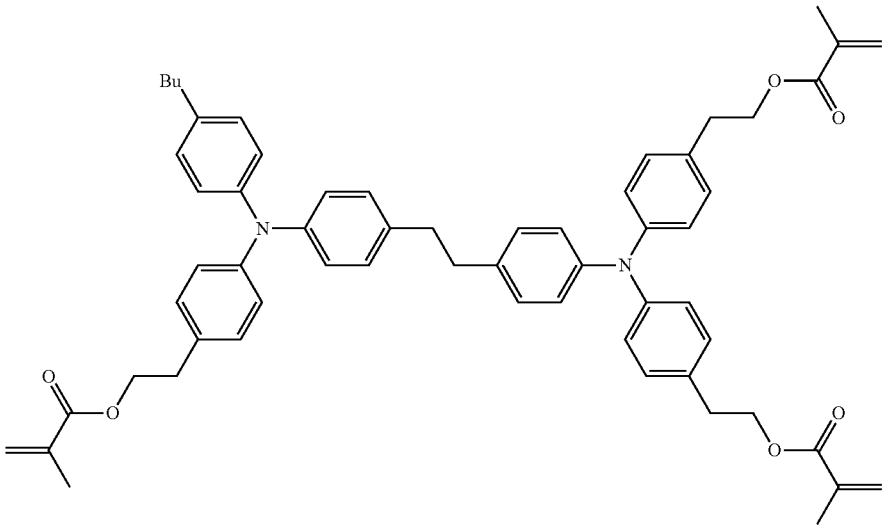
iii-12
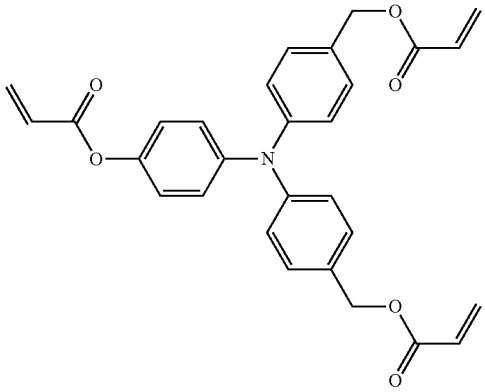
iii-13
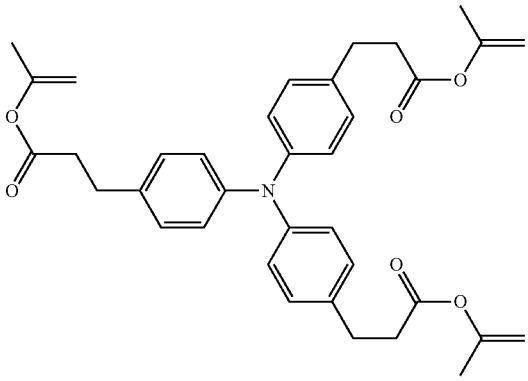
iii-14
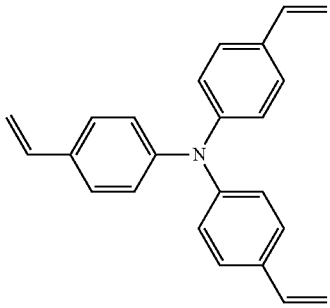
iii-15
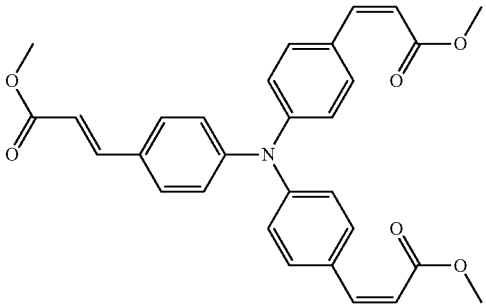
iii-16
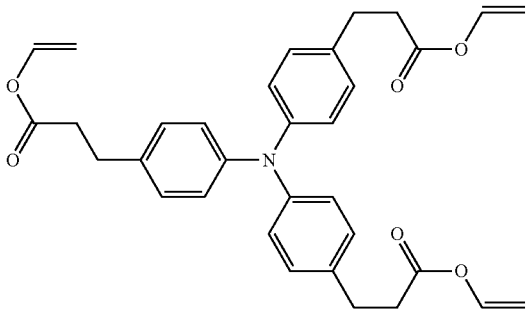

-continued
iii-17
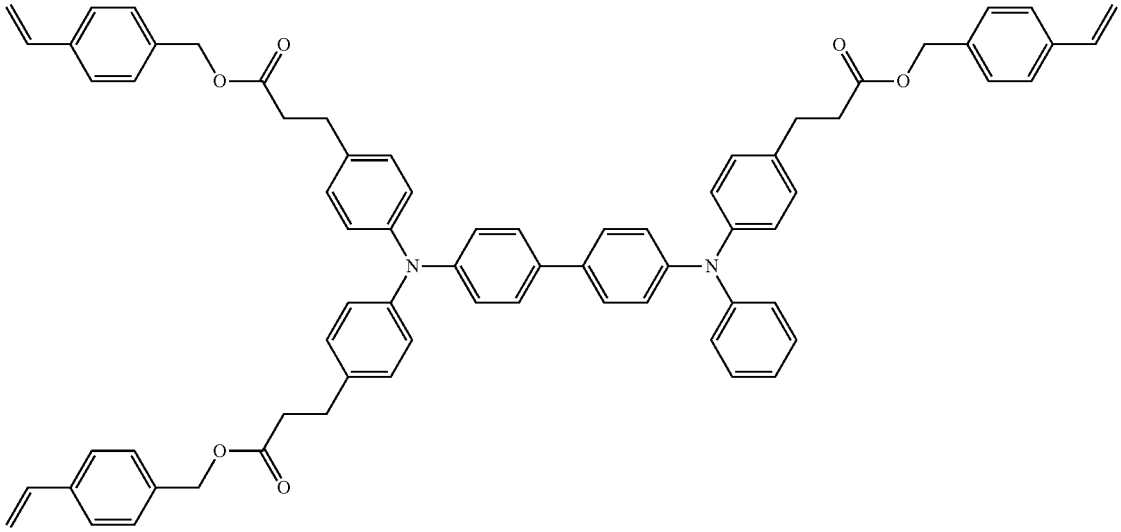
iii-18
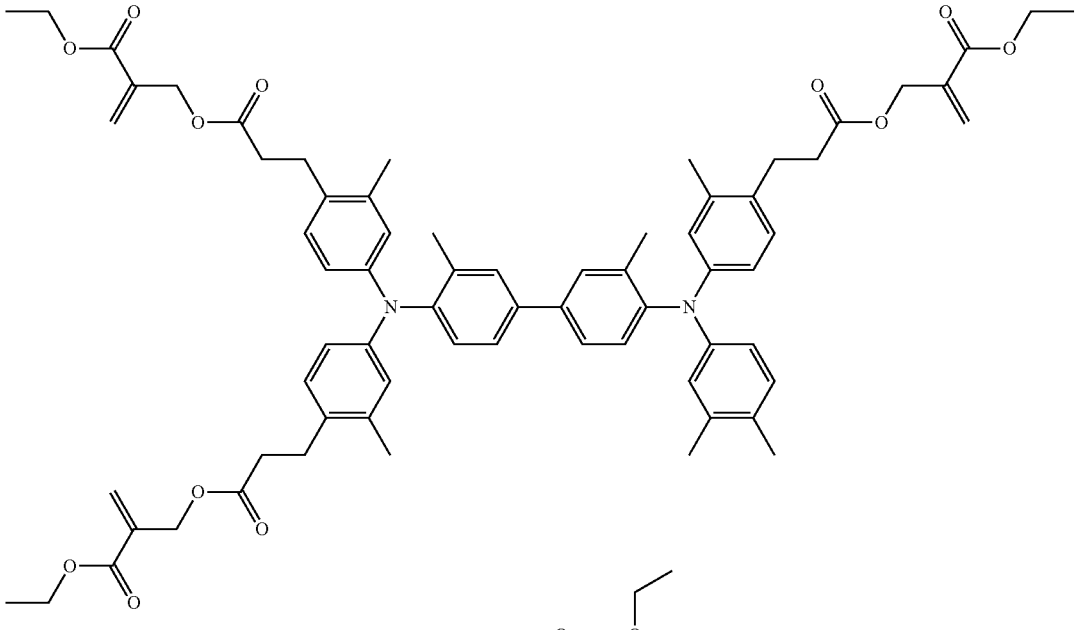
iii-19
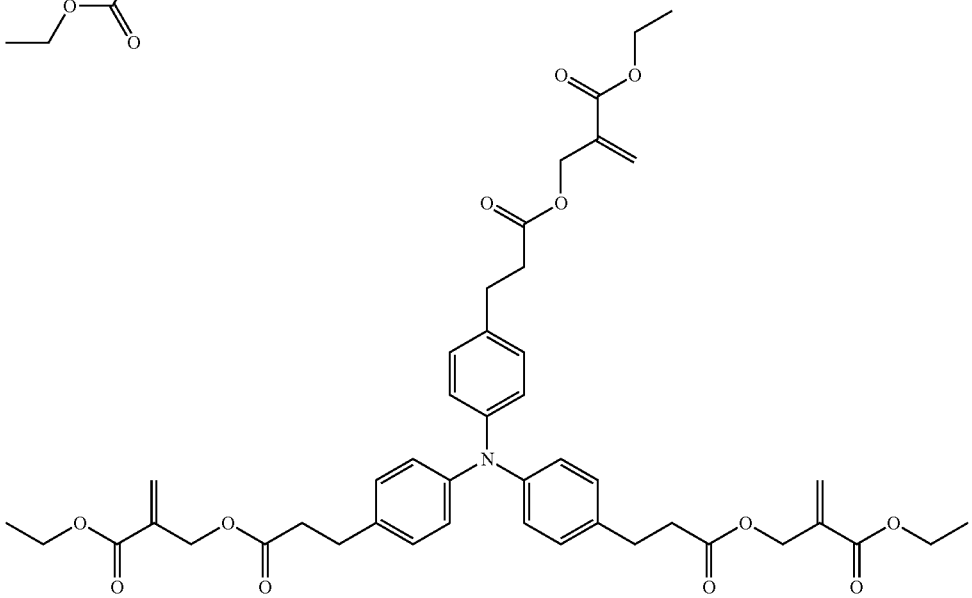

Next, specific examples of the specific charge transporting material having 4 to 6 chain polymerizable functional groups are shown, but are not limited thereto.
iv-1
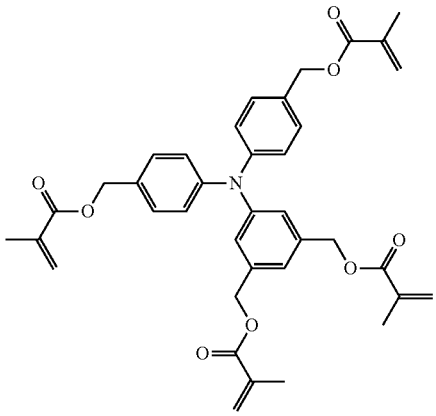
iv-2
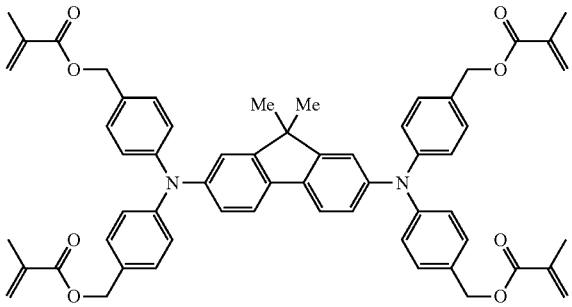
iv-3
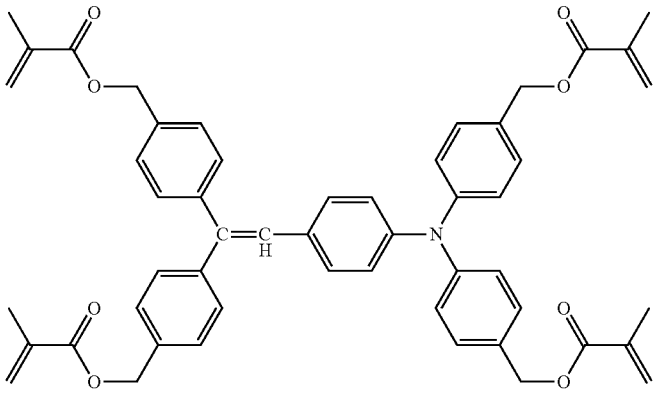
iv-4
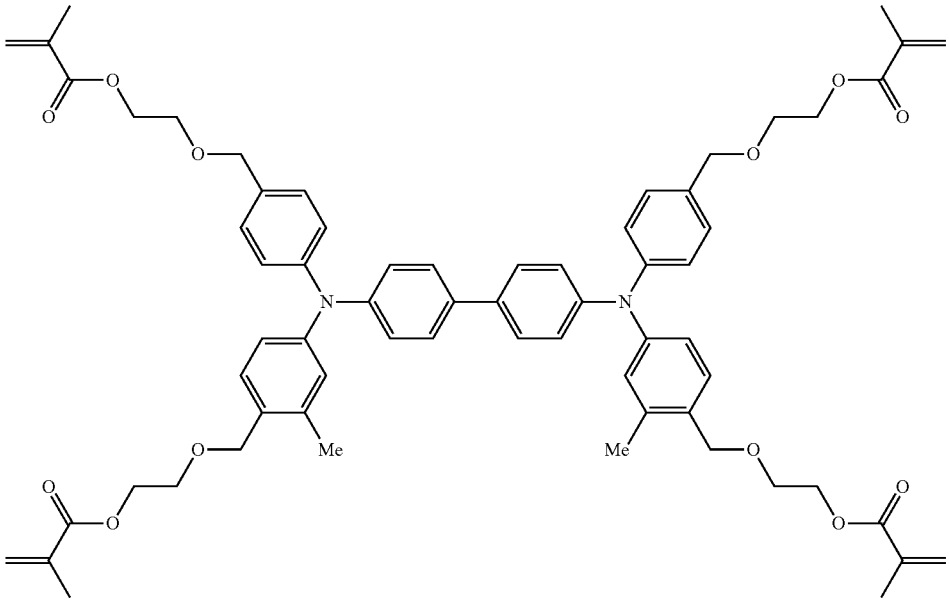

-continued
iv-5
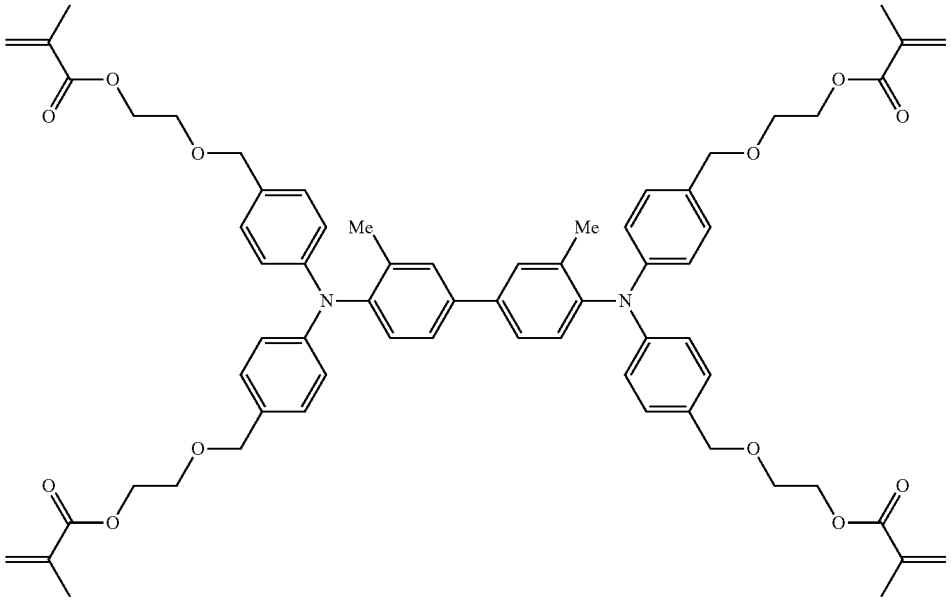
iv-6
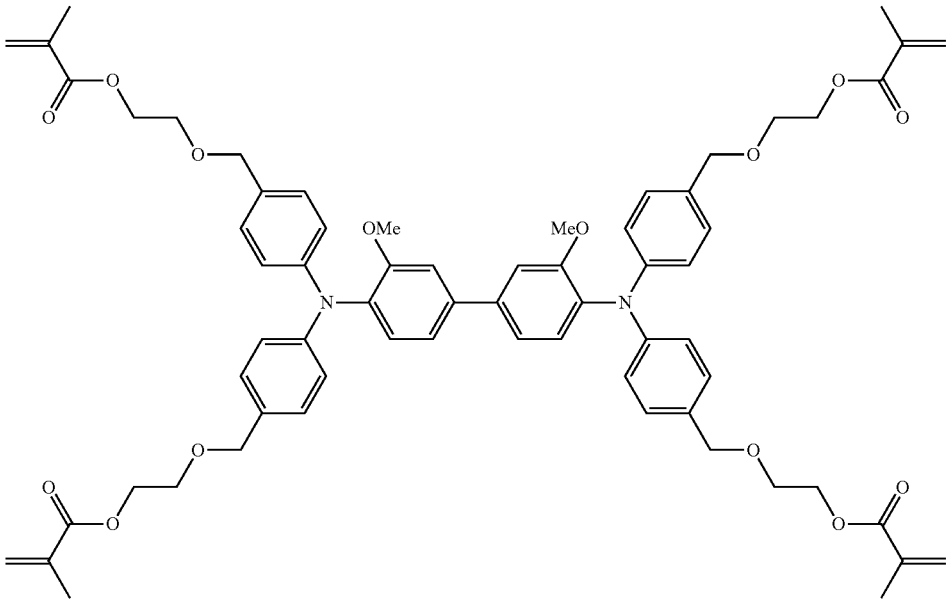

-continued
iv-7
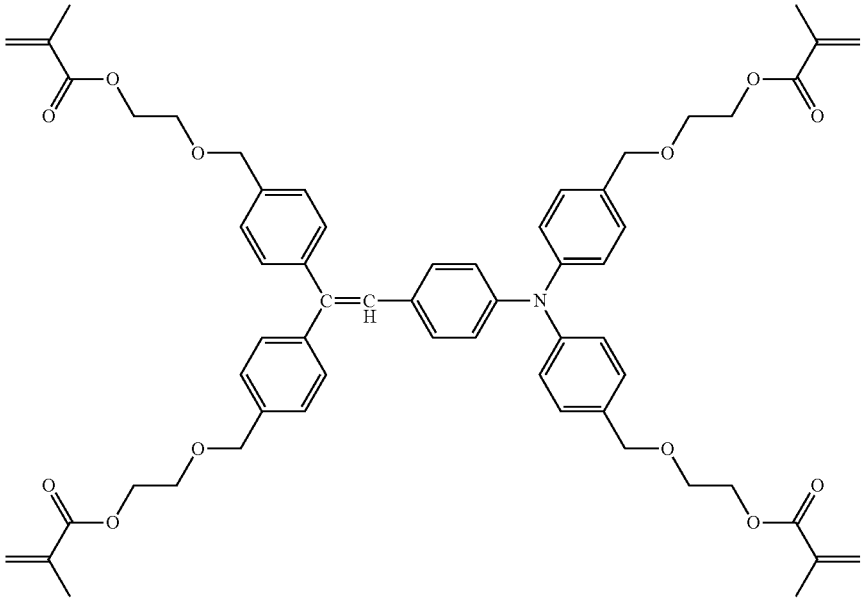
iv-8
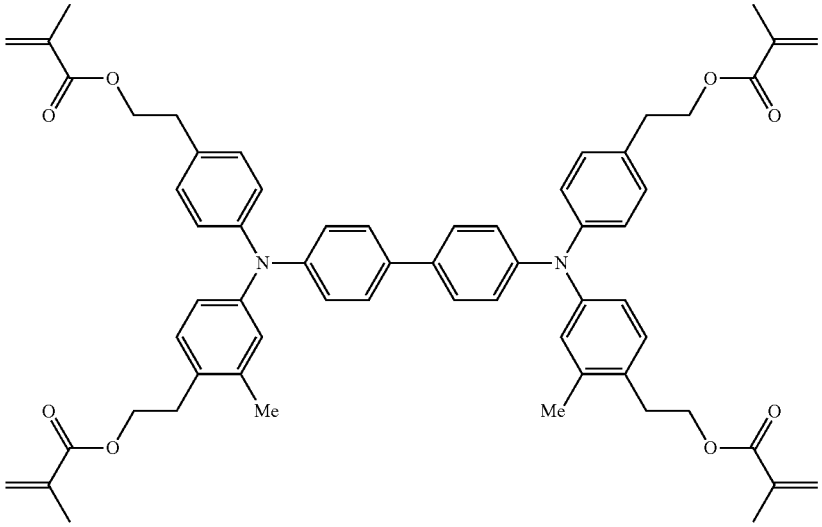
iv-9
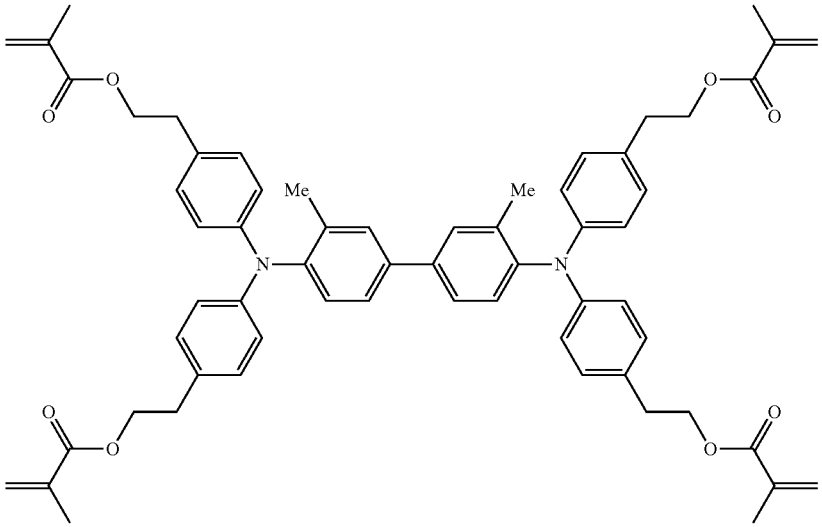

-continued
iv-10
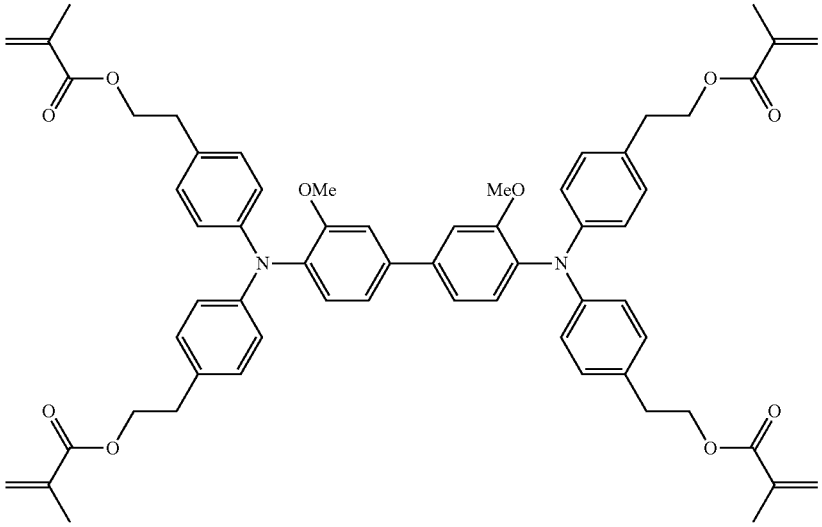
iv-11
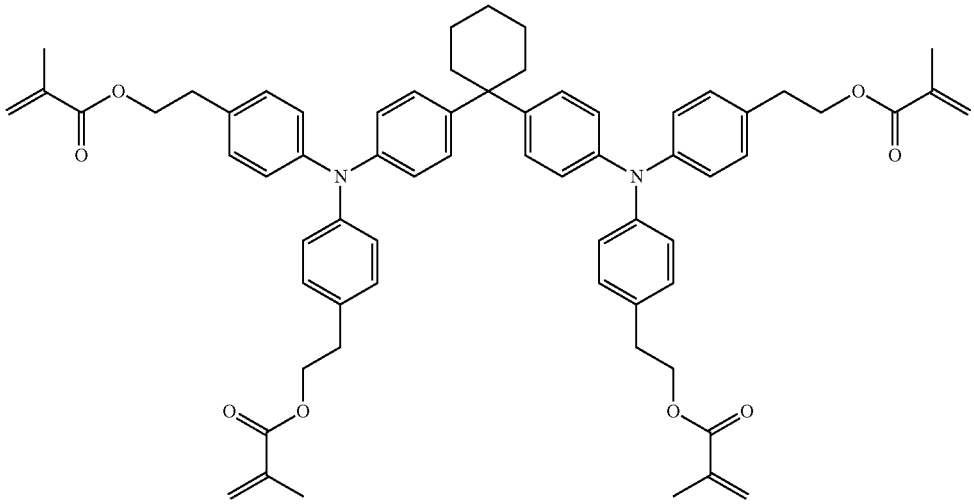
iv-12
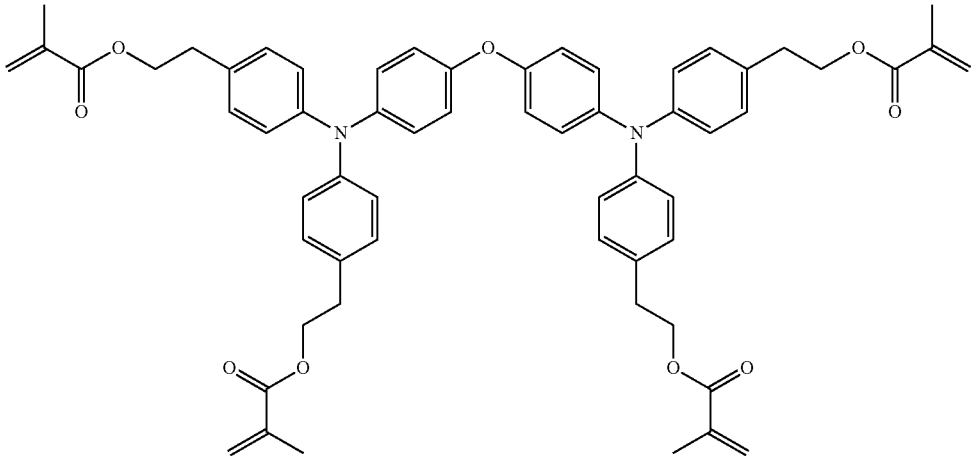

-continued
iv-13
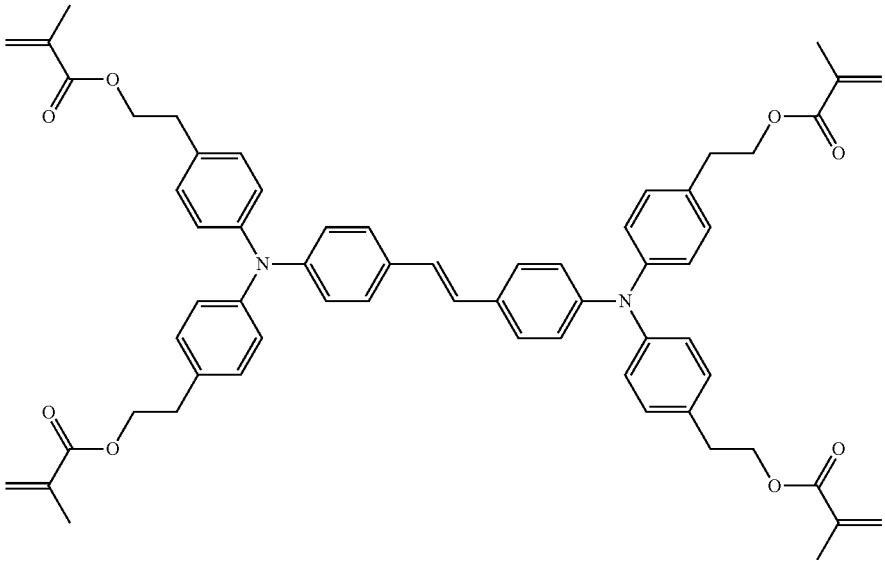
iv-14
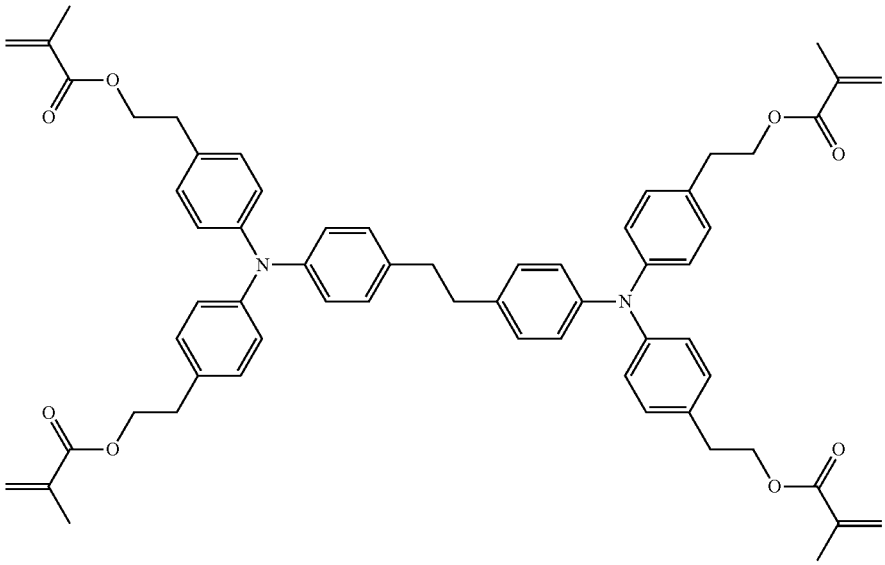
iv-15
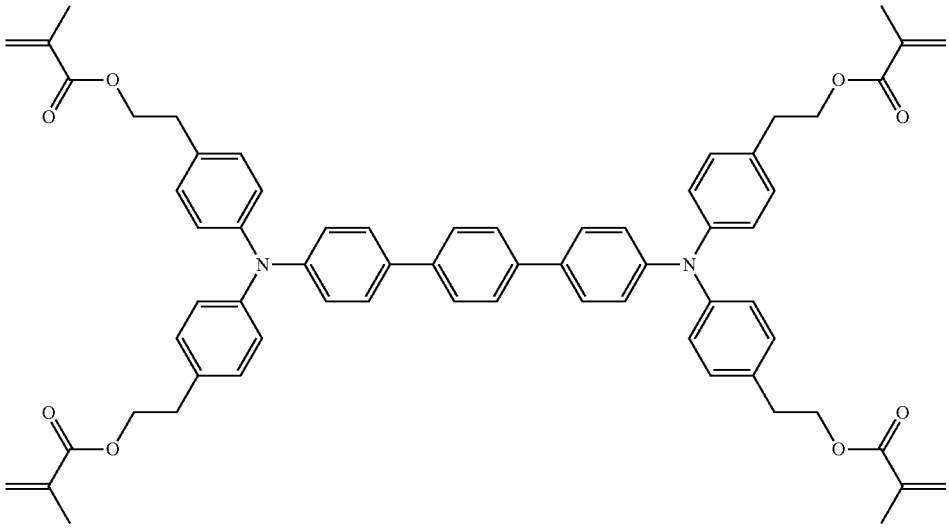

-continued
iv-16
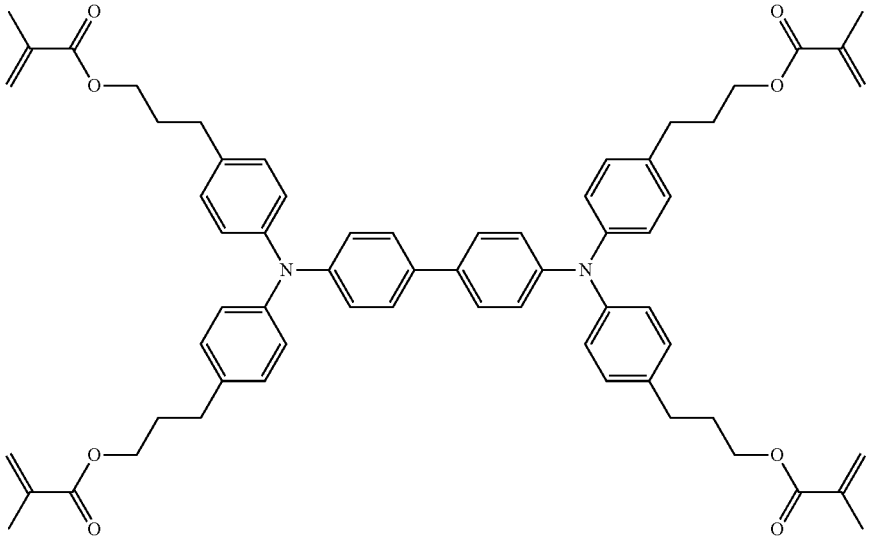
iv-17
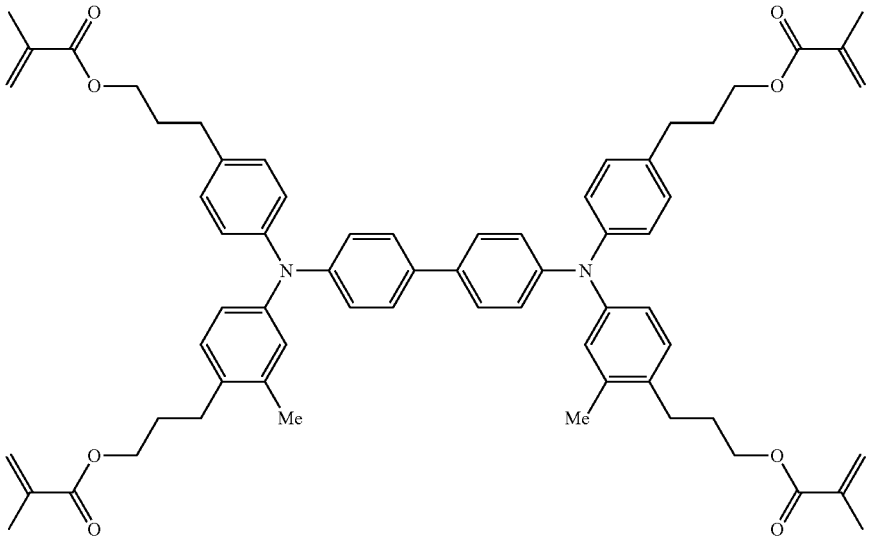
iv-18
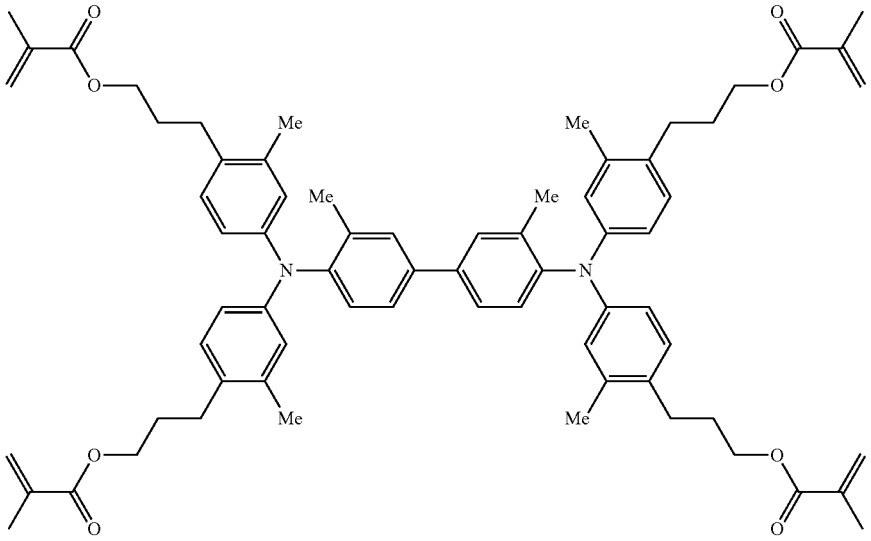

-continued
iv-19
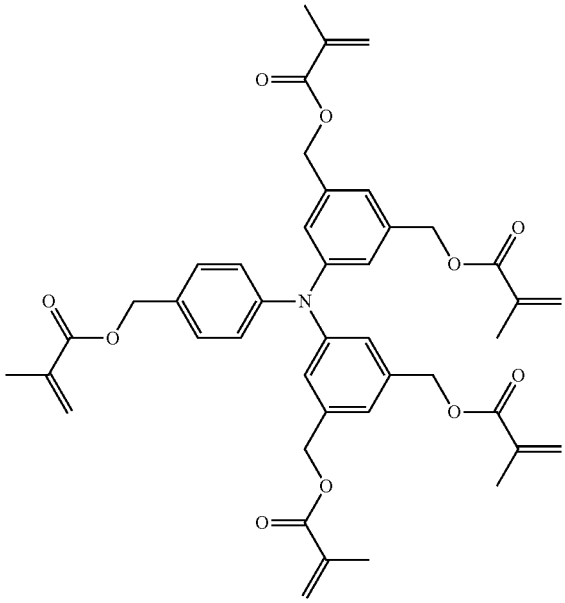
iv-20
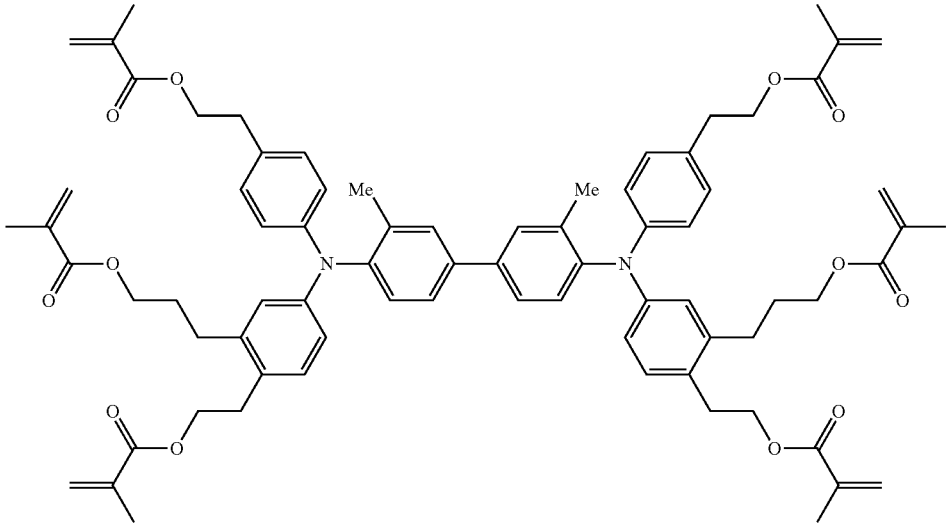
iv-21
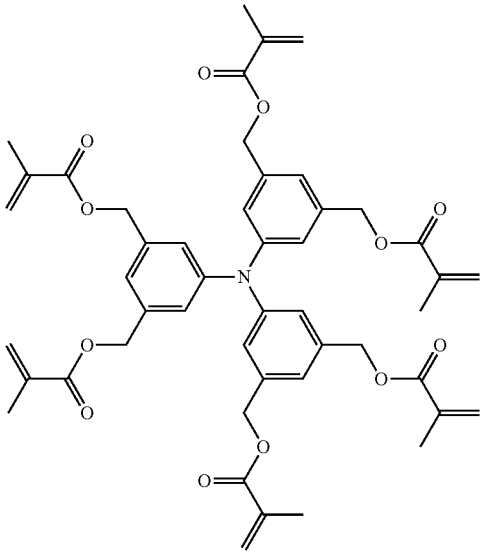
iv-22
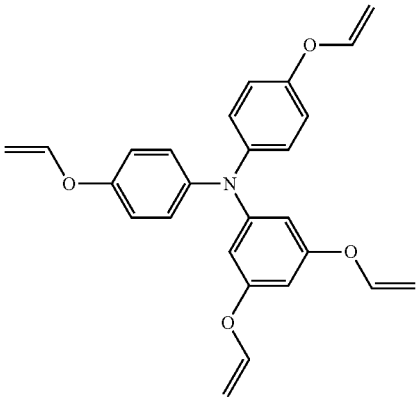

-continued
iv-23
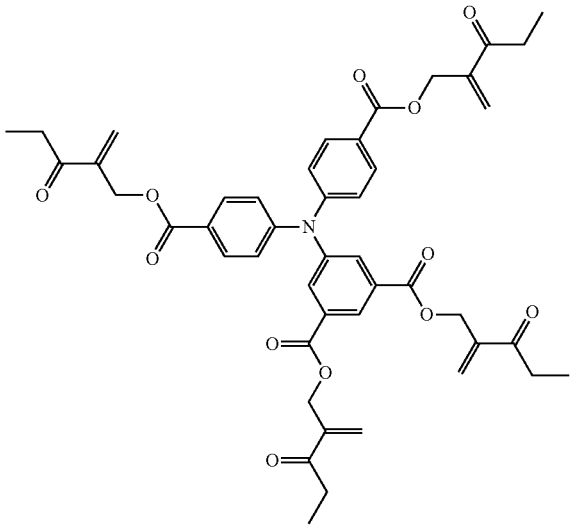
iv-24
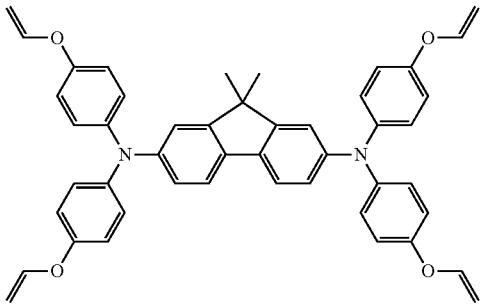
iv-25
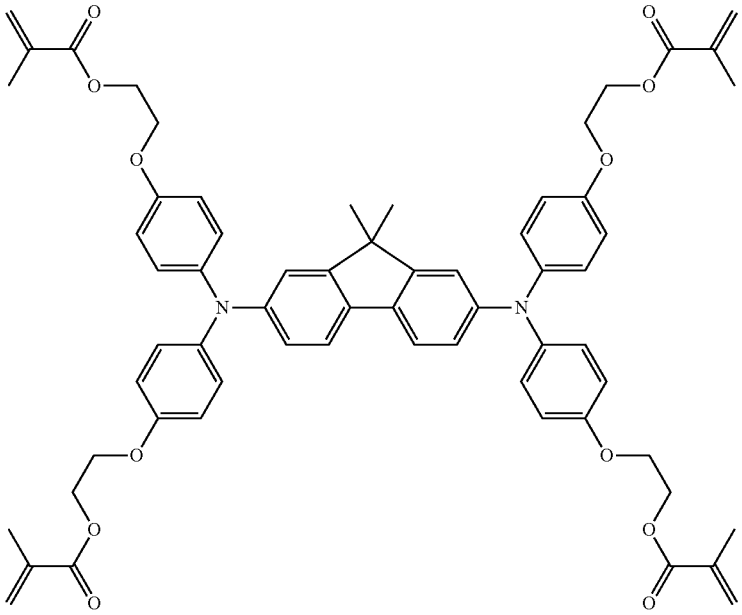

-continued
iv-26
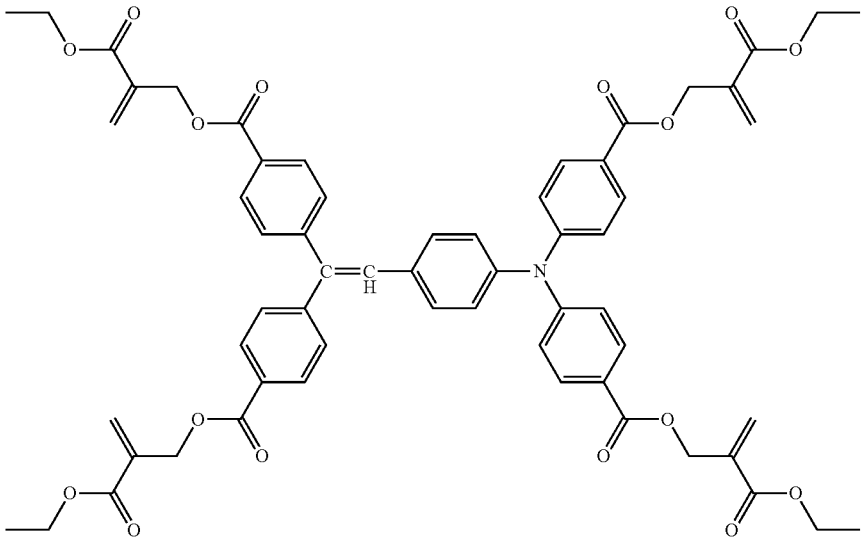
iv-27
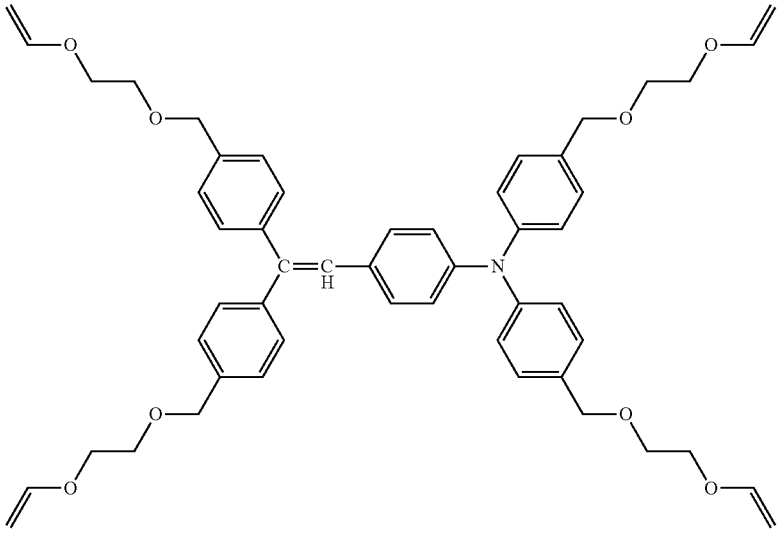
iv-28
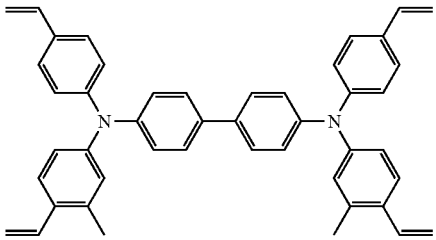
iv-29
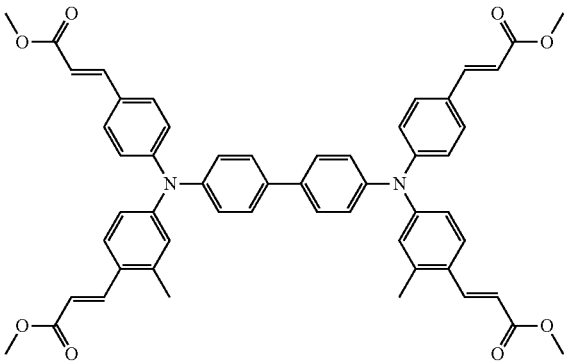

-continued
iv-30
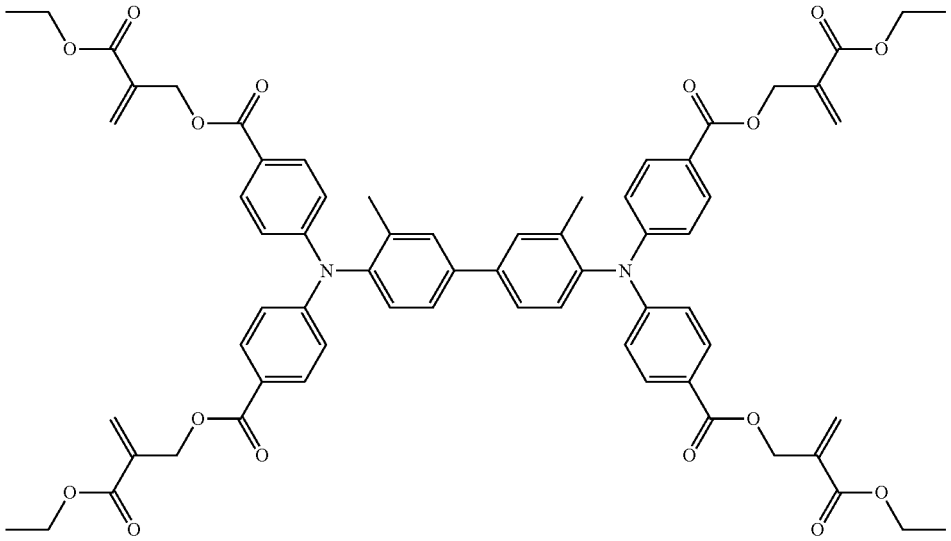
iv-31
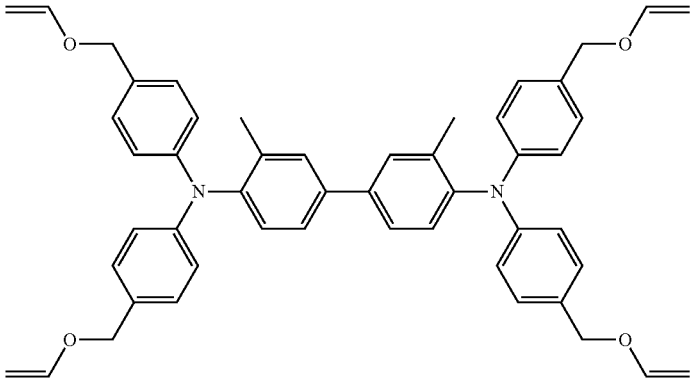
iv-32
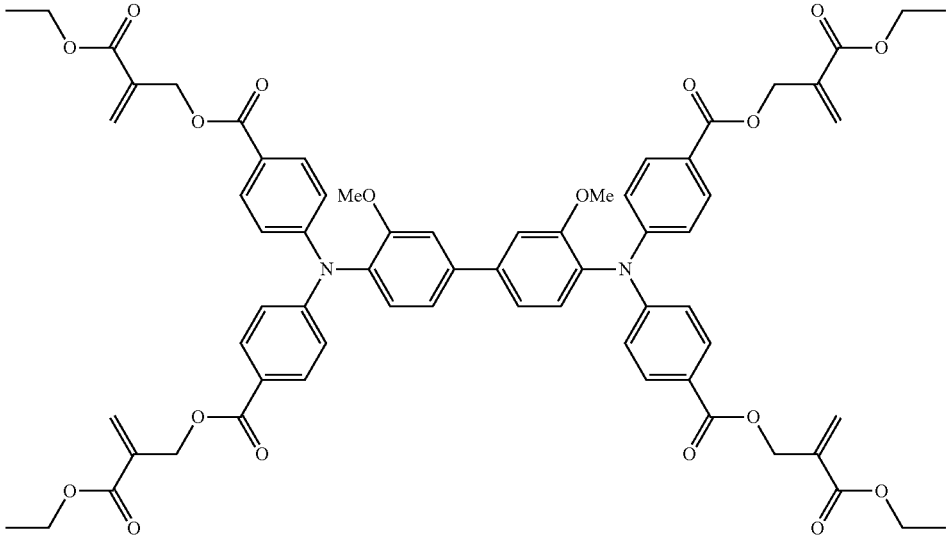

-continued
iv-33
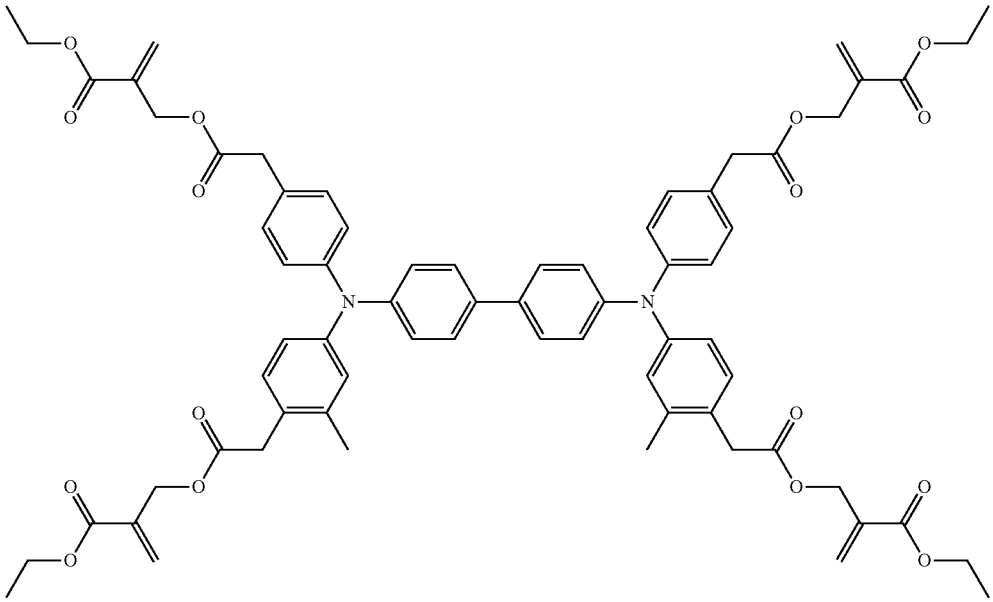
iv-34
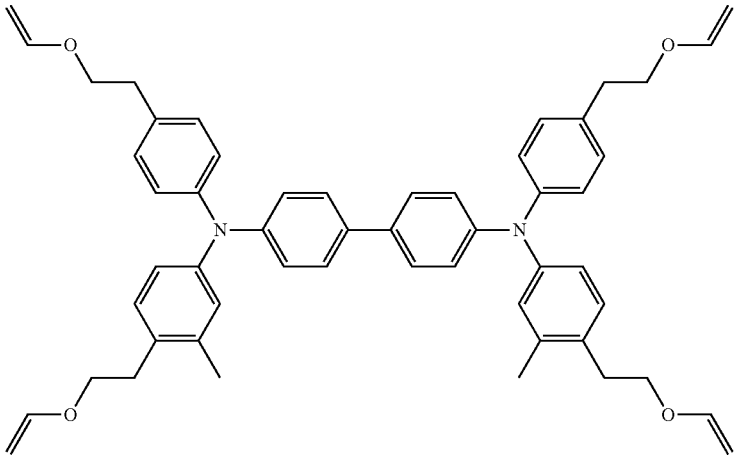
iv-35
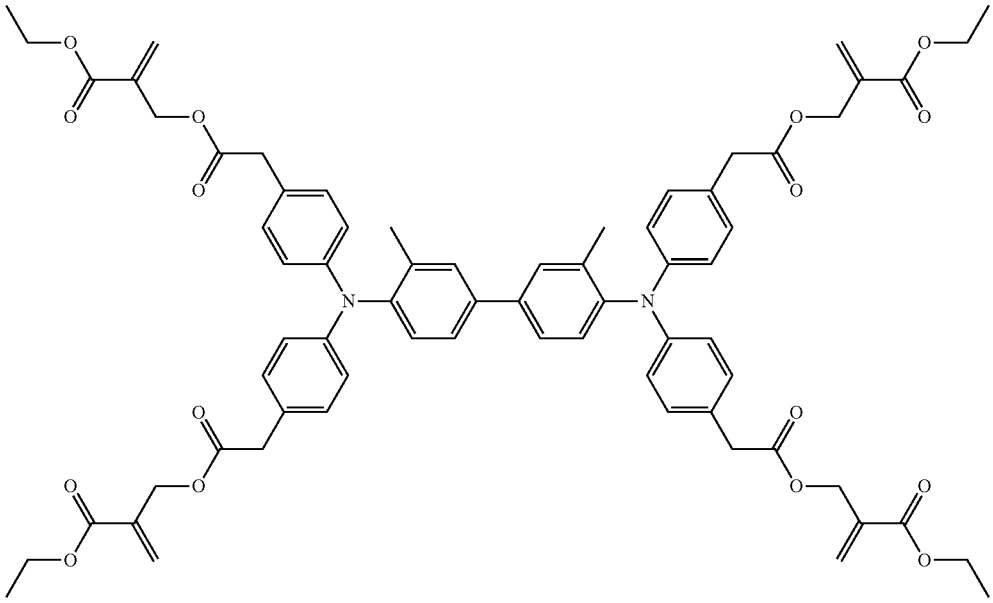

-continued
iv-36
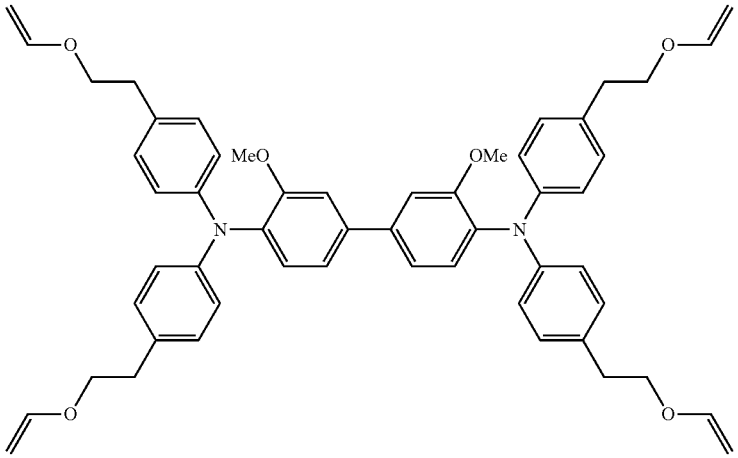
iv-37
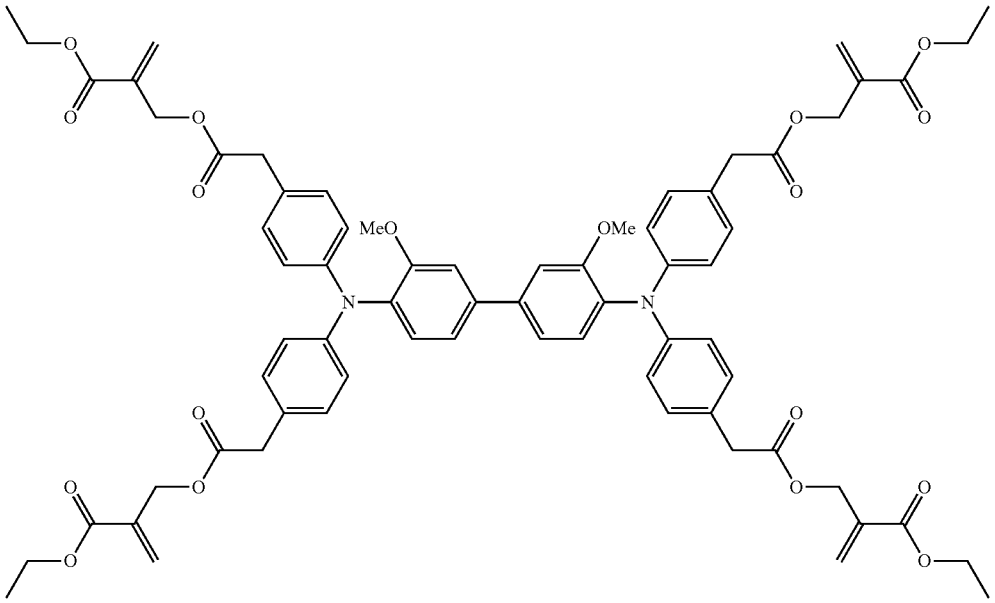

-continued
iv-38
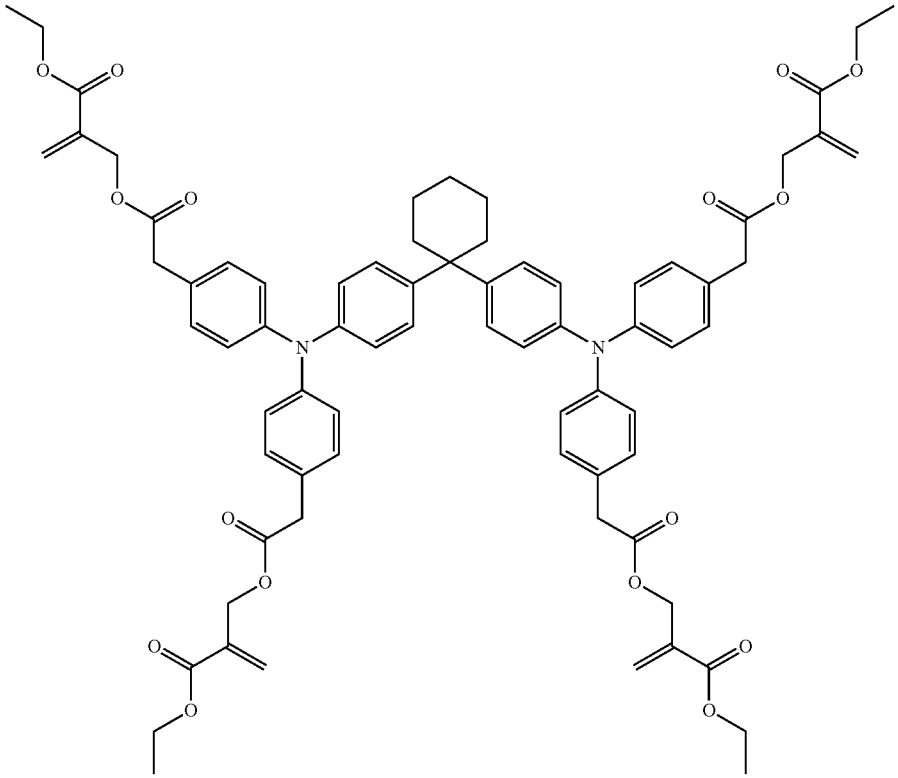
iv-39
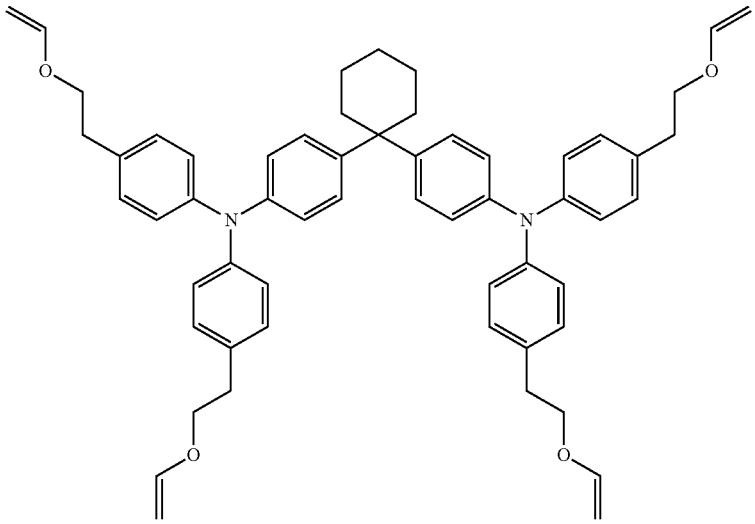

-continued
iv-40
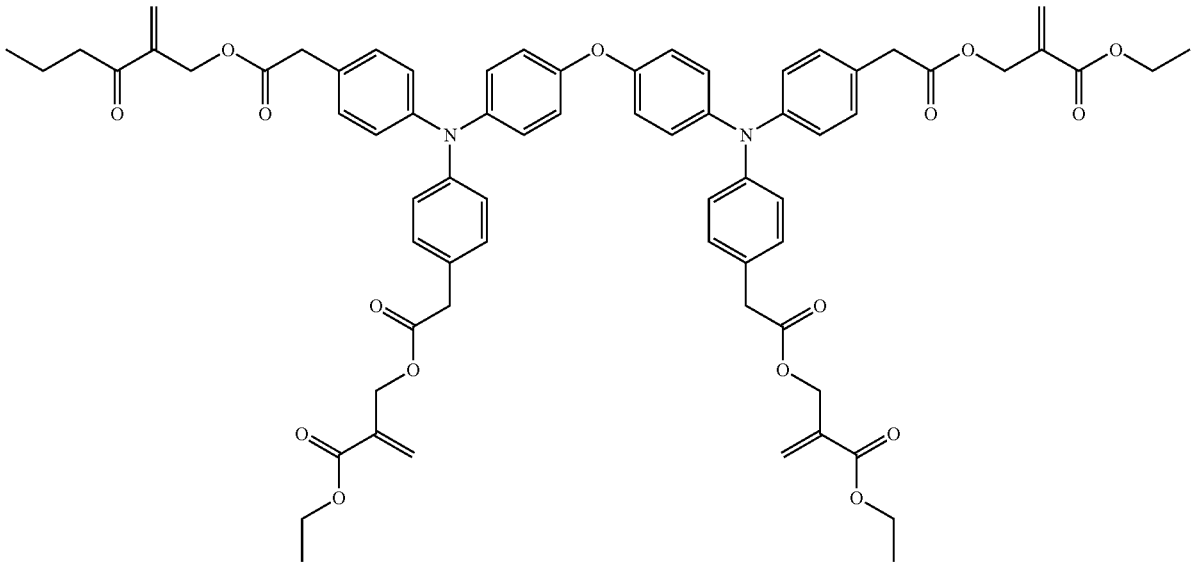
iv-41
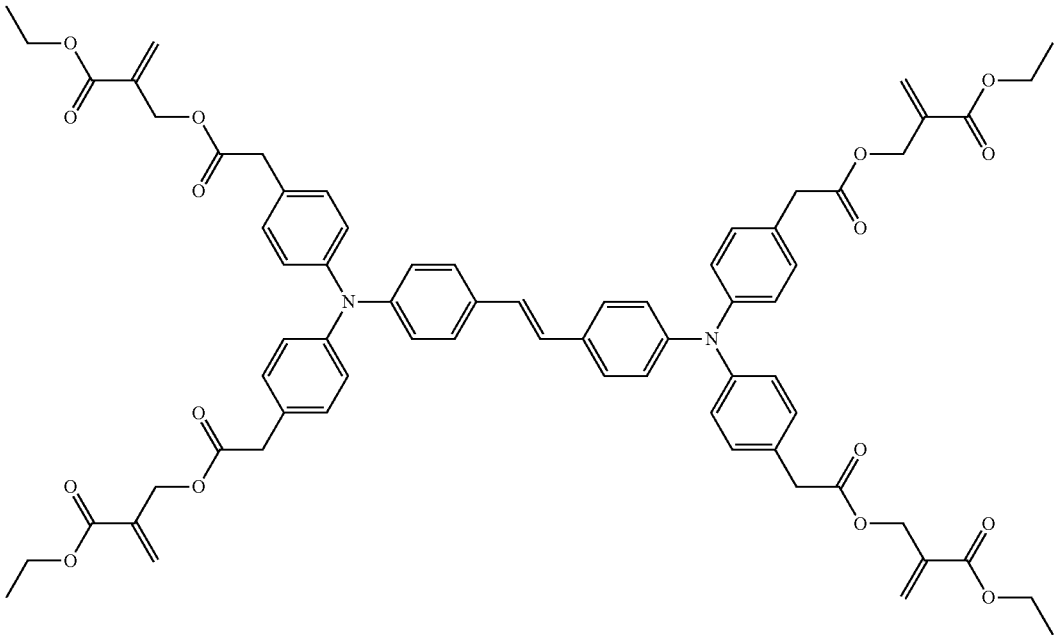

-continued
iv-42
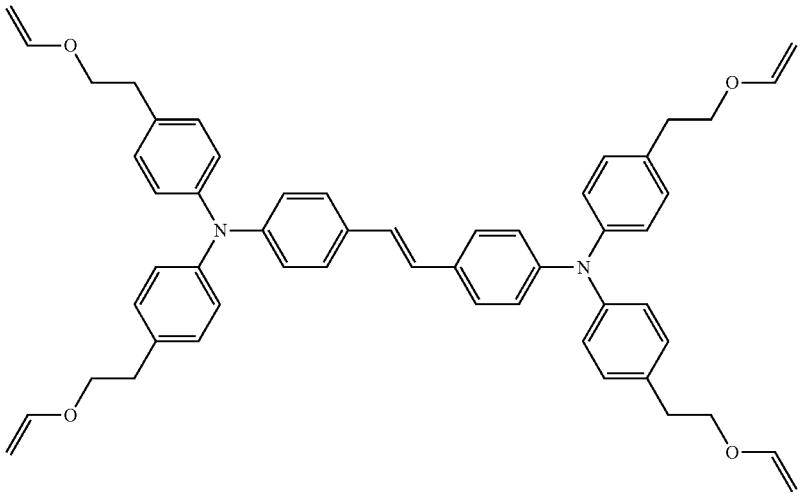
iv-43
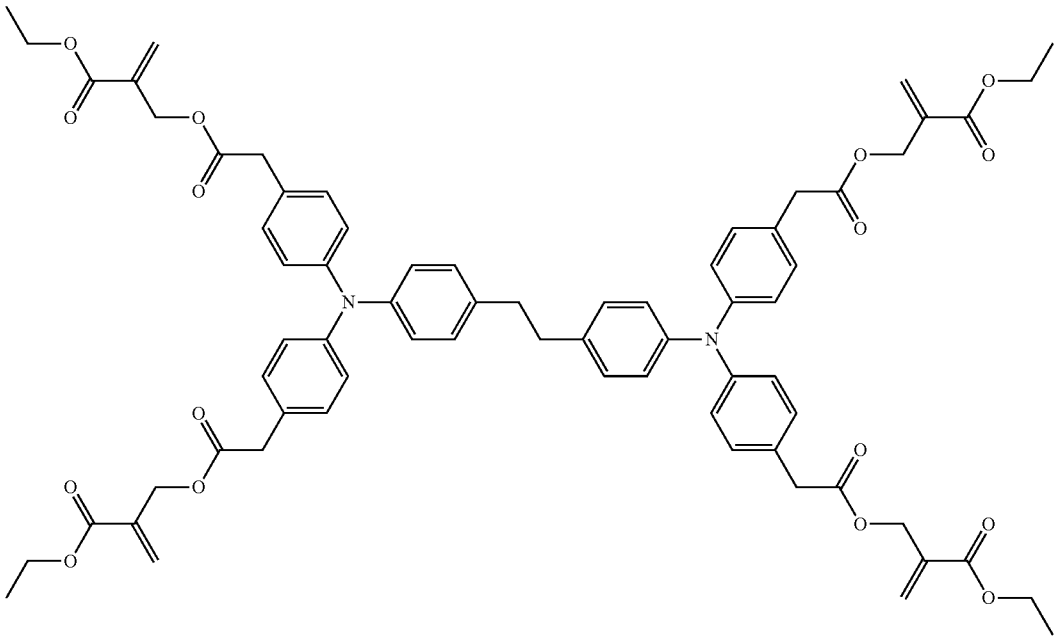
iv-44
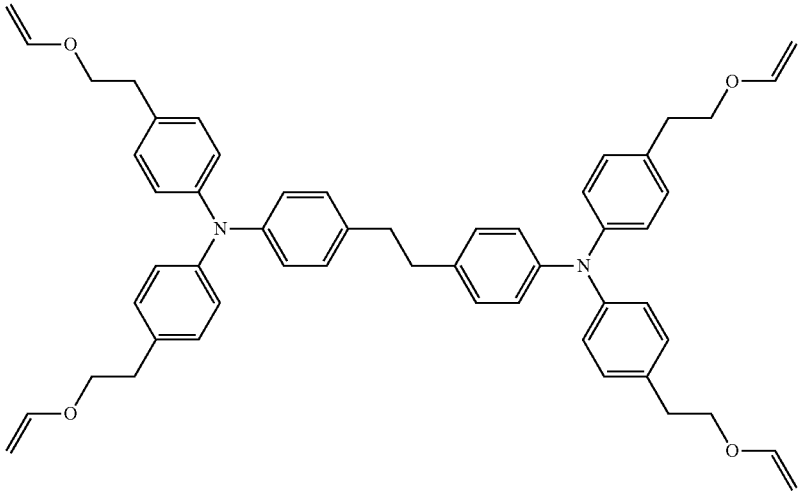

-continued
iv-45
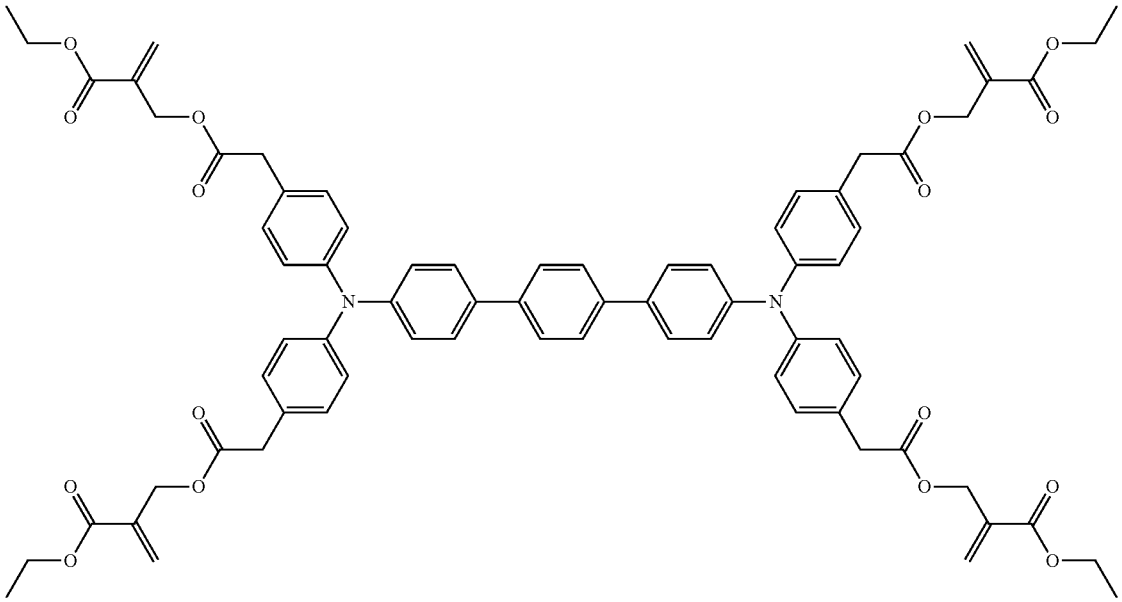
iv-46
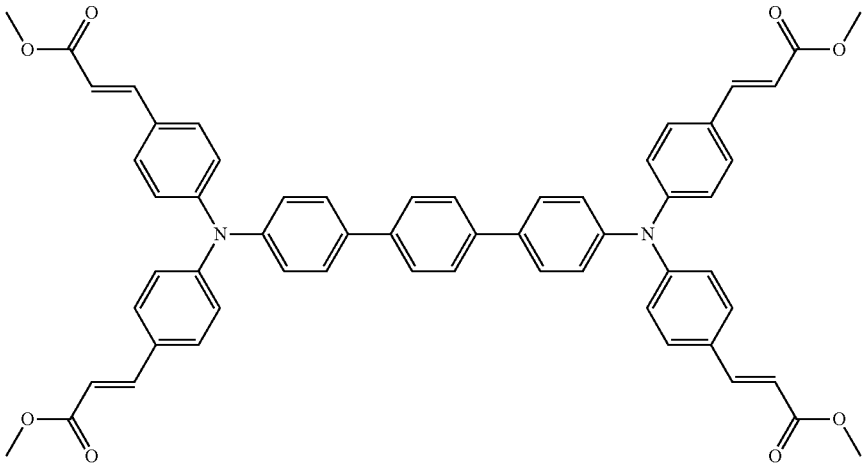
iv-47
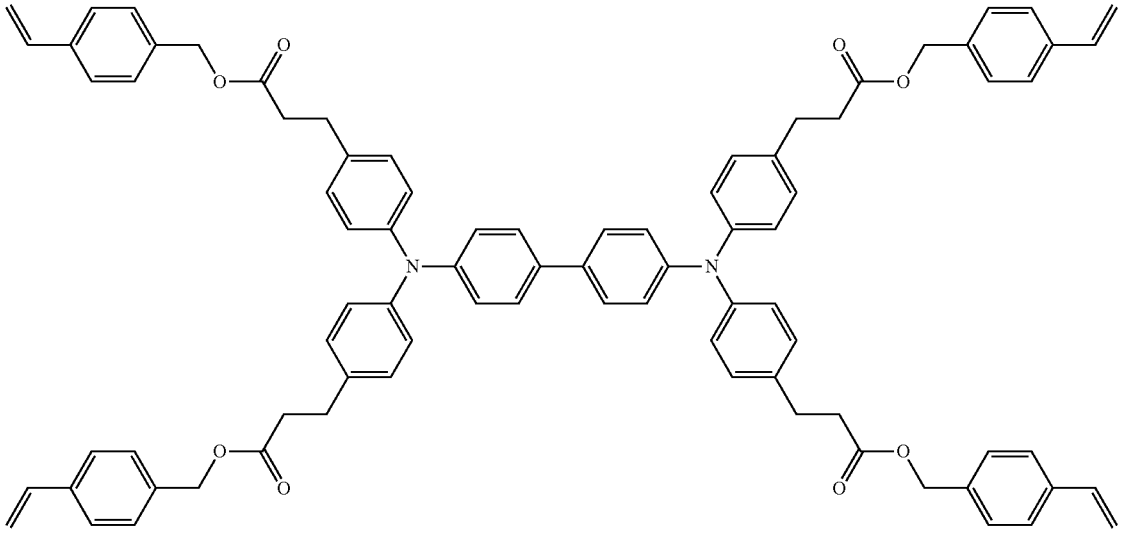

-continued
iv-48
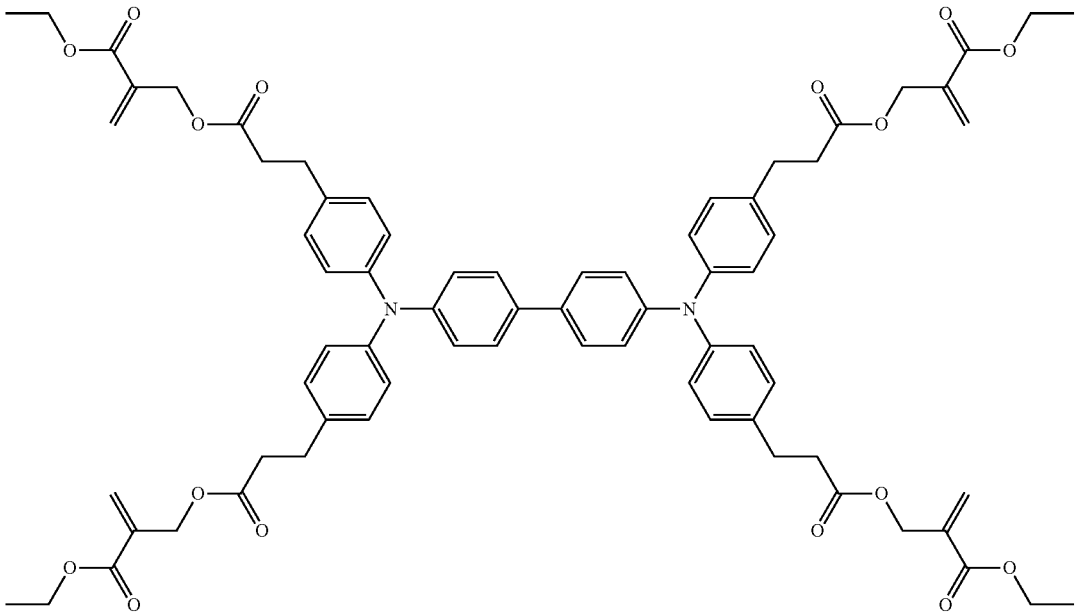
iv-49
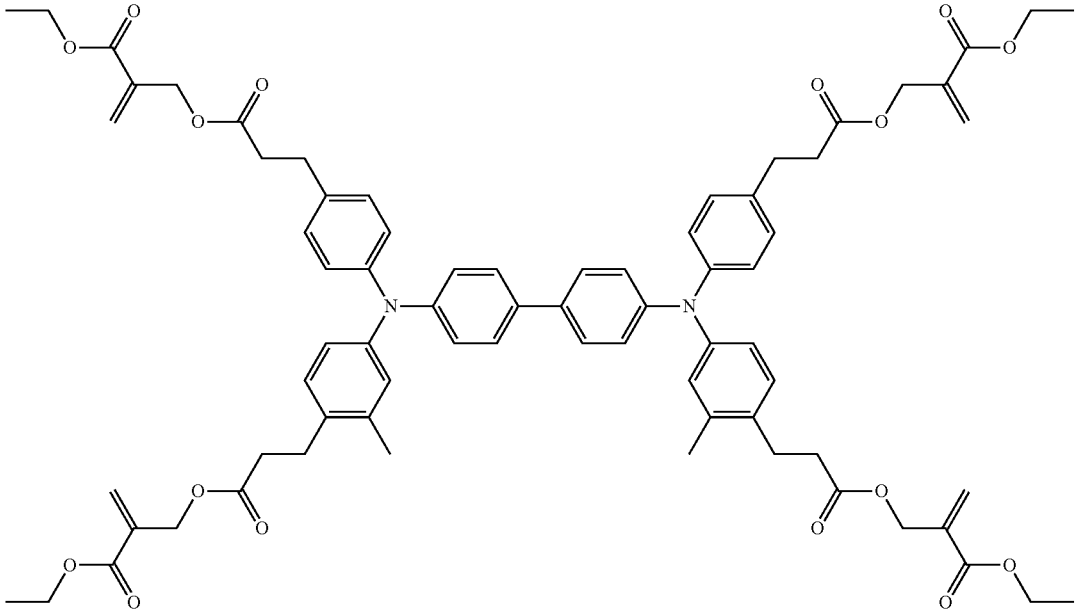

-continued
iv-50
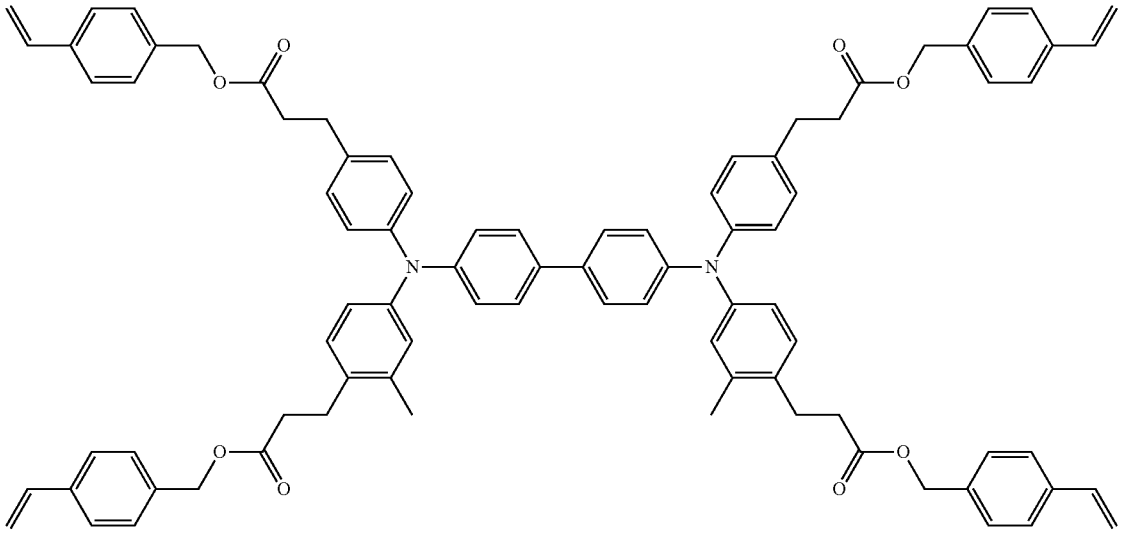
iv-51
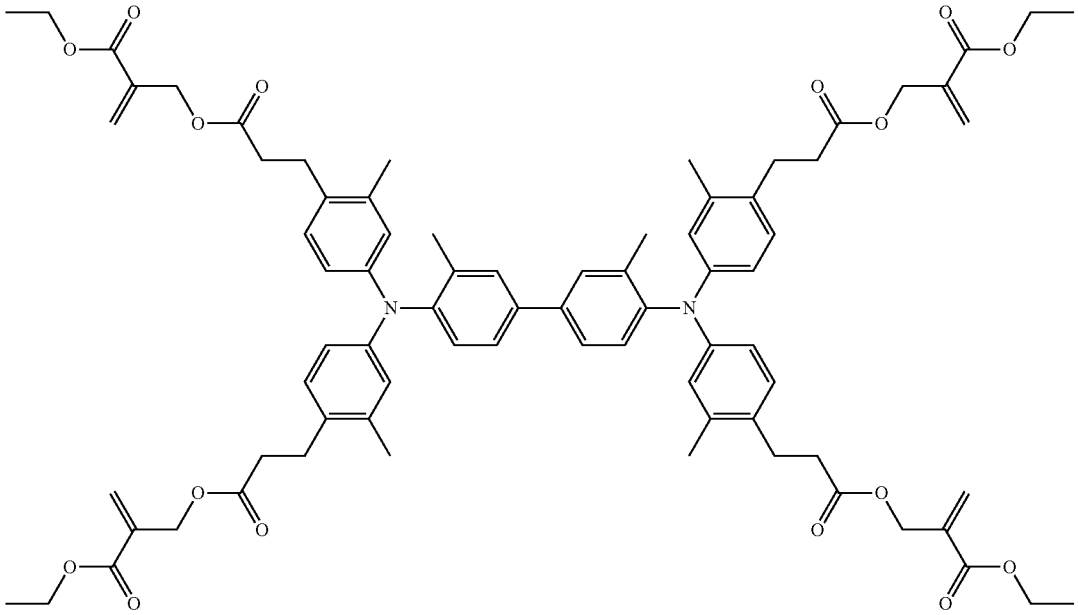

-continued
iv-52
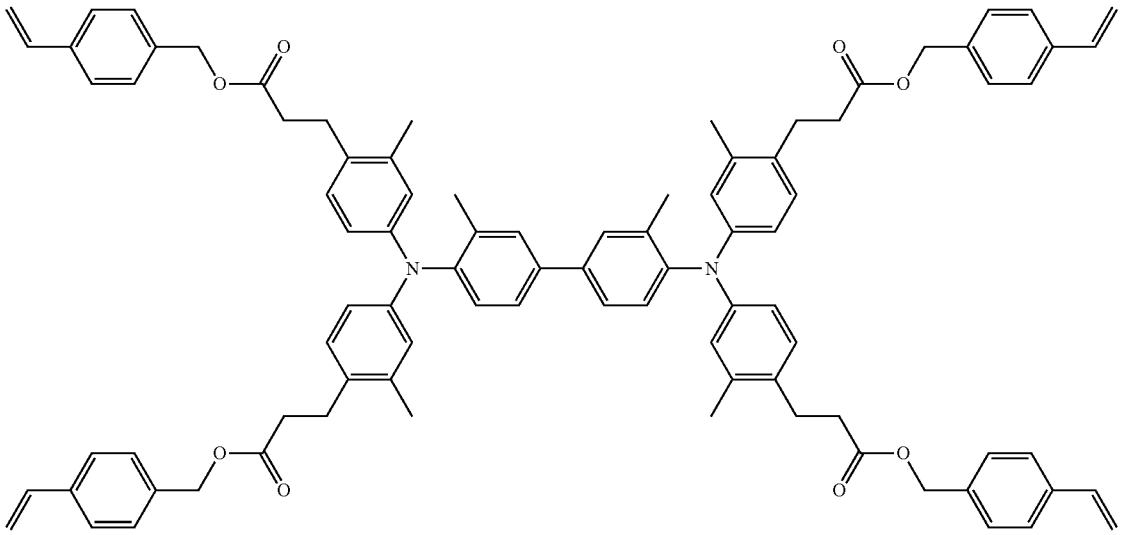
iv-53
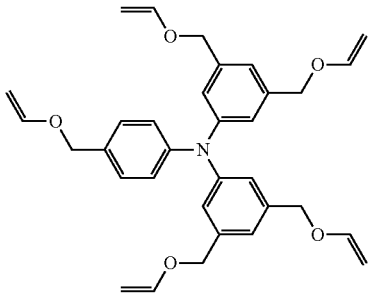
iv-54
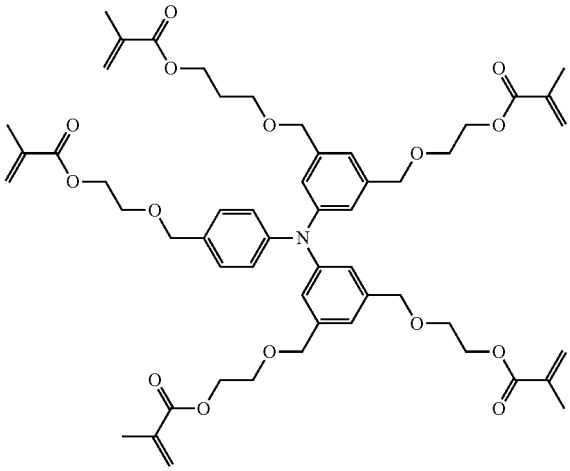

-continued
iv-55
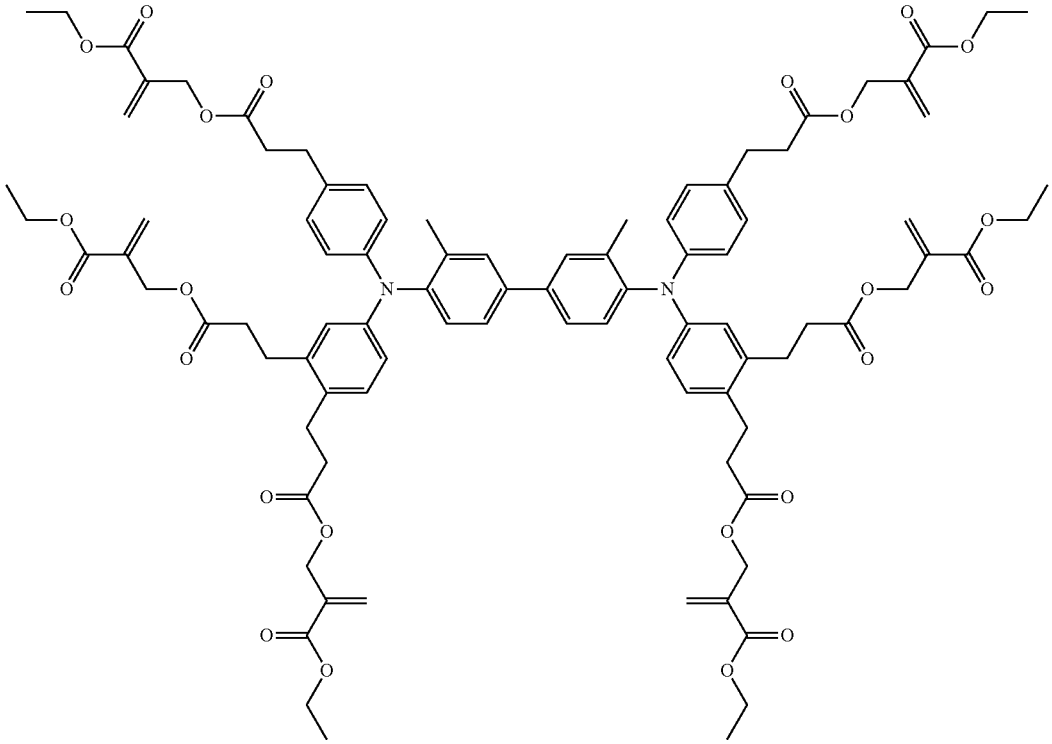
iv-56
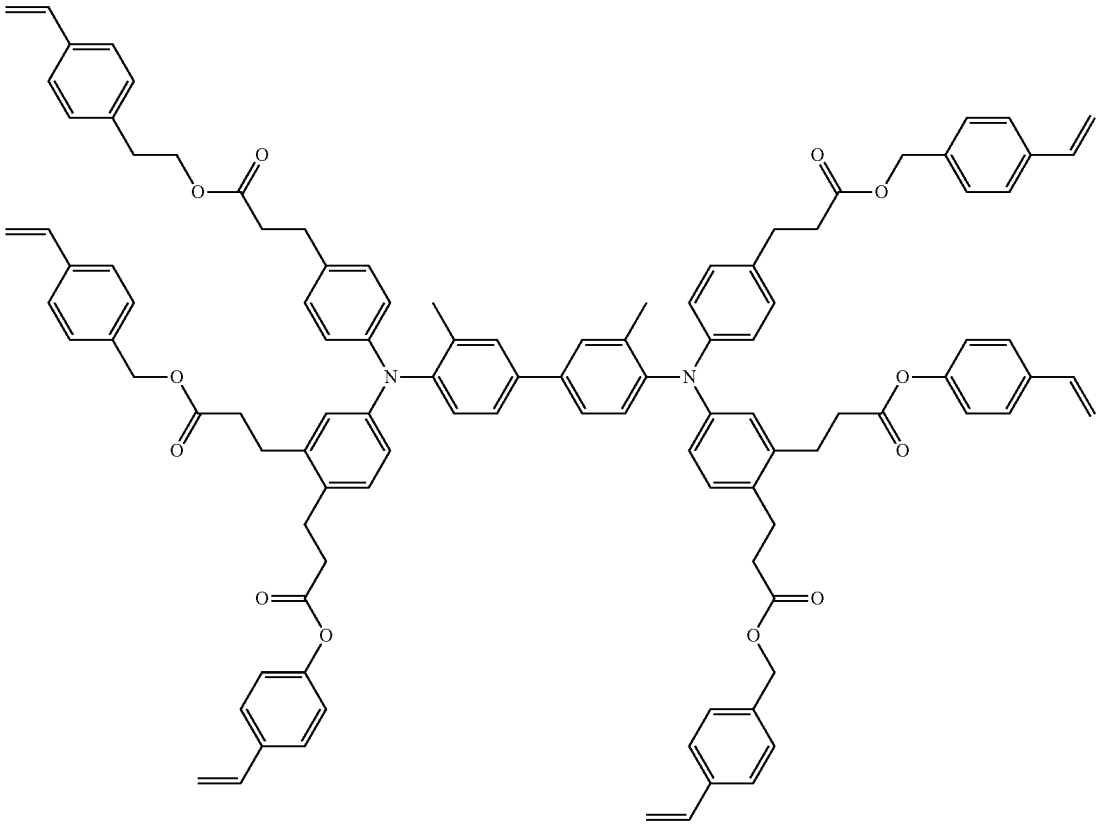

-continued iv-57

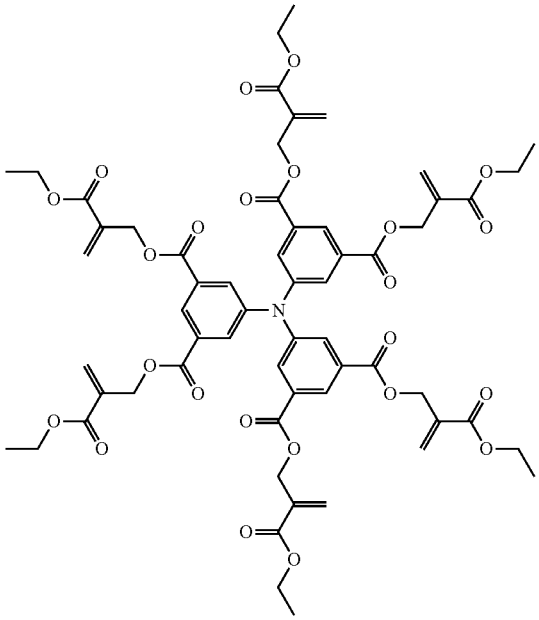

iv-58

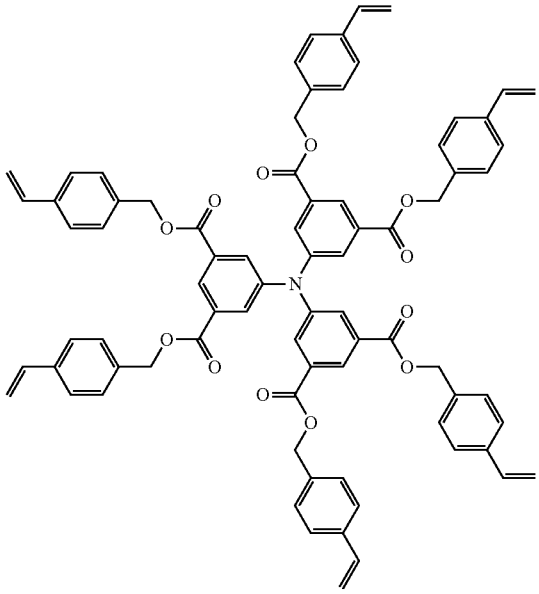

The specific charge transporting material is synthesized, for example, as follows.

That is, the specific charge transporting material can be synthesized by condensation of an alcohol which is a precursor with a corresponding methacrylic acid or methacrylic acid halide, or when an alcohol which is a precursor has a benzyl alcohol structure, the compound can be synthesized by dehydration etherification of a methacrylic acid derivative having a hydroxyl group, such as hydroxyethyl methacrylate and the like.

The synthesis routes of Compound iv-4 and Compound iv-17 that are used in the present exemplary embodiment are shown below as one example.

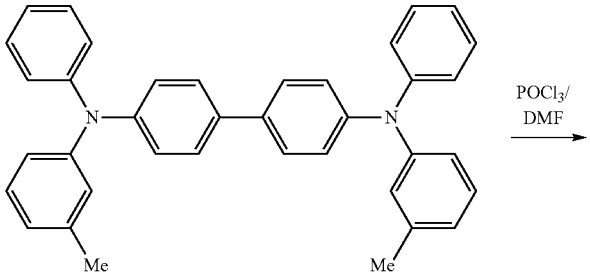

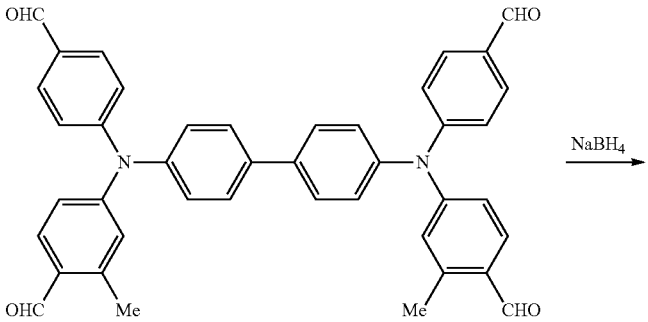

-continued
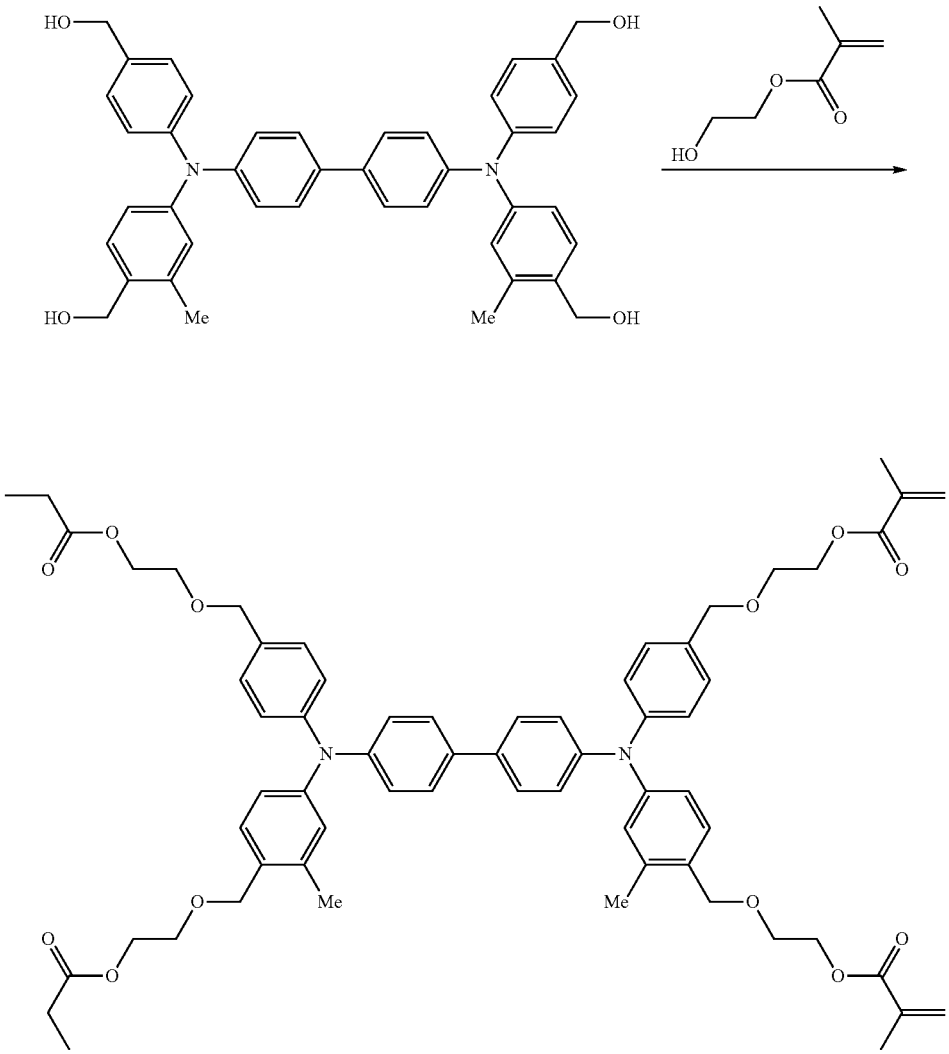
Compound iv-4
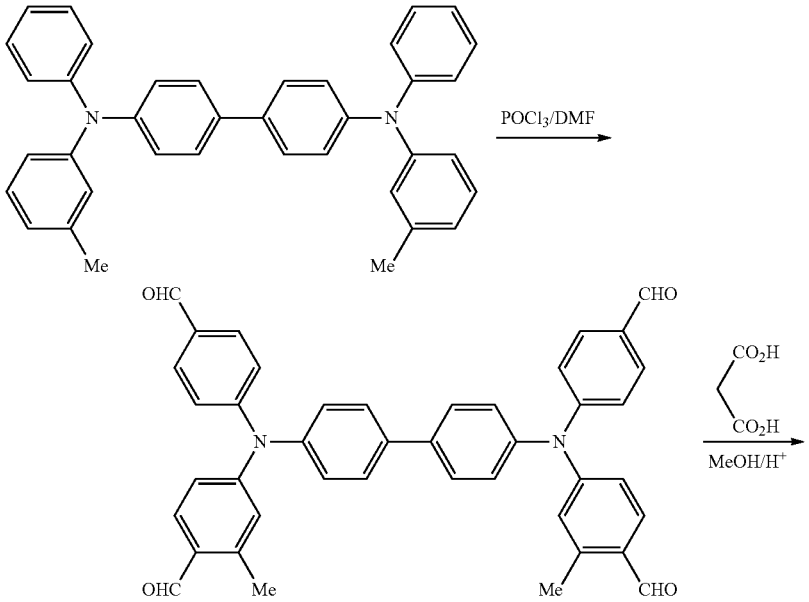

-continued
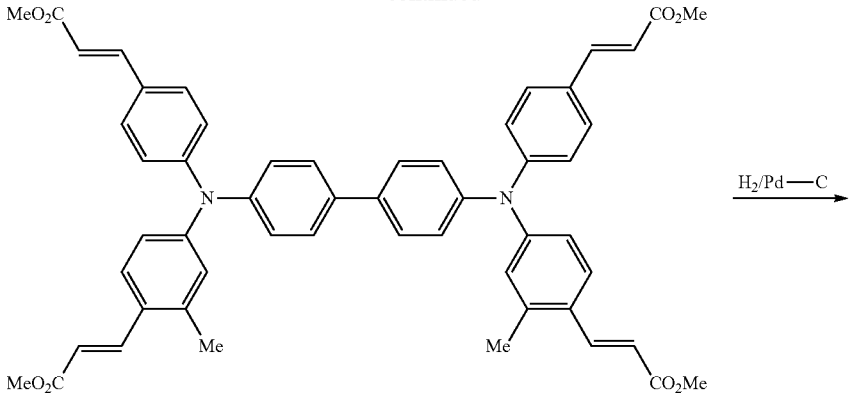
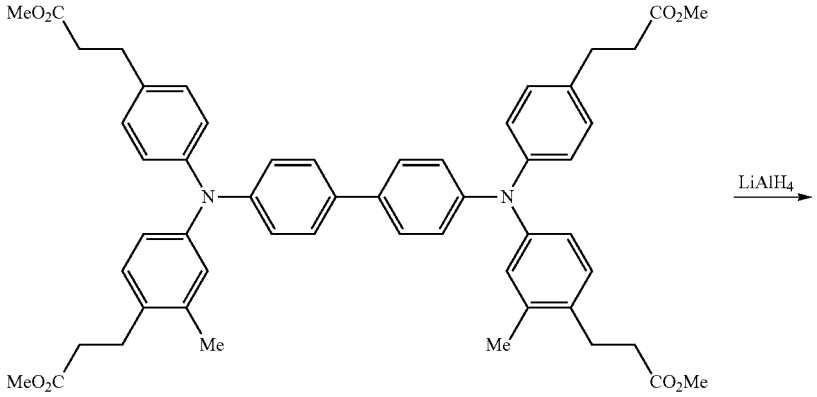
Compound iv-4
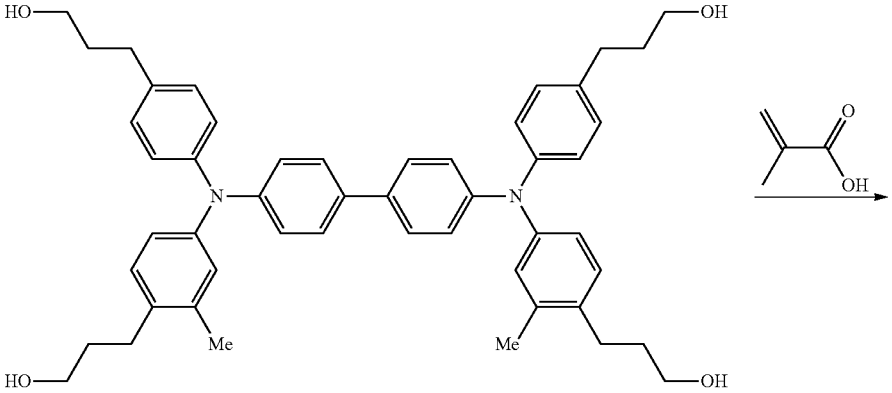

-continued

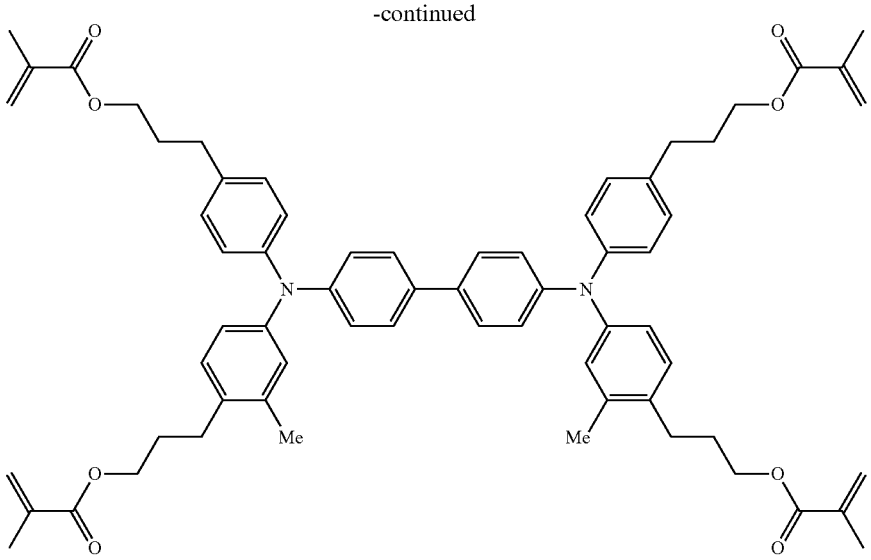

Compound iv-17

Other specific charge transporting materials are synthesized, for example, in the same manner as in the synthesis routes of the Compound iv-4 and the Compound iv-17 as described above.

In the present exemplary embodiment, as the specific charge transporting material, as described above, a compound having 2 or more chain polymerizable functional groups is preferable, and a compound having 4 or more chain polymerizable functional groups is particularly preferable.

Furthermore, as the specific charge transporting material, a compound having 4 or more chain polymerizable functional groups and a compound having 1 to 3 chain polymerizable functional groups may be used in combination. By this combined use, the strength of the cured film is adjusted while reduction of the charge transporting performance is inhibited.

If as the specific charge transporting material, a compound having 4 or more chain polymerizable functional groups and a compound having 1 to 3 chain polymerizable functional groups is used in combination, the content of the compound having 4 or more chain polymerizable functional groups is preferably adjusted to 5% by mass or more, and particularly preferably 20% by mass or more, based on the total content of the specific charge transporting materials.

The total content of the specific charge transporting materials is, for example, preferably 40% by mass or more, more preferably 50% by mass or more, and even more preferably 60% by mass or more.

When the total content is within this range, excellent electrical characteristics may be obtained and a cured film may be formed into a thick film.

Furthermore, in the present exemplary embodiment, the specific charge transporting material and a known charge transporting material containing no reactive group may be used in combination. The known charge transporting materials containing no reactive groups increase the component concentration of the charge transporting material and are effective in improving electrical characteristics because they have no reactive groups that do not serve for charge transport.

As the known charge transporting material, ones that are exemplified as a charge transporting material constituting the charge transporting layer as described above are used.

Hereinafter, other components of the charge transporting composition for forming the protective layer (functional layer) will be described.

Examples of the charge transporting composition used for forming the protective layer (functional layer) include the following surfactants, from the viewpoint of securing the film forming ability.

The surfactant is, for example, a surfactant having, in the molecule thereof, at least one structure selected from (A) a structure obtained by polymerizing an acrylic monomer having a fluorine atom, (B) a structure having a carbon-carbon double bond and a fluorine atom, (C) an alkylene oxide structure, and (D) a structure having a carbon-carbon triple bond and a hydroxyl group.

The surfactant may contain one or more kinds of structure selected from the structures (A) to (D) in the molecule and may have 2 or more.

Hereinafter, the structures (A) to (D) and the surfactant that has these structures will be described.

(A) Structure Obtained by Polymerizing Acrylic Monomer Having Fluorine Atom

The structure (A) obtained by polymerizing an acrylic monomer having a fluorine atom is not particularly limited, but is preferably a structure obtained by polymerizing an acrylic monomer having a fluoroalkyl group, and is more preferably a structure obtained by polymerizing an acrylic monomer having a perfluoroalkyl group.

Specific examples of the surfactant having the structure (A) include POLYFLOW-KL-600 (manufactured by KYOEISHA CHEMICAL Co., Ltd.), EFTOP EF-351, EF-352, EF-801, EF-802, and EF-601 (all manufactured by Mitsubishi Materials Electronic Chemicals Co., Ltd.), and the like.

(B) Structure Having Carbon-Carbon Double Bond and Fluorine Atom

The structure (B) having a carbon-carbon double bond and a fluorine atom is not particularly limited, but is preferably a group represented by at least one of the following structural formulae (B1) and (B2).

(B1)

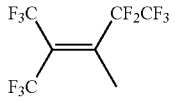

(B2)

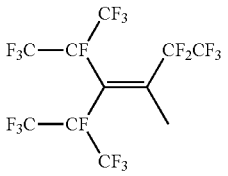

The surfactant having the structure (B) is preferably a compound that has a group represented by at least one of the structural formulae (B1) and (B2) on the side chain of an acrylic polymer or a compound represented by any one of the following structural formulae (B3) to (B5). When the surfactant having the structure (B) is the compound that has a group represented by at least one of the structural formulae (B1) and (B2) on the side chain of an acrylic polymer, a uniform outermost layer may be formed because the acrylic structure has good affinity to the other components of the composition.

Furthermore, when the surfactant having the structure (B) is the compound represented by any one of the structural formulae (B3) to (B5), film defects may be inhibited because it tends to prevent repelling upon coating.

(B3)

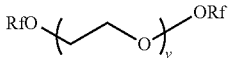

(B4)

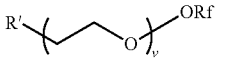

(B5)

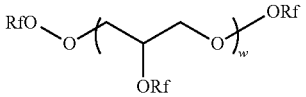

In the structural formulae (B3) to (B5), v and w each independently represent an integer of 1 or more, R' represents a hydrogen atom or a monovalent organic group, and Rf's each independently represent a group represented by the structural formula (B1) or (B2).

In the structural formulae (B3) to (B5), the monovalent organic group represented by R' may include, for example, an alkyl group having 1 to 30 carbon atoms and a hydroxyalkyl group having 1 to 30 carbon atoms.

Examples of the commercially available products of the surfactant having the structure (B) include the following.

Examples of the compound represented by any one of the structural formulae (B3) to (B5) include FTERGENT 100, 100C, 110, 140A, 150, 150CH, A-K, 501, 250, 251, 222F, FTX-218, 300, 310, 400SW, 212M, 245M, 290M, FTX-207S, FTX-211S, FTX-220S, FTX-230S, FTX-209F, FTX-213F, FTX-222F, FTX-233F, FTX-245F, FTX-2080, FTX-218G, FTX-230G, FTX-2400, FTX-204D, FTX-280D, FTX-212D, FTX-216D, FTX-218D, FTX-220D, and FTX-222D (all manufactured by NEOS Co., Ltd.).

Further, examples of the compound that has a group represented by at least one of the structural formulae (B1) and (B2) on the side chain of an acrylic polymer include KB-L82, KB-L85, KB-L97, KB-L109, KB-L110, KB-F2L, KB-F2M, KB-F2S, KB-F3M, and KB-FaM (all, manufactured by NEOS Co., Ltd.), and the like.

(C) Alkylene Oxide Structure

Examples of the alkylene oxide structure (C) include an alkylene oxide and a polyalkylene oxide. Specific examples of the alkylene oxide include ethylene oxide, propylene oxide, and the like. Polyalkylene oxide that has 2 to 10000 repeating units of these alkylene oxides may be also included.

Examples of the surfactant having the alkylene oxide structure (C) include polyethylene glycol, a polyether defoaming agent, and a polyether modified silicone oil.

Polyethylene glycol having a weight average molecular weight of 2000 or less is preferable. Examples of the polyethylene glycol having a weight average molecular weight of 2000 or less include polyethylene glycol 2000 (weight average molecular weight 2000), polyethylene glycol 600 (weight average molecular weight 600), polyethylene glycol 400 (weight average molecular weight 400), polyethylene glycol 200 (weight average molecular weight 200), and the like.

In addition, preferable examples include a polyether defoaming agent such as PE-M and PE-L (manufactured by Wako Pure Chemical Industries, Ltd.), Defoaming Agent No. 1, or Defoaming Agent No. 5 (all, manufactured by Kao Corp.).

Examples of the surfactant having a fluorine atom in the molecule thereof in addition to the alkylene oxide structure (C) in the molecule include a surfactant having an alkylene oxide or a polyalkylene oxide on the side chain of a polymer having a fluorine atom and a surfactant that is characterized by substituting the end of an alkylene oxide or a polyalkylene oxide with a substitution group having a fluorine atom.

Specific examples of the surfactant having a fluorine atom in the molecule thereof in addition to the an alkylene oxide structure (C) include MEGAFAC F-443, F-444, F-445, and F-446 (all manufactured by Dainippon Ink & Chemicals Inc.), FTERGENT 250, 251, and 222F (all manufactured by NEOS Co., Ltd.), POLY FOX PF636, PF6320, PF6520, and PF656 (all manufactured by Kitamura Chemicals Co., Ltd.), and the like.

Specific examples of the surfactant having a silicone structure in the molecule thereof in addition to the alkylene oxide structure (C) in the molecule include KF351(A), KF352(A), KF353(A), KF354(A), KF355(A), KF615(A), KF618, KF945(A), and KF6004 (all manufactured by Shin-Etsu Chemical Co., Ltd.), TSF4440, TSF4445, TSF4450, TSF4446, TSF4452, TSF4453, and TSF4460 (all manufactured by GE Toshiba Silicone Corp.), and BYK-300, 302, 306, 307, 310, 315, 320, 322, 323, 325, 330, 331, 333, 337, 341, 344, 345, 346, 347, 348, 370, 375, 377, 378, UV3500, UV3510, UV3570, and the like (all manufactured by BYK-Chemie Japan K.K. Company).

(D) Structure Having Carbon-Carbon Triple Bond and Hydroxyl Group

The structure (D) having a carbon-carbon triple bond and a hydroxyl group is not particularly limited. The surfactant having this structure include the following compounds.

The surfactant having the structure (D) having a carbon-carbon triple bond and a hydroxyl group may include a compound having a triple bond and a hydroxyl group in the molecule thereof. Specific examples thereof include 2-propyn-1-ol, 1-Butyn-3-ol, 2-butyn-1-ol, 3-Butyn-1-ol, 1-pentyn-3-ol, 2-pentyn-1-ol, 3-pentyn-1-ol, 4-pentyn-1-ol, 4-pentyn-2-ol, 1-hexyn-3-ol, 2-hexyn-1-ol, 3-hexyn-1-ol, 5-hexyn-3-ol, 1-heptyn-3-ol, 2-heptyn-1-ol, 3-heptyn-1-ol, 4-heptyn-2-ol, 5-heptyn-3-ol, 1-octyn-3-ol, 2-octyn-1-ol, 3-octyn-1-ol, 3-nonyn-1-ol, 2-decyn-1-ol, 10-undecyn-1-ol, 3-methyl-1-butyn-3-ol, 3-methyl-1-penten-4-yn-3-ol, 3-methyl-1-pentyn-3-ol, 5-methyl-1-hexyn-3-ol, 3-ethyl-1-pentyn-3-ol, 3-ethyl-1-heptyn-3-ol, 4-ethyl-1-octyn-3-ol, 3,4-dimethyl-1-pentyn-3-ol, 3,5-dimethyl-1-hexyn-3-ol, 3,6-dimethyl-1-heptyn-3-ol, 2,2,8,8-tetramethyl-3,6-nonadiyn-5-ol, 4,6-nonadecadiyn-1-ol, 10,12-pentacosadiyn-1-ol, 2-butyne-1,4-diol, 3-hexyne-2,5-diol, 2,4-hexadiyne-1,6-diol, 2,5-dimethyl-3-hexyne-2,5-diol, 3,6-dimethyl-4-octyne-3,6-diol, 2,4,7,9-tetramethyl-5-decyne-4,7-diol, (+)-1,6-bis(2-chlorophenyl)-1,6-diphenyl-2,4-hexadiyne-1,6-diol, (−)-1,6-bis(2-chlorophenyl)-1,6-diphenyl-2,4-hexadiyne-1,6-diol, 2-butyne-1,4-diol bis(2-hydroxyethyl), 1,4-diacetoxy-2-butyne, 4-diethylamino-2-butyn-1-al, 1,1-diphenyl-2-propyn-1-ol, 1-ethynyl-1-cyclohexanol, 9-ethynyl-9-fluorenol, 2,4-hexadiynediyl-1,6-bis(4-phenylazobenzene sulfonate), 2-hydroxy-3-butynoic acid, 2-hydroxy-3-butynoic acid ethyl ester, 2-methyl-4-phenyl-3-butyn-2-ol, methyl proparagyl ether, 5-phenyl-4-pentyn-1-ol, 1-phenyl-1-propyn-3-ol, 1-phenyl-2-propyn-1-ol, 4-trimethylsilyl-3-butyn-2-ol, 3-trimethylsilyl-2-propyn-1-ol, and the like.

In addition, compounds (for example, SURFYNOL 400 series (manufactured by Shin-Etsu Chemical Co., Ltd.) and the like) that are obtained by adding an alkylene oxide such as ethylene oxide to a part or all of hydroxyl groups of the above compounds may be included.

The surfactant having the structure (D) having a carbon-carbon triple bond and a hydroxyl group is preferably a compound represented by any one of the following formulae (D1) and (D2).

(D1)

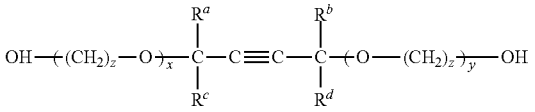

(D2)

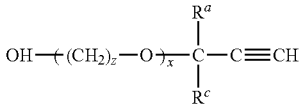

In formulae (D1) and (D2), $R^a$, $R^b$, $R^c$, and $R^d$ each independently represent a monovalent organic group, and x, y, and z are each independently an integer of 1 or more.

Among the compounds represented by formula (D1) or (D2), the compound in which $R^a$, $R^b$, $R^c$, and $R^d$ are an alkyl group is preferable. Further, the compound in which at least one of $R^a$ and $R^b$ and at least one of $R^c$ and $R^d$ is a branched alkyl group is preferable. Further, the compound in which z is 1 or more and 10 or less is preferable. x and y are each preferably 1 or more and 500 or less.

Examples of the commercially available product of the compound represented by formula (D1) or (D2) include the SURFYNOL 400 series (manufactured by Shin-Etsu Chemical Co., Ltd.).

The surfactants having the structure (A) to (D) may be used alone or as a mixture of plural types. When a mixture of plural types is used, a surfactant having a structure different from the structures of the surfactants that have the structures (A) to (D) may be used in combination, as long as it does not damage the effects.

The surfactant usable in combination may include a surfactant having a fluorine atom or a surfactant having a silicone structure as described below.

Namely, examples of the surfactant that is usable in combination with the surfactants having the structures (A) to (D) include preferably perfluoroalkyl sulfonic acids (for example, perfluorobutane sulfonic acid, perfluorooctane sulfonic acid, and the like), perfluoroalkyl carboxylic acids (for example, perfluorobutane carboxylic acid, perfluorooctane carboxylic acid, and the like), and perfluoroalkyl group-containing phosphoric esters. Examples of the perfluoroalkyl sulfonic acids and perfluoroalkyl carboxylic acids include salts thereof and amide modified bodies thereof.

Examples of the commercially available product of the perfluoroalkyl sulfonic acids include MEGAFAC F-114 (manufactured by Dainippon Ink & Chemicals Inc.), EFTOP EF-101, EF-102, EF-103, EF-104, EF-105, EF-112, EF-121, EF-122A, EF-122B, EF-122C, and EF-123A (all manufactured by Mitsubishi Materials Electronic Chemicals Co., Ltd.), FTERGENT 100, 100C, 110, 140A, 150, 150CH, A-K, and 501 (all manufactured by NEOS Co., Ltd.), and the like.

Examples of a commercially available product of the perfluoroalkyl carboxylic acids include MEGAFAC F-410 (manufactured by Dainippon Ink & Chemicals Inc.), EFTOP EF-201 and EF-204 (all manufactured by Mitsubishi Materials Electronic Chemicals Co., Ltd.), and the like.

Examples of a commercially available product of the perfluoroalkyl-group containing phosphoric esters include MEGAFAC F-493 and F-494 (all manufactured by Dainippon Ink & Chemicals Inc.), EFTOP EF-123A, EF-123B, EF-125M and EF-132 (all manufactured by Mitsubishi Materials Electronic Chemicals Co., Ltd.), and the like.

Furthermore, the surfactant that can be used in combination with the surfactants having the structures (A) to (D) is not limited to those described above, but a fluorine atom containing betaine structure compound (for example, FTARGENT 400SW (manufactured by NEOS Co., Ltd.)) and a surfactant having an amphoteric ion group (for example, FTARGENT SW (manufactured by NEOS Co., Ltd.)) are also suitably used.

Examples of the surfactant that has a silicone structure and is usable in combination with the surfactants having the structures (A) to (D) include general silicone oils such as dimethyl silicone, methyl phenyl silicone, diphenyl silicone, or derivatives thereof.

The content of the surfactant is preferably 0.01% by mass or more and 1% by mass or less, and more preferably 0.02% by mass or more and 0.5% by mass or less, based on the charge transporting composition (the total mass of the solid content excluding the solvent). If the content of the surfactant is less than approximately 0.01% by mass, the effect of preventing a coating film from having defects tends to be insufficient, whereas if the content of the surfactant is more than approximately 1% by mass, the strength of the resultant cured film tends to be lowered because of separation of a surfactant from a curing component (the compound represented by formula (I) or the other monomers or oligomers).

Further, with respect to the total content of the surfactants, the content of the surfactants having the structures (A) to (D) is preferably 1% by mass or more, and more preferably 10% by mass or more.

To the charge transporting composition used for forming the protective layer (functional layer), radical polymerizable monomers, oligomers, or the like that have no charge transportability may be added in order to control the viscosity of the composition, and the strength, flexibility, smoothness, cleaning property, or the like of the film.

Examples of the mono-functional radical polymerizable monomer include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxy acrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl-o-phenylphenol acrylate, o-phenylphenol glycidyl ether acrylate, and the like.

Examples of the bi-functional radical polymerizable monomer include 1,4-butanediol diacrylate, 1,6-hexanediol diacrylate, 1,9-nonanediol diacrylate, 2-n-butyl-2-ethyl-1,3-propanediol diacrylate, tripropylene glycol diacrylate, tetraethylene glycol diacrylate, dioxane glycol diacrylate, polytetramethylene glycol diacrylate, ethoxized bisphenol A diacrylate, ethoxized bisphenol A dimethacrylate, tricyclodecanemethanol diacrylate, tricyclodecanemethanol dimethacrylate, and the like.

Examples of the tri- or higher functional radical polymerizable monomer include trimethylolpropane triacrylate, trimethylolpropane trimethacrylate, pentaerythritol acrylate, trimethylolpropane EO adduct triacrylate, glycerin PO adduct triacrylate, trisacryloyloxyethyl phosphate, pentaerythritol tetraacrylate, ethoxized isocyanuric triacrylate, and the like.

Further, examples of the radical polymerizable oligomer include epoxy acrylate-based oligomers, urethane acrylate-based oligomers, and polyester acrylate-based oligomers.

The radical polymerizable monomers and oligomers that have no charge transportability are preferably contained in an amount of 0% by mass or more and 50% by mass or less, preferably 0% by mass or more and 40% by mass or less, and even more preferably 0% by mass or more and 30% by mass or less, based on the charge transporting composition (the total mass of the solid content excluding the solvent).

Furthermore, it is preferable to add a heat radical generator or a derivative thereof to the charge transporting composition used for forming the protective layer (functional layer). That is, it is preferable that a heat radical generator or a derivative thereof be contained in the protective layer (functional layer).

Here, the cured film (crosslinked film) that constitutes the protective layer (functional layer) is obtained by curing the charge transporting composition containing each of the components with heat, light, an electron beam, or the other various methods, but heat curing is preferable from the viewpoint of balancing the properties of the cured film including the electrical characteristics, the mechanical strength, and the like. Usually, when a general acrylic paint or the like is cured, an electron beam that allows curing without a catalyst and photopolymerization that allows a short time curing are preferably used. However, since in an electrophotographic photoreceptor, a photosensitive layer on which the outermost layer is formed contains a photosensitive material, heat curing that allows a mild reaction is preferable in order to bring about less damage to the photosensitive material and to enhance the surface properties of the resultant cured film.

Thus, heat curing may be performed without a catalyst, but as described below, a heat radical generator or a derivative thereof is preferably used as a catalyst. By this, generation of ghost due to repeated use is easily inhibited.

The heat radical generator or a derivative thereof is not particularly limited, but preferably has a 10 hour half-life temperature of 40° C. or higher and 110° C. or lower for the purpose of preventing the damage of the photosensitive material contained in the photosensitive layer when the protective layer (functional layer) is formed.

Examples of the commercially available heat radical generator or a derivative thereof include an azo-based initiator such as V-30 (10 hour half-life temperature: 104° C.), V-40 (10 hour half-life temperature: 88° C.), V-59 (10 hour half-life temperature: 67° C.), V-601 (10 hour half-life temperature: 66° C.), V-65 (10 hour half-life temperature: 51° C.), V-70 (10 hour half-life temperature: 30° C.), VF-096 (10 hour half-life temperature: 96° C.), Vam-110 (10 hour half-life temperature: 111° C.), and Vam-111 (10 hour half-life temperature: 111° C.) (all manufactured by Wako Pure Chemical Industries, Ltd.); $OT_{AZO}$-15 (10 hour half-life temperature: 61° C.), $OT_{Azo}$-30, AMBN (10 hour half-life temperature: 65° C.), AMBN (10 hour half-life temperature: 67° C.), ADVN (10 hour half-life temperature: 52° C.), and ACVA (10 hour half-life temperature: 68° C.) (all manufactured by Otsuka Chemical Co., Ltd.);

PERTETRA A, PERHEXA HC, PERHEXA C, PERHEXA V, PERHEXA 22, PERHEXA MC, PERBUTYL H, PERCUMYL H, PERCUMYL P, PERMENTA H, HPEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, and PERBUTYL Z (all manufactured by NOF Corp.);

KAYAKETAL AM-055, TRIGONOX 36-C75, LAUROX, PERKADOX L-W75, PERKADOX CH-50L, TRIGONOX TMBH, KAYACUMENE H, KAYABUTYL H-70, PERKADOX BC-FF, KAYAHEXA AD, PERKADOX 14, KAYABUTYL C, KAYABUTYL D, KAYAHEXA YD-E85, PERKADOX 12-XL25, PERKADOX 12-EB20, TRIGONOX 22-N70, TRIGONOX 22-70E, TRIGONOX TRIGONOX 423-C70, KAYAESTER CND-C70, KAYAESTER CND-W50, TRIGONOX 23-C70, TRIGONOX 23-W50N, TRIGONOX 257-C70, KAYAESTER P-70, KAYAESTER TMPO-70, TRIGONOX 121, KAYAESTER O, KAYAESTER HTP-65W, KAYAESTER AN, TRIGONOX 42, TRIGONOX F-050, KAYABUTYL B, KAYACARBON EH-C70, KAYACARBON EH-W60, KAYACARBON I-20, KAYACARBON BIC-75, TRIGONOX 117, and KAYARENE 6-70 (all manufactured by Kayaku Akzo Co., Ltd.); and LUPEROX LP (10 hour half-life temperature: 64° C.), LUPEROX 610 (10 hour half-life temperature: 37° C.), LUPEROX 188 (10 hour half-life temperature: 38° C.), LUPEROX 844 (10 hour half-life temperature: 44° C.), LUPEROX 259 (10 hour half-life temperature: 46° C.), LUPEROX 10 (10 hour half-life temperature: 48° C.), LUPEROX 701 (10 hour half-life temperature: 53° C.), LUPEROX 11 (10 hour half-life temperature: 58° C.), LUPEROX 26 (10 hour half-life temperature: 77° C.), LUPEROX 80 (10 hour half-life temperature: 82° C.), LUPEROX 7 (10 hour half-life temperature: 102° C.), LUPEROX 270 (10 hour half-life temperature: 102° C.), LUPEROX P (10 hour half-life temperature: 104° C.), LUPEROX 546 (10 hour half-life temperature: 46° C.), LUPEROX 554 (10 hour half-life temperature: 55° C.), LUPEROX 575 (10 hour half-life temperature: 75° C.), LUPEROX TANPO (10 hour half-life temperature: 96° C.), LUPEROX 555 (10 hour half-life temperature: 100° C.), LUPEROX 570 (10 hour half-life temperature: 96° C.), LUPEROX TAP (10 hour half-life temperature: 100° C.), LUPEROX TBIC (10 hour half-life temperature: 99° C.), LUPEROX TBEC (10 hour half-life temperature: 100° C.), LUPEROX JW (10 hour half-life temperature: 100° C.), LUPEROX TRIC (10 hour half-life temperature: 96° C.), LUPEROX TAEC (10 hour half-life temperature: 99° C.), LUPEROX DC (10 hour half-life temperature: 117° C.), LUPEROX 101 (10 hour half-life temperature: 120° C.), LUPEROX F (10 hour half-life temperature: 116° C.), LUPEROX DI (10 hour half-life temperature: 129° C.), LUPEROX 130 (10 hour half-life temperature: 131° C.), LUPEROX 220 (10 hour half-life temperature: 107° C.), LUPEROX 230 (10 hour half-life temperature: 109° C.), LUPEROX 233 (10 hour half-life temperature: 114° C.), and LUPEROX 531 (10 hour half-life temperature: 93° C.) (all manufactured by ARKEMA YOSHITOMI, Ltd.).

The heat radical generator or a derivative thereof is contained in an amount of preferably 0.001% by mass or more and 10% by mass or less, more preferably 0.01% by mass or more and 5% by mass or less, and even more preferably 0.1% by mass or more and 3% by mass or less, based on the reactive compounds (specific charge transporting materials) in the charge transporting composition.

Furthermore, to the charge transporting composition used for forming the protective layer (functional layer), the other thermosetting resins such as a phenolic resin, a melamine resin, a benzoguanamine resin, and the like may be added for the purpose of preventing excess absorption of discharge product gases and to prevent effective oxidation caused by the discharge product gases.

Moreover, to the charge transporting composition used for forming the protective layer (functional layer), a coupling agent, a hardcoat agent, or a fluorine-containing compound may be further added for the purpose of controlling the film forming property, flexibility, lubricity, and adhesive property of the film, and others. As these additives, specifically, various silane coupling agents and commercially available silicone-based hardcoat agents are used.

As the silane coupling agents, vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl) γ-aminopropyl triethoxysilane, tetramethoxysilane, methyltrimethoxysilane, dimethyldimethoxysilane, or the like is used.

Furthermore, as the commercially available hardcoat agent, KP-85, X-40-9740, and X-8239 (manufactured by Shin-Etsu Silicones Co., Ltd.), AY42-440, AY42-441, and AY49-208 (manufactured by Dow Corning Toray Co., Ltd.), or the like is used.

In addition, in order to provide water-repellency or the like, a fluorine-containing compound may be added, examples of which include (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, 1H,1H,2H,2H-perfluorooctyltriethoxysilane, and the like.

The silane coupling agents are used in any amount, but the amount of the fluorine-containing compound is preferably 0.25 time or less of the weight of the compounds free of fluorine. When the used amount exceeds this value, a problem in terms of the film forming property of a crosslinked film possibly may be brought about.

In addition, to the charge transporting composition used for forming the protective layer (functional layer), a thermoplastic resin may be added for the purpose of providing the protective layer with resistance against discharge gases, mechanical strength, scratch resistance, torque reduction, control of the abrasion amount, extension of the pot-life, or the like of the protective layer (functional layer), or for controlling the particle dispersibility and the viscosity.

Examples of the thermoplastic resin include a polyvinyl butyral resin, a polyvinyl formal resin, a polyvinyl acetal resin (for example, S-LEC B, K, and the like (all manufactured by Sekisui Chemical Co., Ltd.) such as a partially acetalized polyvinyl acetal resin and the like, a polyamide resin, a cellulose resin, a polyvinyl phenolic resin, and the like. In particular, considering the electrical characteristics, a polyvinyl acetal resin and a polyvinyl phenolic resin are preferable. The weight average molecular weight of the resin is preferably 2,000 or more and 100,000 or less, and more preferably 5,000 or more and 50,000 or less. When the molecular weight of the resin is less than 2,000, the effect of resin addition tends to be insufficient, whereas when it is more than 100,000, the solubility lowers, whereby the addition amount is limited and also failures in film formation are likely to be brought about upon coating. The addition amount of the resin is preferably 1% by mass or more and 40% by mass or less, more preferably 1% by mass or more and 30% by mass or less, and even more preferably 5% by mass or more and 20% by mass or less. When the addition amount of the resin is less than 1% by mass, the effect of resin addition tends to be insufficient, whereas when it is more than 40% by mass, images become to be easily blurred under high temperature and high humidity conditions (for example, 28° C. and 85% RH).

With the charge transporting composition used for forming the protective layer (functional layer), an antioxidant is preferably added for the purpose of preventing degradation caused by oxidative gases such as ozone generated in a charging device of the protective layer (functional layer). When the mechanical strength of the photoreceptor surface is increased and the durability of the photoreceptor is improved, still stronger oxidation resistance as compared before is requested because the photoreceptor is exposed to oxidative gases over a long time.

As the antioxidant, hindered phenol antioxidants or hindered amine antioxidants are preferable. Known antioxidants such as organic sulfur-based antioxidants, phosphite-based antioxidants, dithiocarbamate-based antioxidants, thiourea-based antioxidants, or benzimidazole-based antioxidants may be also used. The addition amount of the antioxidant is preferably 20% by mass or less, and more preferably 10% by mass or less.

Examples of the hindered phenol-based antioxidant include 2,6-di-t-butyl-4-methylphenol, 2,5-di-t-butylhydroquinone, N,N'-hexamethylene bis(3,5-di-t-butyl-4-hydroxyhydrocinnamide, 3,5-di-t-butyl-4-hydroxy-benzylphosphonate-diethylester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenylacrylate, 4,4'-butylidenebis(3-methyl-6-t-butylphenol), and the like.

For the purpose of decreasing the residual potential or improving the strength of the protective layer (functional layer), various particles may be added to the charge transporting composition used for forming the protective layer (functional layer). One example of the particles may be a silicon-containing particle. The silicon-containing particle includes silicon as a constituent element, and specific examples thereof include colloidal silica and silicone particles, and the like. The colloidal silica used as a silicon-containing particle is a dispersion in which silica particles having an average particle diameter of 1 nm or more and 100 nm or less, and preferably 10 nm or more and 30 nm or less are dispersed in an acidic or alkaline aqueous solvent, or in an organic solvent such as an alcohol, a ketone, an ester, and the like. The colloidal silica may be a commercially available product. The solid content of the colloidal silica in the protective layer (functional layer) is not particularly limited, but is preferably 0.1% by mass or more and 50% by mass or less, and more preferably 0.1% by mass or more and 30% by mass or less, with respect to the total solid content of the protective layer from the viewpoints of film forming ability, electrical characteristics, and strength.

The silicone particles that are used as silicon-containing particles are selected from silicone resin particles, silicone rubber particles, and silica particles surface-treated with silicone, and silicone particles generally available on the market are used. These silicone particles are spherical in shape, having an average particle diameter of preferably 1 nm or more and 500 nm or less, and more preferably 10 nm or more and 100 nm or less. The silicone particles are chemically inactive and are minute diameter particles having excellent dispersibility in resins. In addition, the content of the silicone particles required to have sufficient characteristics is so low that the surface properties of electrophotographic photoreceptors are improved without blocking crosslinking reactions. That is, the silicone particles improve the surface lubricity and water-repellency of electrophotographic photoreceptors while they are incorporated without any irregularity in a strong cross-linked structure, so that adequate resistance against abrasion and deposition of staining impurities are maintained over a long time.

The content of the silicone particles in the protective layer (functional layer) is preferably 0.1% by mass or more and 30% by mass or less, and more preferably 0.5% by mass or more and 10% by mass or less, based on the charge transporting composition (the total solid mass excluding the solvent).

Furthermore, other examples of the particles include fluorine particles such as ethylene tetrafluoride, ethylene trifluoride, propylene hexafluoride, vinyl fluoride, vinylidene fluoride, and the like, particles of resin obtained by copolymerizing a fluorine resin and a monomer having a hydroxyl group, such as those described on page 89 of "the Proceedings of the 8th Polymer Material Forum Lecture", and particles of semiconductive metal oxides such as ZnO—$Al_2O_3$, $SnO_2$—$Sb_2O_3$, $In_2O_3$—$SnO_2$, $ZnO_2$—$TiO_2$, ZnO—$TiO_2$, MgO—$Al_2O_3$, FeO—$TiO_2$, $TiO_2$, $SnO_2$, $In_2O_3$, ZnO, MgO, and the like. Oils such as silicone oil and the like may be added for similar purposes. Examples of the silicone oil include silicone oils such as dimethylpolysiloxane, diphenylpolysiloxane, phenylmethylsiloxane, and the like; reactive silicone oils such as amino-modified polysiloxane, epoxy-modified polysiloxane, carboxy-modified polysiloxane, carbinol-modified polysiloxane, methacryl-modified polysiloxane, mercapto-modified polysiloxane, phenol-modified polysiloxane, and the like; cyclic dimethylcyclosiloxanes such as hexamethylcyclotrisiloxane, octamethylcyclotetrasiloxane, decamethylcyclopentasiloxane, dodecamethylcyclohexasiloxane, and the like; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, 1,3,5,7,9-pentamethyl-1,3,5,7,9-pentaphenylcyclopentasiloxane, and the like; cyclic phenylcyclosiloxanes such as hexaphenylcyclotrisiloxane and the like; fluorine-containing cyclosiloxanes such as (3,3,3-trifluoropropyl)methylcyclotrisiloxane and the like; hydrosilyl group-containing cyclosiloxanes such as a methylhydrosiloxane mixture, pentamethylcyclopentasiloxane, phenylhydrocyclosiloxane, and the like; and vinyl group-containing cyclosiloxanes such as pentavinylpentamethylcyclopentasiloxane and the like.

Furthermore, a metal, a metal oxide, carbon black, or the like may added to the charge transporting composition used for forming the protective layer (functional layer). Examples of the metal include aluminum, zinc, copper, chromium, nickel, silver, stainless steel, and the like, and plastic particles onto which a metal such as those above is vapor-deposited. Examples of the metal oxide include zinc oxide, titanium oxide, tin oxide, antimony oxide, indium oxide, bismuth oxide, tin-doped indium oxide, antimony-doped or tantalum-doped tin oxide, antimony-doped zirconium oxide, and the like. These may be used alone or in a combination of 2 or more kinds thereof. When 2 or more kinds thereof are used in combination, these may be simply mixed or made into a solid solution or a fused product. The average particle diameter of the conductive particles is preferably 0.3 μm or less, particularly preferably 0.1 μm or less, from the viewpoint of transparency of the protective layer (functional layer).

The charge transporting composition used for forming the protective layer (functional layer) is preferably prepared in the form of a coating liquid for forming a protective layer (coating liquid for forming a functional layer). The coating liquid for forming a protective layer may be free of a solvent, or if necessary, may contain a solvent such as alcohols including methanol, ethanol, propanol, butanol, cyclopentanol, cyclohexanol, and the like; ketones including acetone, methyl ethyl ketone, and the like; or ethers including tetrahydrofuran, diethyl ether, dioxane, and the like.

The solvent may be used alone or as a mixture of 2 or more kinds, but the solvent has a boiling point of preferably 100° C. or lower. As the solvent, in particular, a solvent having at least one hydroxyl group (for example, alcohols and the like) is preferably used.

The coating liquid for forming a protective layer including the composition for forming the protective layer (functional layer) is coated on the charge transporting layer with a conventional method such as a blade coating method, a wire bar coating method, a spray coating method, a dip coating method, a bead coating method, an air knife coating method, a curtain coating method, and the like, and then if necessary, the resultant coating is polymerized (cured) by, for example, heating at a temperature of 100° C. or higher and 170° C. or lower, thereby obtaining a film. As a result, the protective layer (functional layer) including the film is obtained.

Further, the oxygen concentration during polymerization (curing) of the coating liquid for forming the protective layer (functional layer) is preferably 1% by mass or less, more preferably 1000 ppm or less, and still more preferably 500 ppm or less.

An example of a function-separate type electrophotographic photoreceptor is described above, but the content of the charge generating material in a single layer type photosensitive layer 6 (a charge generating/charge transporting layer) as shown in FIG. 2 is 10% by mass or more and 85% by mass or less, and preferably 20% by mass or more and 50% by mass or less. The content of the charge transporting material is preferably 5% by mass or more and 50% by mass or less. The method for forming the singlelayer type photosensitive layer 6 (a charge generating/charge transporting layer) is similar to the method for forming the charge generating layer or the charge transporting layer. The thickness of the single-layer type photosensitive layer (a charge generating/charge transporting layer) 6 is preferably from 5 μM or more and 50 μm or less, and more preferably from 10 μm or more and 40 μm or less.

Moreover, in the present exemplary embodiment, an exemplary embodiment in which the outermost layer including a functional layer is a protective layer is described. In the case of a constitution of layers where the protective layer is not included, a charge transporting layer that is positioned on the outermost surface in the configuration of layers serves as the outermost layer, on which the functional layer may be applied.

Furthermore, even when the protective layer exists, the functional layer may be applied as a charge transporting layer for the undercoat layer.

[Image Forming Apparatus/Process Cartridge]

Figure 4:
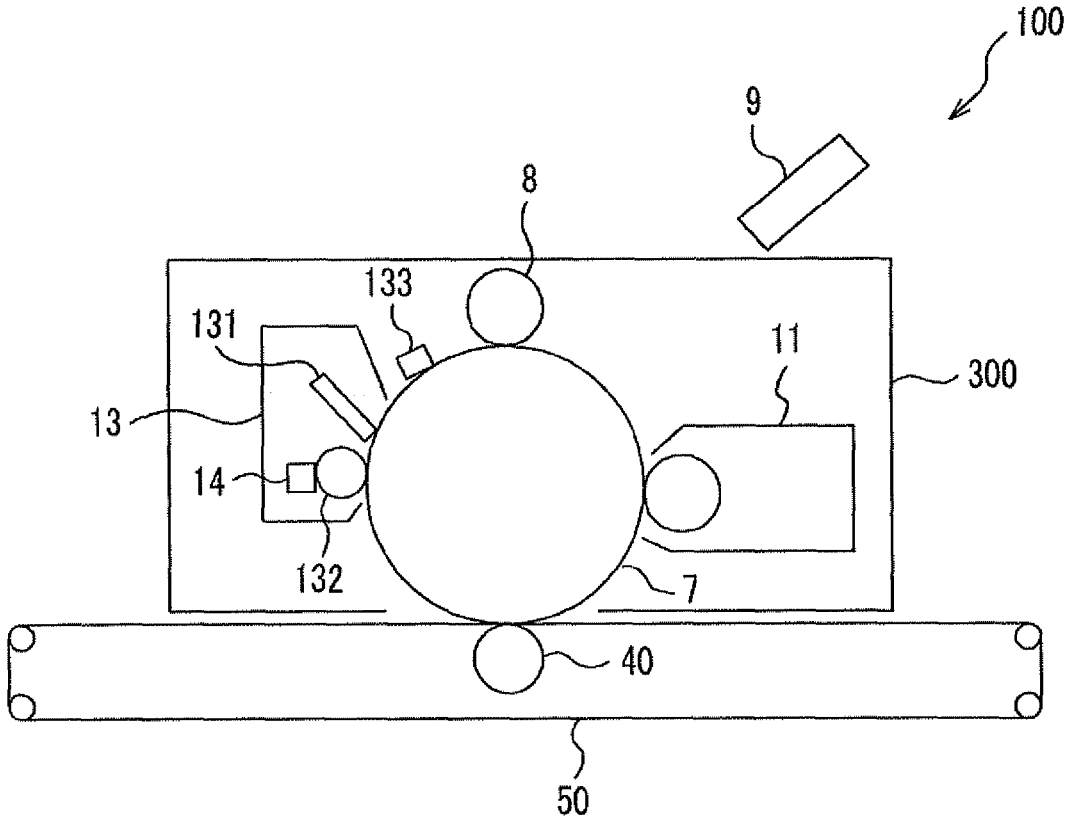
FIG. 4 is a schematic structural view showing an image forming apparatus according to an exemplary embodiment.

FIG. 4 is a schematic structural view showing an image forming apparatus 100 according to an exemplary embodiment.

As shown in FIG. 4, the image forming apparatus 100 includes a process cartridge 300 equipped with electrophotographic photoreceptor 7, an exposure device (electrostatic latent image forming unit) 9, a transfer device (transfer unit) 40, and an intermediate transfer medium 50. In the image forming apparatus 100, the exposure device 9 is disposed so as to irradiate the electrophotographic photoreceptor 7 through the opening of the process cartridge 300, the transfer device 40 is disposed so as to oppose the electrophotographic photoreceptor 7 via the intermediate transfer medium 50, and the intermediate transfer medium 50 is disposed so as to be partially in contact with the electrophotographic photoreceptor 7.

The process cartridge 300 in FIG. 4 integrally supports the electrophotographic photoreceptor 7, the charging device (charging unit) 8, a developing device (developing unit) 11 and a cleaning device 13, in a housing. The cleaning device 13 has a cleaning blade 131 (cleaning member). The cleaning blade 131 is disposed so as to be in contact with the surface of the electrophotographic photoreceptor 7.

Further, the process cartridge 300 is not particularly limited as long as it has a constitution where it includes the electrophotographic photoreceptor 7 and is detachable from the image forming apparatus, and if necessary, it may have a constitution where it integrally supports the devices other than the electrophotographic photoreceptor 7 (for example, one selected from the charging device (charging unit) 8, the developing device (developing unit) 11, and the cleaning device 13) together with the electrophotographic photoreceptor 7.

Furthermore, in FIG. 4, an example for the cleaning device 13 is shown, which is equipped with fibrous member 132 (in the form of a roll) feeding lubricant 14 to the surface of photoreceptor 7, and using fibrous member 133 (in the form of a flat brush) as a cleaning assist, and these members are used according to necessity.

As the charging device 8, for example, a contact-type charging device employing a conductive or semiconductive charging roller, a charging brush, a charging film, a charging rubber blade, a charging tube, or the like may be used. Known non contact-type charging devices such as a non contact-type roller charging device, a scorotron or corotron charging device utilizing corona discharge, and the like, may also be used.

Further, in order to improve stability of the image, a photoreceptor heating member, although not shown, may be provided around the electrophotographic photoreceptor 7 thereby increasing the temperature of the electrophotographic photoreceptor 7 and reducing the relative temperature.

Examples of the exposure device 9 include optical instruments which can expose the surface of the photoreceptor 7 so that a desired image is formed by using light of semiconductor laser light, LED light, a liquid-crystal shutter light, or the like. The wavelength of light sources to be used is in the range of the spectral sensitivity region of the photoreceptor. As the semiconductor laser light, near-infrared light having an oscillation wavelength in the vicinity of 780 nm is predominantly used. However, the wavelength of the light source is not limited to the above-described wavelength, and lasers having an oscillation wavelength on the order of 600 nm and blue lasers having an oscillation wavelength in the vicinity of 400 nm or more and 450 nm or less can also be used. Further, a surface-emitting type laser light source which is capable of multi-beam output is effective to form a color image.

As the developing device 11, for example, a common developing device, in which a magnetic or non-magnetic one- or two-component developer is brought into contact or not brought into contact for forming an image, can be used. Such a developing device is not particularly limited as long as it has above-described functions, and can be appropriately selected according to the preferable use. Examples thereof include known a developing device in which the above single- or two-component developer is applied to the photoreceptor 7 using a brush, a roller, or the like. Among these, the developing device using a developing roller retaining developer on the surface thereof is preferable.

Examples of the transfer device 40 include known transfer charging devices such as a contact type transfer charging devices using a belt, a roller, a film, a rubber blade, or the like, a scorotron transfer charging device or corotron transfer charging device utilizing corona discharge, and the like.

As the intermediate transfer medium 50, a belt which is imparted semiconductivity (intermediate transfer belt) of polyimide, polyamideimide, polycarbonate, polyarylate, polyester, rubber, or the like is used. The intermediate transfer medium 50 may also take the form of a drum.

In addition to the above-described devices, the image forming apparatus 100 may further be provided with, for example, a photodischarging device for photodischarging the photoreceptor 7.

Figure 5:
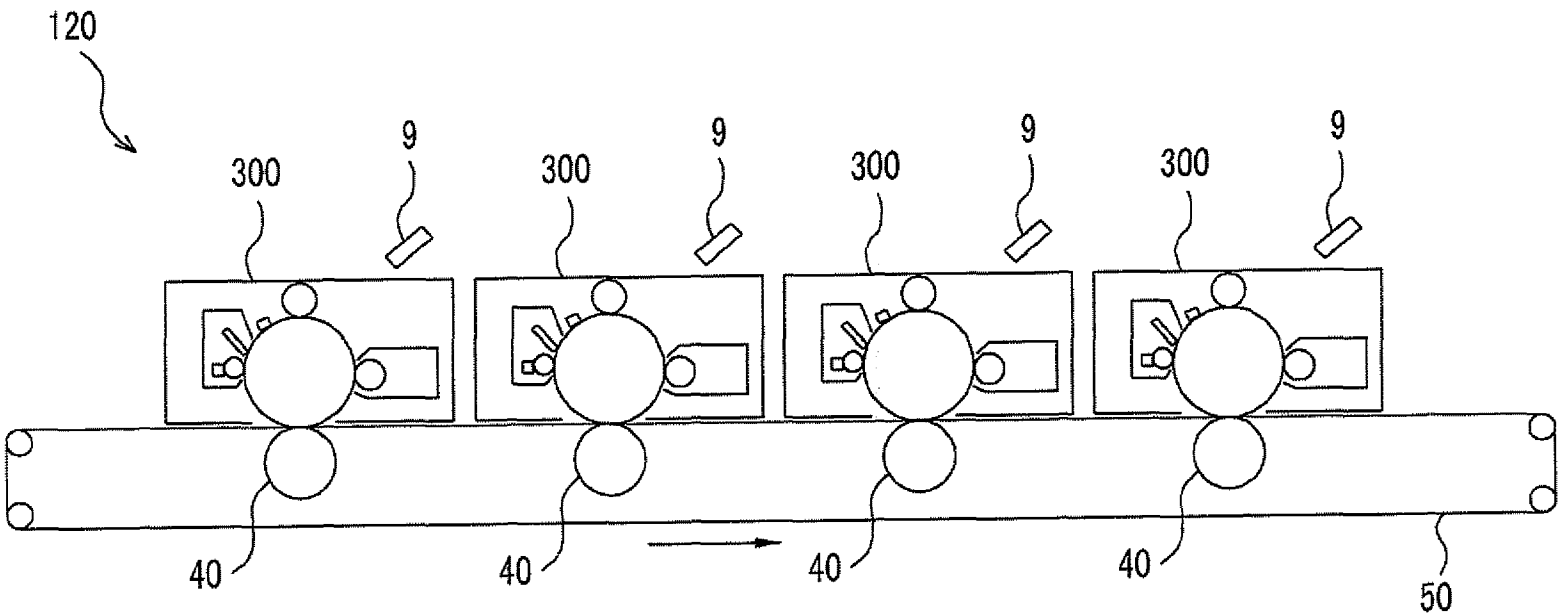
FIG. 5 is a schematic structural view showing an image forming apparatus according to another exemplary embodiment; and Each of FIGS. 6A to 6C is an explanatory view showing the criteria for image defect evaluation.

FIG. 5 is a schematic sectional view showing an exemplary embodiment of a tandem type image forming apparatus 120 using a process caitiidge including the electrophotographic photoreceptor of the invention.

The image forming apparatus 120 shown in FIG. 5 is a tandem type full color image forming apparatus equipped with four process cartridges 300.

In the image forming apparatus 120, four process cartridges 300 are disposed parallel with each other on the intermediate transfer medium 50, and one electrophotographic photoreceptor can be used for one color. The image forming apparatus 120 has the same constitution as the image forming apparatus 100, except that it is a tandem type.

The image forming apparatus according to the present exemplary embodiment is not limited to the constitutions above, but other known types of image forming apparatuses may be applied.

EXAMPLES

Hereinbelow, the present invention will be described in more detail with reference to Examples. However, the present invention is not limited thereto.

Example 1

Preparation of Electrophotographic Photoreceptor

—Preparation of Undercoat Layer—

100 parts by mass of zinc oxide (average particle diameter: 70 nm, manufactured by Tayca Corporation, specific surface area: 15 $m^2/g$) is stirred and mixed with 500 parts by mass of toluene, into which 1.3 parts by mass of a silane coupling agent (KBM503, manufactured by Shin-Etsu Chemical Co., Ltd.) is added, and the mixture is stirred for 2 hours, Subsequently, the solvent is removed by distillation under reduced pressure, and baking is carried out at a temperature of 120° C. for 3 hours to obtain zinc oxide having a surface treated with the silane coupling agent.

110 parts by mass of the surface-treated zinc oxide is stirred and mixed with 500 parts by mass of tetrahydrofuran, to which a solution in which 0.6 part by mass of alizarin is dissolved in 50 parts by mass of tetrahydrofuran is added, and the mixture is then stirred at a temperature of 50° C. for 5 hours. Subsequently, the zinc oxide to which the alizarin is added is collected by filtration under a reduced pressure, and dried under reduced pressure at a temperature of 60° C. to obtain alizarin-added zinc oxide.

38 parts by mass of a solution prepared by dissolving 60 parts by mass of the alizarin-added zinc oxide, 13.5 parts by mass of a curing agent (blocked isocyanate, Sumidur 3175, manufactured by Sumitomo-Bayer Urethane Co., Ltd.) and 15 parts by mass of a butyral resin (S-Lee BM-1, manufactured by Sekisui Chemical Co., Ltd.) in 85 parts by mass of methyl ethyl ketone is mixed with 25 parts by mass of methyl ethyl ketone. The mixture is dispersed using a sand mill with glass beads having a diameter of 1 minϕ for 2 hours to obtain a dispersion.

0.005 part by mass of dioctyltin dilaurate as a catalyst, and 40 parts by mass of silicone resin particles (Tospal 145, manufactured by GE Toshiba Silicone Co., Ltd.) are added to the dispersion to obtain a coating liquid for forming an undercoat layer. An undercoat layer having a thickness of 20 μm is formed by applying the coating liquid on an aluminum substrate by a dip coating method, and drying to cure at a temperature of 170° C. for 40 minutes.

—Preparation of Charge Generating Layer—

A mixture comprising 15 parts by mass of hydroxygallium phthalocyanine having the diffraction peaks at least at 73°, 16.0°, 24.9° and 28.0° of Bragg angles)(2θ±0.2°) in an X-ray diffraction spectrum of CuKα characteristic X-ray as a charge generating substance, 10 parts by mass of vinyl chloride-vinyl acetate copolymer resin (VMCH, manufactured by Nippon Unicar Co., Ltd.) as a binder resin, and 200 parts by mass of n-butyl acetate is dispersed using a sand mill with glass beads of 1 mmϕ diameter for 4 hours. 175 parts by mass of n-butyl acetate and 180 parts by mass of methyl ethyl ketone are added to the obtained dispersion, and the mixture is then stirred to obtain a coating liquid for forming a charge generating layer. The coating liquid for forming a charge generating layer is applied to the undercoat layer by a dip coating method, and dried at an ordinary temperature (25° C.) to form a charge generating layer having a film thickness of 0.2 μm.

—Preparation of Charge Transporting Layer—

48 parts by mass of N,N'-diphenyl-N,N'-bis(3-methylphenyl)-[1,1']biphenyl-4,4'-diamine (hereinafter referred to as "TPD") and 52 parts by mass of a bisphenol Z polycarbonate resin (hereinafter referred to as, "PCZ500", viscosity average molecular weight: 50,000) are dissolved in 800 parts by mass of chlorobenzene to obtain a coating liquid for forming a charge transporting layer. The coating liquid is applied onto the charge generating layer, and then dried at a temperature of 130° C. for 45 minutes to form a charge transporting layer having a film thickness of 20 μm.

—Preparation of Protective Layer—

30 parts by mass of the compound represented by formula (I) (Compound I-10), 70 parts by mass of the compound represented by formula (I) (Compound II-18), and 20 parts by mass of monomers having no charge transporting ability ("BEP-500" manufactured by Shin-Nakamura Chemical Co., Ltd.) are dissolved in 200 parts by mass of tetrahydrofuran (THF), and further, 2.4 parts by mass of an initiator VE-73 (manufactured by Wako Pure Chemical Industries, Ltd.), and 10 parts by mass of a polymer (4) are dissolved therein to obtain a coating liquid for forming a protective layer. This coating liquid is coated on the charge transporting layer and heated at 145° C. for 40 minutes under an atmosphere of an oxygen concentration of approximately 80 ppm to form a 7 μm thick protective layer.

By the above method, an electrophotographic photoreceptor is obtained. This photoreceptor is taken as a photoreceptor 1.

(Evaluation)

The prepared electrophotographic photoreceptor is installed on a "Color 1000 Plus" manufactured by Fuji Xerox Co., Ltd., and 50,000 sheets of 15% half-tone image are printed under an environment of 10° C. and 15% RH.

After printing 50,000 sheets, an image evaluation test (1) is carried out under the same environmental conditions. Further, after the image evaluation test (1), the image forming apparatus is left to stand at 28° C. and 80% RH for 24 hours, and then, for the image quality of the image on the sheet printed firstly thereafter, an image quality evaluation test (2) is carried out under the same environmental conditions.

Here, in the image evaluation test (1) and the image evaluation test (2), the density unevenness, the streak, the image defect, and the residual image phenomenon (referred to as "ghost") that is generated by a persisting history of previous images, shown below, are evaluated.

Further, for the image forming test, Paper P (size A4, horizontal transfer) manufactured by FXOS Co., Ltd. is used.

The evaluation results are shown in Table 4.

—Evaluation of Density Unevenness—

The density unevenness is evaluated by visual observation using a 20% half-tone sample.

A: Development of density unevenness is not observed.

B: Development of partial density unevenness is observed.

C: Development of density unevenness having a damaging effect on image quality is observed.

—Evaluation of Streaks—

The streaks are evaluated by visual observation using a 20% half-tone sample.

A: Development of streaks is not observed.

B: Development of partial streaks is observed.

C: Development of streaks having a damaging effect on image quality is observed.

—Evaluation of Image Defect—

Evaluation of the image defect is carried out in the following manner as the evaluation used for the above tests.

The image defect is evaluated by visual observation using a 20% half-tone sample.

A: Development of image defect is not observed.

B: No problem occurred during the continuous printing test, but development of image defect is observed after leaving the sample for 24 hours.

C: Development of image defect is observed during the continuous printing test.

—Evaluation of Ghost—

Figure 6A:
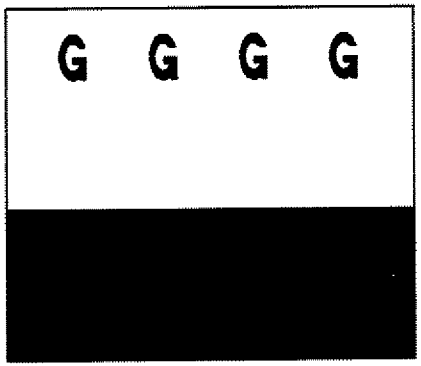

A chart having a pattern of letters G and a black area shown in FIG. 6A is printed, and the state where the letters G appeared in the black area is evaluated by visual observation.

A: The degree is from good to slight as in FIG. 6A.

Figure 6B:
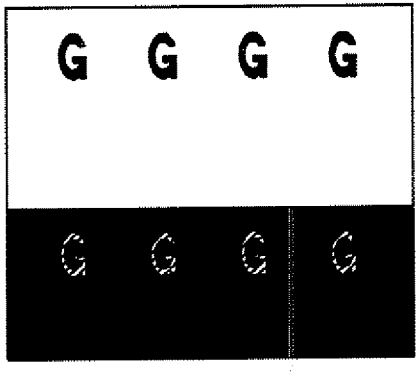

B: Slightly conspicuous as in FIG. 6B.

Figure 6C:
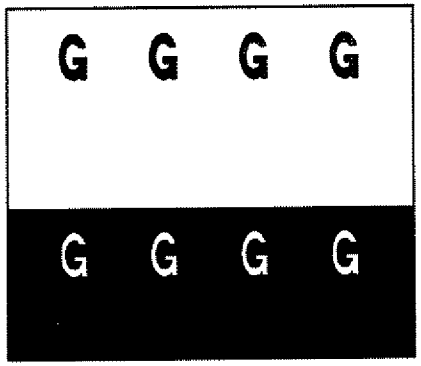

C: Clearly observed as in FIG. 6C.

—Surface Observation—

The surface of the electrophotographic photoreceptor is observed in the image quality tests (1) and (2), and then evaluated as follows:

A: Neither scars nor depositions are found even at a magnification of 20 times, which is thus good.

B: Slight scars and depositions are found at a magnification of 20 times.

C: Scars and depositions are found even with the naked eye.

Examples 2 to 20 and 23 to 24, and Comparative Examples 1 to 3

Preparation of Electrophotographic Photoreceptor

The charge transporting layers are prepared in the same manner as in Example 1, and the compositions of the protective layers are changed as in Tables 1 to 3, thereby obtaining coating liquids for forming protective layers. Each of the coating liquids is coated on the charge transporting layer, and heated at 145° C. for 40 minutes under an atmosphere of an oxygen concentration of approximately 80 ppm, thereby forming a 7 μm thick protective layer.

By the method as described above, electrophotographic photoreceptors are obtained. These photoreceptors are taken as photoreceptors 2 to 20 and 23 to 24, and comparative photoreceptors 1 to 3.

(Evaluation)

The resulting photoreceptor is evaluated in the same manner as in Example 1. The results are shown in Tables 4 to 6.

Example 21

Preparation of Electrophotographic Photoreceptor

The charge transporting layer is prepared in the same manner as in Example 1, and the composition of the protective layer is changed as in Table 3, thereby obtaining a coating liquid for forming a protective layer. The coating liquid is coated on the charge transporting layer, and the resultant coating is irradiated with UV at an illuminance of 700 mW/cm$^2$ (at a reference wavelength of 365 nm) for an irradiation period of 60 seconds under an atmosphere of an oxygen concentration of approximately 80 ppm, using a metal halide lamp (manufactured by USHIO Inc.). The coating is heated at 150° C. for 40 minutes to form a 7 μm thick protective layer.

By this method, an electrophotographic photoreceptor is obtained. This photoreceptor is taken as a photoreceptor 21.

(Evaluation)

The resulting photoreceptor is evaluated in the same manner as in Example 1. The results are shown in Table 6.

Example 22

Preparation of Electrophotographic Photoreceptor

The charge generating layer is prepared in the same manner as in Example 1, and the composition of the charge transporting layer is changed as in Table 3 and the amount of the solvent to be used is changed to 250 parts by mass, thereby obtaining a coating liquid for forming a charge transporting layer. The coating liquid is coated on the charge generating layer, and the resultant coating is heated at 145° C. for 40 minutes under an atmosphere of an oxygen concentration of approximately 80 ppm to form a 20 μm thick charge transporting layer.

By this method, an electrophotographic photoreceptor is obtained. This photoreceptor is taken as a photoreceptor 22.

(Evaluation)

The resulting photoreceptor is evaluated in the same manner as in Example 1. The results are shown in Table 6.

TABLE 1

| Composition | | Example 1 Photo-receptor 1 | Example 2 Photo-receptor 2 | Example 3 Photo-receptor 3 | Example 4 Photo-receptor 4 | Example 5 Photo-receptor 5 | Example 6 Photo-receptor 6 | Example 7 Photo-receptor 7 | Example 8 Photo-receptor 8 | Example 9 Photo-receptor 9 | Example 10 Photo-receptor 10 |
|---|---|---|---|---|---|---|---|---|---|---|---|
| Monomer having charge transporting ability | Kind (1) | i-10 | i-13 | ii-18 | ii-24 | ii-22 | ii-22 | iv-17 | iv-09 | ii-24 | ii-24 |
| | Amount (parts by mass) | 30 | 30 | 60 | 60 | 105 | 60 | 60 | 60 | 60 | 60 |
| | Kind (2) | ii-18 | ii-18 | | | | | | | | |
| | Amount (parts by mass) | 70 | 70 | | | | | | | | |

TABLE 1-continued

| Composition | | Example 1 Photo-receptor 1 | Example 2 Photo-receptor 2 | Example 3 Photo-receptor 3 | Example 4 Photo-receptor 4 | Example 5 Photo-receptor 5 | Example 6 Photo-receptor 6 | Example 7 Photo-receptor 7 | Example 8 Photo-receptor 8 | Example 9 Photo-receptor 9 | Example 10 Photo-receptor 10 |
|---|---|---|---|---|---|---|---|---|---|---|---|
| Monomer having no charge transporting ability | Kind (1) | BPE-500 | BPE-500 | BPE-500 | BPE-500 | | BPE-500 | BPE-500 | BPE-500 | BPE-500 | BPE-500 |
| | Amount (parts by mass) | 20 | 20 | 35 | 35 | | 35 | 35 | 35 | 35 | 35 |
| | Kind (2) | | | | | | | | | | |
| | Amount (parts by mass) | | | | | | | | | | |
| Thermo-plastic resin | Kind | | | | | | | | | | |
| | Amount (parts by mass) | | | | | | | | | | |
| Initiator | Kind | VE-73 | VE-73 | VE-73 | VE-73 | VE-73 | VE-73 | VE-73 | VE-73 | VE-73 | VE-73 |
| | Amount (parts by mass) | 2.4 | 2.4 | 2.2 | 2.2 | 2.2 | 2.2 | 2.2 | 2.2 | 2.2 | 2.2 |
| Additive | Kind | Polymer 4 | Polymer 4 | Polymer 4 | Polymer 4 | Polymer 4 | Polymer 4 | Polymer 4 | Polymer 4 | Bis(2-ethylhexyl) adipate | Diethylene glycol diacetate |
| | Amount (parts by mass) | 10 | 10 | 10 | 10 | 10 | 10 | 10 | 10 | 10 | 10 |

TABLE 2

| Composition | | Example 11 Photo-receptor 11 | Example 12 Photo-receptor 12 | Example 13 Photo-receptor 13 | Example 14 Photo-receptor 14 | Example 15 Photo-receptor 15 | Example 16 Photo-receptor 16 | Example 17 Photo-receptor 17 | Example 18 Photo-receptor 18 | Example 19 Photo-receptor 19 | Example 20 Photo-receptor 20 |
|---|---|---|---|---|---|---|---|---|---|---|---|
| Monomer having charge transporting ability | Kind (1) | ii-24 | ii-24 | ii-18 | ii-22 | ii-19 | iv-09 | ii-24 | ii-24 | ii-19 | ii-24 |
| | Amount (parts by mass) | 60 | 60 | 60 | 60 | 60 | 60 | 60 | 60 | 60 | 60 |
| | Kind (2) | | | | | | | | | | |
| | Amount (parts by mass) | | | | | | | | | | |
| Monomer having no charge transporting ability | Kind (1) | BPE-500 | BPE-500 | BPE-500 | BPE-500 | BPE-500 | BPE-500 | BPE-500 | BPE-500 | BPE-500 | BPE-500 |
| | Amount (parts by mass) | 35 | 35 | 35 | 35 | 35 | 35 | 35 | 35 | 35 | 35 |
| | Kind (2) | | | | | | | | | | |
| | Amount (parts by mass) | | | | | | | | | | |
| Thermoplastic resin | Kind | | | | | | | | | | |
| | Amount (parts by mass) | | | | | | | | | | |
| Initiator | Kind | VE-73 | VE-73 | VE-73 | VE-73 | VE-73 | VE-73 | VE-73 | VE-73 | VE-73 | VE-73 |
| | Amount (parts by mass) | 2.2 | 2.2 | 2.2 | 2.2 | 2.2 | 2.2 | 2.2 | 2.2 | 2.2 | 2.2 |
| Additive | Kind | Diethylene glycol dibutyl ether | ARUFON UP-1000 | ARUFON UP-1000 | ARUFON UP-1000 | ARUFON UP-1000 | ARUFON UP-1000 | ARUFON UP-1170 | ARUFON UP-1000 | ARUFON UP-1170 | D643 |
| | Amount (parts by mass) | 10 | 10 | 10 | 10 | 10 | 10 | 10 | 10 | 10 | 10 |

TABLE 3

| Composition | | Example 21 Photo-receptor 21 | Example 22 Photo-receptor 22 | Example 23 Photo-receptor 23 | Example 24 Photoreceptor 24 | Comparative Example 1 Comparative photoreceptor 1 | Comparative Example 2 Comparative photoreceptor 2 | Comparative Example 3 Comparative photoreceptor 3 |
|---|---|---|---|---|---|---|---|---|
| Monomer having charge transporting ability | Kind (1) | ii-24 | iv-09 | ii-24 | ii-24 | ii-24 | ii-24 | ii-24 |
| | Amount (parts by mass) | 60 | 60 | 60 | 60 | 60 | 60 | 60 |
| | Kind (2) | | | | | | | |
| | Amount (parts by mass) | | | | | | | |
| Monomer having no charge transporting ability | Kind (1) | | | | | | | |
| | Amount (parts by mass) | BPE-500 | BPE-500 | BPE-500 | BPE-500 | BPE-500 | BPE-500 | BPE-500 |
| | Kind (2) | 35 | 35 | 35 | 35 | 35 | 35 | 35 |
| | Amount (parts by mass) | | | | | | | |
| Thermoplastic resin | Kind | | PCZ-400 | | | | | |
| | Amount (parts by mass) | | 35 | | | | | |
| Initiator | Kind | Irgacure 819 | VE-73 | VE-73 | VE-73 | VE-73 | VE-73 | VE-73 |
| | Amount (parts by mass) | 2.2 | 2.2 | 2.2 | 2.2 | 2.2 | 2.2 | 2.2 |
| additive | Kind | ARUFON UP-1000 | ARUFON UP-1000 | Dibutyl phthalate | BA-2 glycol | None | Polymer (2) | Polymer (3) |
| | Amount (parts by mass) | 10 | 5 | 10 | 10 | | 10 | 10 |

TABLE 4

| | | Example 1 | Example 2 | Example 3 | Example 4 | Example 5 | Example 6 | Example 7 | Example 8 | Example 9 | Example 10 |
|---|---|---|---|---|---|---|---|---|---|---|---|
| Test (1) | Density unevenness | A | A | B | A | A | A | A | A | B | B |
| | Streaks | A | A | A | A | A | A | A | A | B | B |
| | Image defect | A | A | A | A | A | A | A | A | A | A |
| | Ghost | A | A | A | A | A | A | A | A | A | A |
| | Surface observation | B | B | A | A | A | A | A | A | A | A |
| Test (2) | Density unevenness | B | B | A | B | B | A | A | A | B | B |
| | Streaks | B | B | A | B | A | B | A | A | B | B |
| | Image defect | A | A | A | A | A | A | A | A | A | A |
| | Ghost | A | A | A | A | A | A | A | A | A | A |
| | Surface observation | B | B | B | A | B | B | A | A | B | B |

TABLE 5

| | | Example 11 | Example 12 | Example 13 | Example 14 | Example 15 | Example 16 | Example 17 | Example 18 | Example 19 | Example 20 |
|---|---|---|---|---|---|---|---|---|---|---|---|
| Test (1) | Density unevenness | B | A | A | A | A | A | A | B | A | B |
| | Streaks | B | A | A | A | A | A | A | A | A | B |
| | Image defect | A | A | A | A | A | A | A | A | A | A |
| | Ghost | A | A | A | A | A | A | A | A | A | A |
| | Surface observation | A | A | A | A | A | A | A | B | A | B |
| Test (2) | Density unevenness | B | B | A | A | A | A | B | B | B | B |
| | Streaks | B | A | A | A | B | A | A | B | A | B |
| | Image defect | A | A | A | A | A | A | A | A | A | A |
| | Ghost | A | A | A | A | A | A | B | A | A | A |
| | Surface observation | B | A | B | B | A | A | A | B | B | B |

TABLE 6

| | | Example 21 | Example 22 | Example 23 | Example 24 | Comparative Example 1 | Comparative Example 2 | Comparative Example 3 |
|---|---|---|---|---|---|---|---|---|
| Test (1) | Density unevenness | A | A | B | B | B | B | B |
| | Streaks | A | A | B | B | A | A | A |
| | Image defect | A | A | A | A | B | B | A |
| | Ghost | B | B | A | A | C | B | A |
| | Surface observation | A | A | B | B | A | A | B |
| Test (2) | Density unevenness | B | B | B | B | C | C | B |
| | Streaks | A | B | B | B | B | B | B |
| | Image defect | A | A | A | B | B | B | B |
| | Ghost | B | B | A | A | C | C | B |
| | Surface observation | B | B | B | B | B | B | C |

From the above-described results, it can be seen that in the present Examples, comprehensively good results are obtained, with regard to density unevenness, streaks, image defect, ghost, and surface observation, as compared with Comparative Examples.

The abbreviations described in Tables 1 to 3 above will be described below.

(Monomer Having No Charge Transporting Ability)

BEP-100 (manufactured by Shin-Nakamura Chemical Co., Ltd.)

(Thermoplastic Resin)

PCZ-400: Bisphenol Z polycarbonate resin manufactured by Mitsubishi Gas Chemical Company, Inc. (viscosity average molecular weight 40,000)

(Initiator)

VE-73: Initiator manufactured by Wako Pure Chemical Industries, Ltd. (heat radical generator)

Irgacure 819: Initiator manufactured by Ciba Specialty Chemicals Inc. (photo radical generator)

(Additives)

Dibutyl phthalate: manufactured by Tokyo Chemical Industry Co., Ltd.

Bis(2-ethylhexyl) adipate: manufactured by Tokyo Chemical Industry Co., Ltd. (liquid at 25° C. and under 1 atmosphere)

Diethylene glycol diacetate: manufactured by Tokyo Chemical Industry Co., Ltd. (liquid at 25° C. and under 1 atmosphere)

Diethylene glycol dibutyl ether: manufactured by Tokyo Chemical Industry Co., Ltd. (liquid at 25° C. and under 1 atmosphere)

ARUFON UP-1000: Compound including the repeating units represented by formula (AA) (Ra=hydrogen atom (H), Rb=butyl group), manufactured by Toagosei Co., Ltd., weight average molecular weight Mw 3000 (liquid at 25° C. and under 1 atmosphere)

ARUFON UP-1170: Compound including the repeating units represented by formula (AA) (Ra=hydrogen atom, Rb=butyl group), manufactured by Toagosei Co., Ltd. weight average molecular weight Mw 8000 (liquid at 25° C. and under 1 atmosphere)

D643: Compound including the repeating units represented by formula (BB) (A=butylene group, B=butylene group), manufactured by J-PLUs Co., Ltd., weight average molecular weight Mw 1800 (liquid at 25° C. and under 1 atmosphere)

BA-2 Glycol: manufactured by Nippon Nyukazai Co., Ltd. (solid at 25° C. and under 1 atmosphere)

Polymer (1): Polymer obtained in the following Synthesis Example 1: weight average molecular weight Mw 9700

Synthesis Example 1

30 parts by mass of butyl methacrylate, 50 parts by mass of toluene, and 0.7 part by mass of azobisisobutyronitrile are collected into a 2-neck flask equipped with a nitrogen inlet tube and a condenser, and replaced with nitrogen. Thereafter, the temperature is slowly raised to 90° C. under stirring to perform a reaction for 3 hours. Thereafter, the solvent is removed by distillation under reduced pressure, and further, the temperature is raised to 140° C. while blowing air into the residue, followed by stirring for 1 hour, thereby obtaining a polymer (1) which is liquid at 25° C. and under 1 atmosphere. The weight average molecular weight Mw of the resulting polymer is 9700 (in terms of polystyrene).

The present polymer (1) is a compound including the repeating units represented by formula (AA) (Ra=methyl group, Rb=butyl group).

Polymer (2): Polymer obtained in the following Synthesis Example 2: weight average molecular weight Mw 19000

Synthesis Example 2

In the same manner as in Synthesis Example 1 except that 0.4 part by mass of azobisisobutyronitrile is used, a polymer (2) which is liquid at 25° C. and under 1 atmosphere is obtained. The weight average molecular weight Mw of the resulting polymer is 19000 (in terms of polystyrene).

Polymer (3): Polymer obtained in the following Synthesis Example 3: weight average molecular weight Mw 11000

Synthesis Example 3

In the same manner as in Synthesis Example 1 except that 0.6 part by mass of azobisisobutyronitrile is used, a polymer (3) which is liquid at 25° C. and under 1 atmosphere is obtained. The weight average molecular weight Mw of the resulting polymer is 11000 (in terms of polystyrene).

Polymer (4): Polymer obtained in the following Synthesis Example 4: weight average molecular weight Mw 8000

Synthesis Example 4

In the same manner as in Synthesis Example 1 except that 0.75 part by mass of azobisisobutyronitrile is used, a polymer (4) which is liquid at 25° C. and under 1 atmosphere is obtained. The weight average molecular weight Mw of the resulting polymer is 8000 (in terms of polystyrene).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor, comprising:

a functional layer containing a polymer of a first compound having a chain polymerizable functional group and a charge transporting skeleton in one molecule, and at least one second compound selected from the group consisting of a compound including at least one kind of a repeating unit represented by the following formula (BB) and having a weight average molecular weight of 10000 or less, a phthalic ester, a trimellitic ester, a fatty acid ester, a polyhydric alcohol ester, and a polyhydric alcohol ether:

(BB)

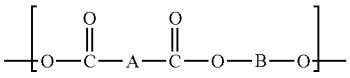

wherein in the formula (BB), A and B each independently represent an alkylene group having 1 to 20 carbon atoms.

2. The electrophotographic photoreceptor according to claim 1, wherein the second compound is a compound which is liquid at 25° C. and under 1 atmosphere.

3. The electrophotographic photoreceptor according to claim 1, wherein the functional layer is an outermost layer.

4. The electrophotographic photoreceptor according to claim 1, wherein the first compound is a compound having 2 or more of the chain polymerizable functional groups in one molecule.

5. The electrophotographic photoreceptor according to claim 1, wherein the first compound is a compound represented by the following formula (I):

(I)

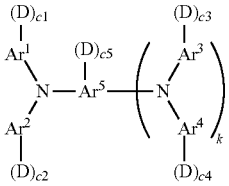

wherein in the formula (I), $Ar^1$ to $Ar^4$ each independently represent a substituted or unsubstituted aryl group; $Ar^5$ represents a substituted or unsubstituted aryl group, or a substituted or unsubstituted arylene group; D represents a group containing a functional group having a carbon double bond; c1 to c5 independently represent 0, 1, or 2; k represents 0 or 1; and a total number of D's is 1 or more.

6. The electrophotographic photoreceptor according to claim 5, wherein in the compound represented by formula (I), D represents a group having at least one selected from the group consisting of an acryloyl group, a methacryloyl group, a vinylphenyl group, an allyl group, a vinyl group, a vinyl ether group, an ally vinyl ether group, and derivatives thereof.

7. The electrophotographic photoreceptor according to claim 1, wherein the functional layer further contains a heat radical generator or a derivative thereof.

8. A process cartridge comprising the electrophotographic photoreceptor of claim 1, the process cartridge being detachable from an image forming apparatus.

9. The process cartridge according to claim 8, wherein the functional layer of the electrophotographic photoreceptor is an outermost layer.

10. The process cartridge according to claim 8, wherein the first compound of the electrophotographic photoreceptor is a compound having 2 or more of the chain polymerizable functional groups in one molecule.

11. The process cartridge according to claim 8, wherein the first compound of the electrophotographic photoreceptor is a compound represented by the following formula (I):

(I)

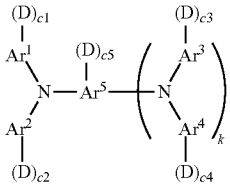

wherein in the formula (I), $Ar^1$ to $Ar^4$ each independently represent a substituted or unsubstituted aryl group; $Ar^5$ represents a substituted or unsubstituted aryl group, or a substituted or unsubstituted arylene group; D represents a group containing a functional group having a carbon double bond; c1 to c5 independently represent 0, 1, or 2; k represents 0 or 1; and a total number of D's is 1 or more.

12. An image forming apparatus, comprising:

the electrophotographic photoreceptor according to claim 1;

a charging unit that charges the electrophotographic photoreceptor;

an electrostatic latent image forming unit that forms an electrostatic latent image on the charged electrophotographic photoreceptor;

a developing unit that develops the electrostatic latent image formed on the electrophotographic photoreceptor by a toner to form a toner image; and a transfer unit that transfers the toner image to a transfer medium.

13. The image forming apparatus according to claim 12, wherein the functional layer of the electrophotographic photoreceptor is an outermost layer.

14. The image forming apparatus according to claim 12, wherein the first compound of the electrophotographic photoreceptor is a compound having 2 or more of the chain polymerizable functional groups in one molecule.

15. The image forming apparatus according to claim 12, wherein the first compound of the electrophotographic photoreceptor is a compound represented by the following formula (I):

(I)

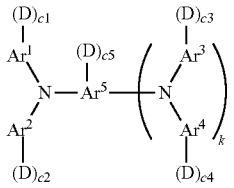

wherein in the formula (I), $Ar^1$ to $Ar^4$ each independently represent a substituted or unsubstituted aryl group; $Ar^5$ represents a substituted or unsubstituted aryl group, or a substituted or unsubstituted arylene group; D represents a group containing a functional group having a carbon double bond; c1 to c5 independently represent 0, 1, or 2; k represents 0 or 1; and a total number of D's is 1 or more.

* * * * *